US012747583B2

(12) United States Patent
Dos Santos Almeida Nunes et al.

(10) Patent No.: US 12,747,583 B2
(45) Date of Patent: Sep. 29, 2026

(54) MASONRY SYSTEM

(71) Applicants: ASSOCIACAO CECOLAB—COLLABORATIVE LABORATORY TOWARDS CIRCULAR ECONOMY, Lagares OHP (PT); ASSOCIACAO BLC3—CAMPUS DE TECNOLOGIA E INOVACAO, Lagares OHP (PT)

(72) Inventors: Joao Miguel Dos Santos Almeida Nunes, Coimbra (PT); Joao Manuel Nunes Pereira Cid Teles, Oliveira Do Hospital (PT); Jorge Almiro Barcelo Caldeira Pinto Paiva, Lisbon (PT)

(73) Assignees: ASSOCIACAO CECOLAB—COLLABORATIVE LABORATORY TOWARDS CIRCULAR ECONOMY, Lagares OHP (PT); ASSOCIACAO BLC3—CAMPUS DE TECNOLOGIA E INOVACAO, Lagares OHP (PT)

( * ) Notice: Subject to any disclaimer, the term of this patent is extended or adjusted under 35 U.S.C. 154(b) by 463 days.

(21) Appl. No.: 18/259,469

(22) PCT Filed: Dec. 28, 2021

(86) PCT No.: PCT/IB2021/062390
§ 371 (c)(1),
(2) Date: Jun. 27, 2023

(87) PCT Pub. No.: WO2022/144772
PCT Pub. Date: Jul. 7, 2022

(65) Prior Publication Data

US 2024/0060294 A1 Feb. 22, 2024

(30) Foreign Application Priority Data

Dec. 29, 2020 (PT) ..... 116979

(51) Int. Cl.
*E04B 2/18* (2006.01)
*E04B 2/02* (2006.01)
*E04C 1/41* (2006.01)

(52) U.S. Cl.
CPC ..... *E04B 2/18* (2013.01); *E04B 2002/0239* (2013.01); *E04B 2002/0282* (2013.01); *E04B 2002/0286* (2013.01); *E04C 1/41* (2013.01)

(58) Field of Classification Search
CPC ..... E04B 2/18; E04B 2002/0286; E04B 2002/0239; E04B 2002/0282; E04B 2/42;
(Continued)

(56) References Cited

U.S. PATENT DOCUMENTS 716,865 A * 12/1902 Choquet et al. ..... E04B 2/18 52/578
811,534 A * 2/1906 Akers et al. ..... E04B 2/18 52/286
(Continued)

FOREIGN PATENT DOCUMENTS

DE 20208886 U1 9/2002
EP 2397619 A1 12/2011
(Continued)

OTHER PUBLICATIONS

Partial Translation of IT-UA20161952-A1 Obtained From https://translate.google.com/; Inventors Parenti Nicola; Montenet Cesare; Parenti Carolina; Parenti Isotta; Maffi Leonardo. Pub Date: Sep. 23, 2017 (Year: 2025).*
(Continued)

*Primary Examiner* — Brian D Mattei
*Assistant Examiner* — Joseph J. Sadlon
(74) *Attorney, Agent, or Firm* — LUCAS & MERCANTI, LLP

(57) ABSTRACT

A masonry system having a primary masonry unit with final coating and thermal and acoustic insulation, with several derivations. The masonry system guarantees the construction of a wall providing final finishing and thermal and acoustic insulation simultaneously. The system is based on a primary masonry unit having a coating layer in its outer face and an insulation layer which, depending on the version
(Continued)

adopted, can be situated in the inner face thereof or in the outer face, covered by the final finishing layer in the latter case. The primary units present a tongue and groove fitting system which allows an easy and quick fitting, allowing the placement of these same units by wet or dry process. The masonry system further foresees secondary units and metallic reinforcements, to prevent phenomena of cracks and fissures and to improve the anti-seismic behavior of the wall.

7 Claims, 60 Drawing Sheets

(58) Field of Classification Search
CPC ..... E04B 2/44; E04B 2/46; E04B 2/52; E04B 2/54; E04B 2002/0213; E04B 2002/0215; E04B 2002/0226; E04B 2002/0228; E04C 1/41; E04F 13/0862; E04F 13/0875; E04F 13/14; E04F 13/141; E04F 13/142; E04F 13/147
USPC ..... 52/293.2
See application file for complete search history.

(56) References Cited

U.S. PATENT DOCUMENTS 962,463 A * 6/1910 Phillips ..... E04D 5/145 52/565
1,772,057 A * 8/1930 Timberlake ..... E04B 2/42 52/426
2,749,739 A * 6/1956 Zagray ..... B28B 7/0079 52/286
2,902,853 A * 9/1959 Lofstrom ..... E04B 2/18 52/505
3,183,628 A * 5/1965 Smith ..... E04B 2/14 52/694
4,028,860 A * 6/1977 Hope ..... E04B 2/42 52/424
4,034,529 A * 7/1977 Lampus ..... E04B 1/4185 52/690
4,110,949 A * 9/1978 Cambiuzzi ..... E04B 2/42 52/437
4,190,995 A * 3/1980 Armistead ..... E04C 1/41 52/592.6
4,228,628 A * 10/1980 Schlomann ..... E04B 2/06 52/438
4,426,815 A * 1/1984 Brown ..... E04B 2/18 D25/115
4,573,301 A * 3/1986 Wilkinson ..... E04B 2/18 52/375
4,597,236 A * 7/1986 Braxton ..... E04B 2/18 52/564
4,651,485 A * 3/1987 Osborne ..... E04B 2/08 52/592.1
4,787,189 A * 11/1988 Haug ..... E04B 2/18 52/603
4,896,472 A * 1/1990 Hunt ..... B28B 7/183 52/592.6
5,245,810 A * 9/1993 Foss ..... E04C 1/41 52/612
5,623,797 A * 4/1997 Gravier ..... E01F 8/0017 52/270
5,802,797 A * 9/1998 Storer-Folt ..... E04B 2/52 52/592.5
5,845,444 A * 12/1998 Besche ..... E04B 2/48 52/421
5,881,511 A * 3/1999 Keller, Jr. ..... E04B 2/08 52/564
6,148,576 A * 11/2000 Janopaul, Jr. ..... E04B 1/4178 52/564
6,189,282 B1 * 2/2001 VanderWerf ..... E04B 2/14 52/582.1
6,508,038 B2 * 1/2003 Al-Ghitta ..... E04B 2/16 52/505
6,625,948 B2 * 9/2003 Valente ..... E04B 5/36 52/745.1
6,769,220 B2 * 8/2004 Friesner ..... B28B 11/042 52/223.7
7,337,589 B2 * 3/2008 Meyer ..... E04B 2/18 52/592.5
7,406,804 B2 * 8/2008 Den Daas ..... E04B 2/04 52/285.3
D600,821 S * 9/2009 Esterhuizen ..... E04B 2/18 D25/113
8,607,516 B2 * 12/2013 O'Brien ..... E04F 13/0736 52/287.1
9,206,599 B2 * 12/2015 Aubé ..... E04B 2/34
9,416,534 B2 * 8/2016 Kovitch ..... E04B 2/18
9,447,578 B2 * 9/2016 DeBoer ..... E04B 2/32
9,593,480 B2 * 3/2017 Vandenbempt ..... E04B 2/18
9,650,784 B2 * 5/2017 Jensen ..... E04B 2/18
9,828,766 B2 * 11/2017 Mori ..... E04C 1/39
10,077,553 B2 * 9/2018 Neumayr ..... E04B 1/14
10,273,684 B2 * 4/2019 Breaz ..... E04C 1/40
10,626,599 B2 * 4/2020 Negev ..... B28B 19/0053
10,883,268 B2 * 1/2021 Jang ..... E04D 11/00
10,941,568 B2 * 3/2021 Weber ..... E04B 2/26
11,208,802 B2 * 12/2021 Raffion ..... E04C 1/41
11,359,370 B2 * 6/2022 Spina ..... E04B 2/18
11,408,173 B2 * 8/2022 Fermanian ..... E04B 2/26
11,525,258 B2 * 12/2022 Nanayakkara ..... E04B 2/18
11,718,985 B2 * 8/2023 Walker ..... E04B 2/30 52/284
11,970,853 B2 * 4/2024 Nicolson ..... C04B 41/5076
12,577,776 B2 * 3/2026 Felton ..... E04B 2/18
2008/0302040 A1 * 12/2008 Lund ..... E04B 2/26 52/309.17
2009/0113835 A1 5/2009 Banova
2009/0173027 A1 * 7/2009 Bennett ..... E04C 1/40 52/596
2010/0018144 A1 * 1/2010 Seibert ..... E04B 2/8617 52/405.2
2012/0090234 A1 * 4/2012 Cronin ..... A01G 9/025 52/576
2013/0232893 A1 * 9/2013 Hohmann, Jr. ..... E04B 1/4185 52/565
2014/0150361 A1 * 6/2014 Castonguay ..... E04B 2/26 52/742.16
2014/0260029 A1 * 9/2014 Browning ..... E04B 1/04 52/564
2018/0347208 A1 * 12/2018 Craft ..... E04B 1/388
2019/0193298 A1 * 6/2019 Chan ..... E04C 1/41
2020/0018083 A1 * 1/2020 Martin ..... E04G 21/1883
2021/0348384 A1 * 11/2021 Savushkin ..... E04C 1/00
2022/0098863 A1 * 3/2022 Ganiev ..... E04C 5/07

FOREIGN PATENT DOCUMENTS

IT UA20161952 A1 * 9/2017 ..... E04B 2/14
KR 20010004693 A * 1/2001 ..... E04C 1/41
RU 2583801 C1 5/2016
WO 2015024134 A1 2/2015

OTHER PUBLICATIONS

International Search Report and Written Opinion for International Application No. PCT/IB2021/062390 (11 Pages) (Apr. 25, 2022).

* cited by examiner

MASONRY SYSTEM

CROSS-REFERENCE TO RELATED APPLICATIONS

This application is a 371 of PCT/IB2021/062390, filed Dec. 28, 2021, which claimed the priority of Portuguese Application No. 116979, filed Dec. 29, 2020, both of which are incorporated herein by reference.

TECHNICAL DOMAIN

The present invention describes a masonry system based on a primary masonry unit which guarantees both the outer coating with final finishing, as the thermal and acoustic insulation. Secondary units and reinforcement units can also integrate the system to construct a wall with high levels of structural, acoustic, and thermal performance.

BACKGROUND

Wall construction is typically made based on rectangular prism masonry units. These units are usually known as bricks or blocks, depending mainly on whether they comprise clay in their constitution or other materials, such as stone or cement. To join the blocks and guarantee a stable and solid structure, mortar or a similar material with cementitious properties is applied in the joints between the masonry units. Further, due to the high permeability of the masonry units and the mortar that unites them and the unattractive appearance of the resulting wall, the need arises to perform a coating. The wall coating is usually guaranteed by the execution of a plastering covered by paint or ceramic tiles, stonework or by applying plates of several materials, for example.

If it is an outer wall, there frequently exist thermal and acoustic requirements to be complied with, and for this reason it is necessary to foresee an insulation solution. The known insulation solutions resort to expanded cork granulate boards, mineral wool blankets and sheets, extruded polystyrene insulation (XPS) or expanded polystyrene insulation (EPS), being usually executed in outer walls, throughout the world. Depending on the thermal properties of the masonry units and the requirements to be complied with, the insulation solutions can be provided on the outer side of the wall, the inner side, or many times by filling an air box between two masonry unit wall panels. Whatever the materials and wall systems chosen, they require at least, two or three steps that are unsynchronized in time to construct an outer wall.

Despite the wide and prolonged use of the previously referred masonry units and systems, there exist important disadvantages related to the construction and the working of these same solutions. In the first place, there is the need for constant measurement and alignments to correct the placement of the rectangular shaped prism units. This requires the use of qualified and typically well-paid masons who waste a lot of time with the referred measurements and alignments. Additionally, the typical mortar joints constitute a weak point of the wall, given that the replacement of lime and cement by the aggregate reduces the overall resistance of the joint and since the joints are performed on a flat surface, it favors the appearance of a possible rupture surface in case the wall must respond to horizontal forces. Considering the fact that the production of mortar usually requires cement or lime together with natural origin aggregates, the natural capital is also diminished by the production of these cementitious compounds, so that the partial or total replacement of the mortar in the joints of a wall are observed with interest. On the other hand, the need for coating and insulation of a wall requires, many times, new construction teams who must integrate other specialized workers, increasing the costs and the complexity, particularly since this type of work usually crates a need for subcontractors. Furthermore, the application of the coating and the supply of insulation are necessarily carried out separately in time, consuming precious time which can be used for other jobs, facilitating the meeting of the deadline for the conclusion of the construction. Therefore, there exists the need for an "all-ready" masonry system, for quick construction, which already provides the masonry units for coating together with the final finishing and with thermal and acoustic insulation. The new fully ready masonry system should minimize or even prevent the use of mortar in the joints, whether for economic reasons, whether for environmental reasons. This means that the new masonry units must enable the placement thereof with a minimum of mortar in the joints or even without it, being placed by dry process, in this case. The fully ready masonry system must be based on units which shape must include channels and ridges so as to form a tongue and groove fitting system which allows the dry placement of the units or by means of a minimal use of mortar. The tongue and groove system must also be responsible for the "break" of the planar joint, preventing weakening of this same joint. At the same time, the tongue and groove fitting system of the masonry units must favor the adequate alignment, saving time and avoiding the need for constant measurements and alignments. The new blocks must already have in their front face a coat of the final finishing with high aesthetic standard and must incorporate a layer of material with good thermal and acoustic insulation properties, to guarantee the high insulation performance in all the wall. The secondary masonry units must, in turn, be part of the masonry system, allowing to contour structural elements and enabling a uniform appearance to the outer side of the wall. Additionally, the masonry system must be capable of incorporating reinforcement elements to improve the behavior thereof in face of cracking phenomena and in face of seismic demands. The application of the coating and the supply of insulation are necessarily carried out separately in time, consuming precious time which can be used for other jobs, facilitating the meeting of the deadline for the conclusion of the construction.

SUMMARY

The present application describes a masonry system with final finishing coating and insulation which presents a primary masonry unit and a secondary masonry unit, wherein the primary masonry unit comprises:

- a body comprising a main central ridge and a main lower central channel, a secondary lateral channel which is developed along the top and along one of the sides of the unit and a secondary lateral channel which develops along the lower part and along the opposite side of the corresponding secondary ridge;
- a plurality of longitudinal and transverse semicircular and quarter circle channels arranged over the upper surface and the lower surface of the referred masonry unit;
- a plurality of cavities which develop from the upper surface to the lower surface of the referred masonry unit;

a tongue and groove fitting system by means of the referred plurality of main and secondary ridges and channels;

a final finishing coat layer shown on the front/outer face of the referred masonry unit;

a thermal and acoustic insulation layer present on the rear/inner face of the referred masonry unit or in the outer face thereof covered by the final finishing coat layer;

a small slope by the top and bottom horizontal edges of the unit and which is developed from the secondary ridges and the secondary channels towards the front face.

In one embodiment, the secondary masonry unit of the masonry system with final coating and insulation comprises:

a body comprising a lateral ridge which develops along the top and along one of the sides and a secondary lateral channel which develops along the lower part and along the opposite side of the corresponding ridge;

a final finishing coat layer in the outer/front face;

a slope by the front top and bottom edges of the unit and which develops from the ridges and channels up to the front face;

a thermal and acoustic insulation layer present in the outer face coated by a final finishing coat layer, only in the secondary unit.

In one embodiment, the secondary masonry unit of the masonry system with final coating and insulation comprises:

an "L" shaped body comprising a lateral ridge which develops along the top of the "L" and along one of the sides of the unit and a lateral channel which develops along the lower part of the "L" and along the opposite side of the corresponding ridge;

a final finishing coat layer present in the front/outer faces;

a thermal and acoustic insulation layer present in the outer face coated by a final finishing coat layer, only in the secondary unit.

a small slope by the top and bottom front horizontal edges of the unit and which is developed from the ridges and channels up to the front face.

In one embodiment, the secondary masonry unit of the masonry system with final coating and insulation comprises:

a body which comprises a ridge which develops along the upper part, a channel which develops along the lower part and along one side of the unit and a ridge or channel which develops on the rear/inner face of the unit, close to the outer lateral surface;

a final finishing coat layer on the front/outer surface and on the outer lateral surface;

a thermal and acoustic insulation layer present in the outer face coated by a final finishing coat layer, only in the secondary unit.

a slope by the front top and bottom edges of the unit and which develops from the ridges and channels up to the front face;

In one embodiment, the masonry system with final finishing and insulation coating comprises a set of two complementary units: a primary unit and a secondary unit, wherein the primary masonry unit comprises a body comprising an upper main central ridge and a lower main central channel, together with an elliptical prismatic protuberance placed in an intermediary position along the front face of the unit and the secondary unit so as to comprise:

a body comprising a ridge which develops along the top and along one of the sides of the unit and a lateral channel which develops along the opposite side of the corresponding ridge;

an elliptical prismatic channel with dimensions similar to those of the elliptical prismatic protuberance of the modified masonry primary unit, but inversely;

a final finishing coat layer on the front/outer surface and on the lower outer surface;

a thermal and acoustic insulation layer present in the outer face coated by a final finishing coat layer, only in the secondary unit.

a small slope by the upper and lower front horizontal edges of the unit and which is developed from the ridges up to the front face.

In one embodiment, the masonry system with final finishing coating and insulation comprises a reinforcement unit which can be covered by pairs of semicircular channels placed on the upper and lower faces of the referred masonry units and which can assume one of three shapes: in "inverse C-C" or ladder-shaped or a reinforcement unit comprising a simple bar set.

In one embodiment, the masonry units of the masonry system with final finishing coat and insulation comprises a vertical steel reinforcement soaked in binding material in the cavities which remains perfectly aligned with those of the primary units immediately below and above.

In one embodiment, the masonry units of the masonry system with final finishing coat and insulation present secondary ridges and channels.

In one embodiment the units of the masonry system with final finishing coat and insulation comprise slope planes close to their upper and lower outer edges.

In one embodiment, the units of the masonry system with final finishing coat and insulation are completely anchored and locked leading to the formwork for reinforced concrete structures simultaneously with the wall construction.

The present application further describes the masonry wall which comprises the previously described masonry system.

BRIEF DESCRIPTION

Such as previously described, according to the state of the art, the application of a coating and/or supply of insulation to a masonry wall are necessarily carried out separately in time, which reveals itself to be an inefficient process.

Therefore, there exists the need for an "all-ready", masonry system, for quick construction, which already provides the masonry units for coating together with the final finishing and with thermal and acoustic insulation. The new "all-ready" masonry system should minimize or even prevent the use of mortar in the joints, whether for economic reasons, whether for environmental reasons. This means that the new masonry units must enable the placement thereof with a minimum of mortar in the joints or even without it, being dry placed, in this latter case. The "all-ready" masonry system must be based on units which shape must include channels and ridges so as to form a tongue and groove fitting system which allows the dry placing of the units or by means of a minimal use of mortar. The tongue and groove system must also be responsible for the "break" in the planar system, preventing weakening of this same joint. At the same time, the tongue and groove fitting system of the masonry units must favor the adequate alignment, saving time and avoiding the need for constant measurements and alignments. The new masonry units must comprise in their front face a final finishing coating with high aesthetic standard and must incorporate a layer of material with good thermal and acoustic insulation properties, to guarantee the high insulation performance in all the wall. The secondary masonry units must, in turn, be part of the masonry system, allowing to contour structural elements and enabling a uniform appearance to the outer side of the wall. Additionally, the masonry system must be capable of incorporating reinforcement elements to improve the behavior thereof in face of cracking phenomena and in face of seismic demands.

The present application therefore describes a masonry system, of quick construction, which ensures the construction of an outer or inner wall at once, and which overcomes advantageously the above cited disadvantages and deficiencies.

The masonry system now described is based on a primary masonry unit which already has final finishing coat and a thermal and acoustic insulation layer. This primary masonry unit is presented in two main variations. In one of the variations, the masonry primary unit has final finishing on one side and an insulation layer on the opposite side. In another variation, this unit incorporates a final finishing layer and an underlying insulation layer to this same coating, which can be understood as an insulation layer from the outside. The system further includes several secondary masonry units with smaller thickness and in different shapes, which present the same final finishing coat that the primary masonry unit presents in its outer side. The adoption of one or another of the variants of the primary masonry unit also determines the variant of the masonry system used, conditioning the choice of secondary masonry units which will form a part of the wall to be constructed. As such, the masonry system presented herein unfolds into two possibilities: that of constructing a wall that is already externally coated and having thermal and acoustic insulation guaranteed from the inside and that of constructing a wall that is already coated and insulated, wherein the thermal and acoustic insulation is guaranteed from the outside. Both the primary masonry units as the secondary masonry units present a tongue and groove fitting system which enables that these units be coupled in any type of units, whether they are similar or different. When laying the several primary masonry units, a wall will be created with thermal and acoustic insulation, due to the insulation layer present on the inner side or on the outer side of these same primary masonry units, depending on the variation that is adopted. When combining the primary masonry units already coated with several secondary units, also comprising final finishing coat, the present system allows constructing a wall which contours structural elements, such as beams, columns, load bearing walls and slab edges, from the outer face, "concealing" same and guaranteeing an aesthetic and pleasant aspect, while at the same time guaranteeing a uniform outer appearance to the wall. Due to the already coated outer faces of the primary and secondary masonry units and, depending on the variation adopted in the primary units, due to their already insulated inner or outer faces, the system dispenses other construction steps. The construction steps that are eliminated are: a) application of plaster, stonework, or boards of any material for coating the outer side of the wall and further the painting or tile covering step when it is necessary to apply over the plaster; b) the supply of insulation material to improve the thermal and acoustic behavior of the wall.

Another advantage related to the use of the referred masonry system refers to the fact that, by means of the use of primary and secondary interconnected masonry units or only using a combination of secondary masonry units, it becomes possible to pre-cast a reinforced concrete structure, providing the masonry units are duly anchored.

Another important characteristic of the referred masonry system is that the primary masonry units, regardless of their variation, also comprise four vertical cavities which are responsible for reducing the weight itself. These cavities occur in symmetrical form in the masonry unit, which enables that, when laying these primary masonry units with aligned vertical joint or unaligned vertical joint at half-block, perfectly aligned vertical channels are created inside the wall thus constructed. When pouring the binding material in these cavities, which can be concrete, for example, at intervals with pre-defined distance, it is also possible to create a matrix of vertical "rigid channels" which improves the overall stability of the wall, including allowing to accommodate vertical steel reinforcements soaked with the binding material.

BRIEF DESCRIPTION OF THE FIGURES

For an easier understanding of the present application there are figures attached which represent embodiments that, however, do not intend to limit the technology herein disclosed.

FIG. 14 illustrates, in ii), a secondary masonry unit suitable to the variation of the masonry system with insulation guaranteed from the outside which is an "L" shaped pillar covering, here seen in top perspective, enabling perceiving that the ridges and channels thereof enable the fitting with other units.

DESCRIPTION OF EMBODIMENTS

With reference to the figures, some embodiments are now described in a more detailed manner, as well as other aspects and advantages of the masonry system now described. The referred figures do not, however, intend to limit the scope of the present application, being only destined to be analyzed together with the text descriptions.

Figure 1A:
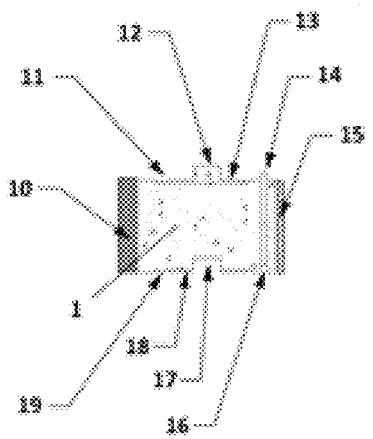
FIG. 1*a* illustrates one of the variations of the primary masonry unit, which comprises insulation on the inner side, represented by means of the projections thereof in 2D and by cuts in its longitudinal and transverse sections.
Figure 1B:
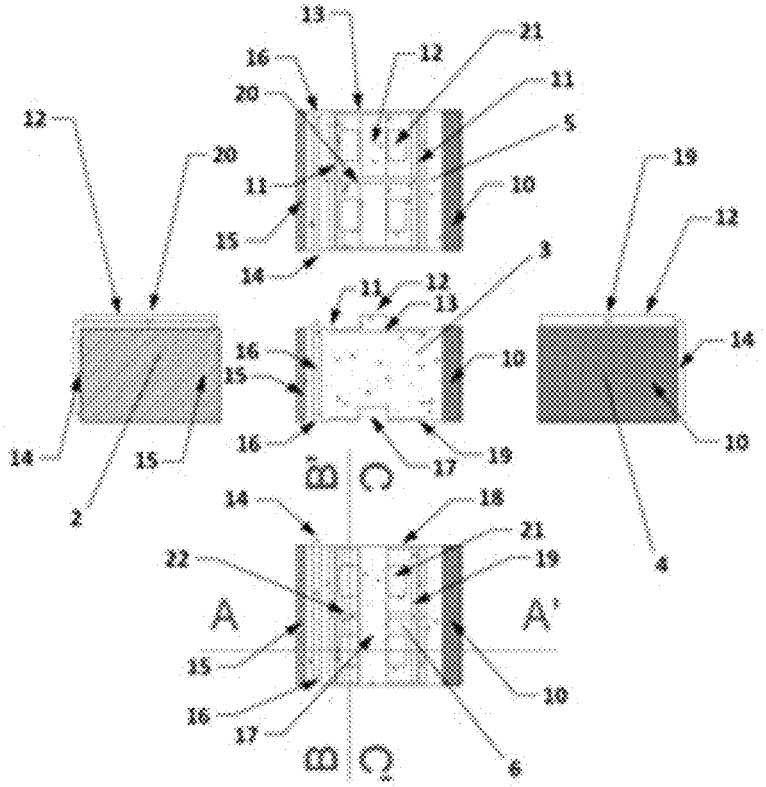
FIG. 1*b* illustrates a top perspective view (left side) and a bottom perspective view (right side) of one of the variations of the primary masonry system, with insulation on the inner side, wherein the cavities, ridges and channels, insulation and final finishing coating layers can be seen.

One of the embodiments of the masonry system is the primary masonry system, in its variation with insulation from inside, which can be observed in detail in FIGS. 1*a* and 1*b*. Apart from the main body or core, the primary masonry unit comprises a front face (23) which can be seen in the front projection of the unit (2) and also by means of the perspective view of the same unit and which is coated with a final finishing coat layer (15) with the purpose of guaranteeing a pleasant outer aspect to the wall wherein the unit will be a part of. Since this refers to a quick construction masonry system unit and which ensures outer coating and insulation as soon as it is laid, the primary masonry unit also presents an insulation layer (10) which coats its rear face (27), as can be seen in the rear projection of the unit (4) and also by means of the perspective view of the same unit. The thickness of the insulation layer can vary according to the desired requirements for the purposes of acoustic and thermal insulation. The length and the height of the insulation layer can be equal to the respective dimensions of the body of the primary masonry unit, but they can also be foreseen in slightly greater dimensions to compensate the dimensions of the joints in case the laying of the masonry units occurs by wet process with mortar or any other binding material with similar cementitious capacity.

Among other characteristics, the primary masonry unit comprises a special shape strongly determined by the need for locking each one of the units to the units occurring above, below and beside, so as to construct a wall with the minimum use of mortar or even without using the same. The form of the primary masonry unit includes a larger central channel (17) arranged along the underside (26) which can be seen in the lower projection of the unit (6) and also by means of the perspective view of the same unit, which is destined to accept a larger central ridge (12) present on the upper face of the primary unit (25), which can be seen in the upper projection of the unit (5) and also by means of the perspective of the same unit. The larger central ridge (12) has slightly smaller dimensions than the dimensions of the corresponding larger central channel (17). This slight difference in dimensions is intended to allow small adjustments and, in this manner, facilitate the laying process. These ridges and channels embody the tongue and groove fitting system, which functions are: a) perfectly align the process of laying of the units without the need for constant and time-consuming measurements and alignments; b) "break" the planar joints between the masonry units, guaranteeing a locking system which prevents these units from sliding out of the wall plane; c) enable the laying of the masonry units by wet process and by dry process, depending on the provision or not of mortar or other similar binding material to cement the units; d) if the choice falls on laying the bricks in a wet process, it enables minimizing the use of mortar or other similar binding material, since the tongue and groove system itself also contributes to lock the units.

Supplementary "locking" capacity is provided by another variation of the tongue and groove fitting system which are the secondary side ridges and channels which are presented with smaller dimensions than the main ones. These are present in the form of upper and lateral ridges (14) and lower and lateral channels (16). These secondary ridges and channels have a similar function to that of the main ridges and channels, however, apart from allowing the fitting in units above and below, they enable one primary unit to couple with another by means of its left side face (24), illustrated in the left side projection (3) of FIG. 1*a*, and right, illustrated in the left side projection (1) of FIG. 1*a*, blocking the units along the vertical joints and guaranteeing, at the same time, the sealing of the vertical and horizontal joints of the formed wall, reducing the permeability to water and air of the whole wall. Similarly to what occurs with the main ridges and channels, the secondary ridges have slightly smaller dimensions than the channels, in this way facilitating the laying of the units. Another important function of the secondary ridges and channels is to allow the fitting in secondary masonry units, which main function is to cover structural elements such as pillars, beams, slab edges or structural walls. Some of these secondary masonry units, such as the cover unit of the beams, can be seen in FIGS. 2*a* and 2*b*.

Figure 1C:
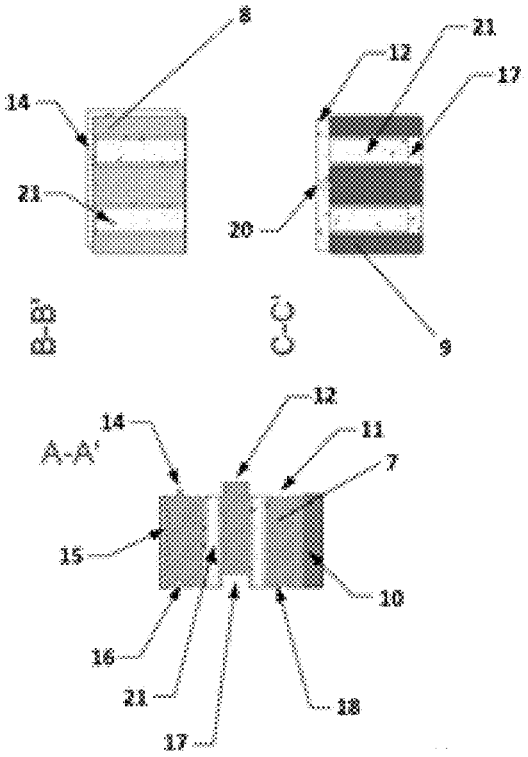
FIG. 1*c* illustrates the existence of a small slope by the top and bottom horizontal edges of the outer face of the primary masonry unit.
Figure 1D:
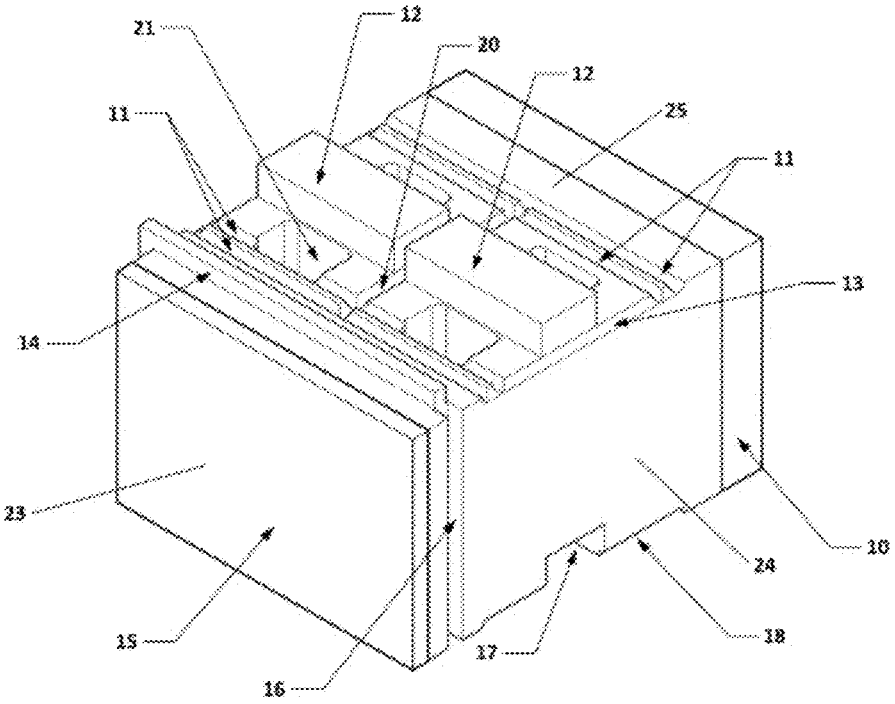
Figure 1E:
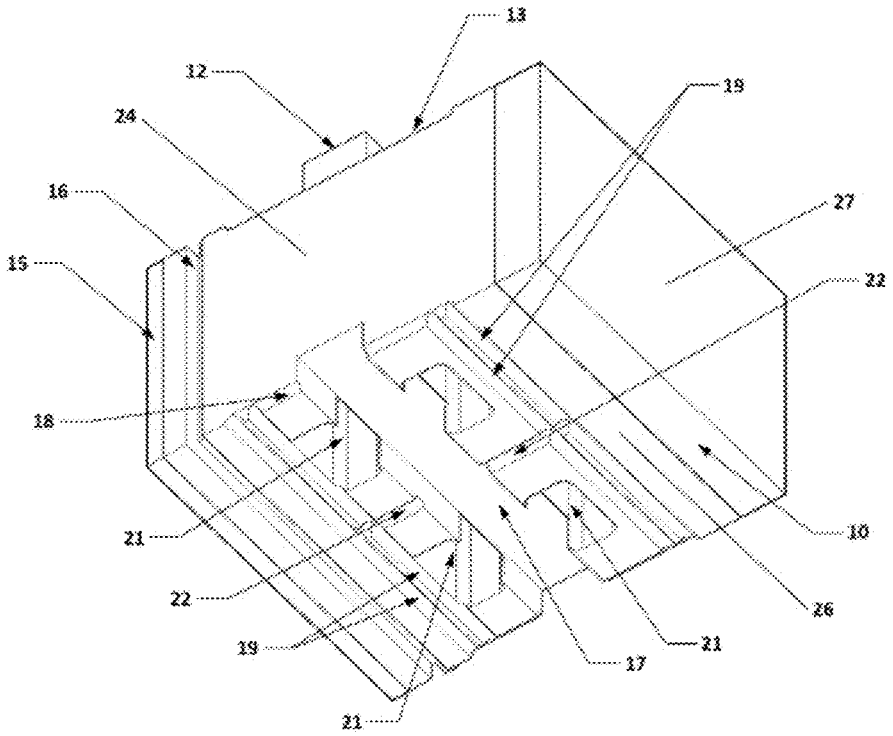
Figure 1F:
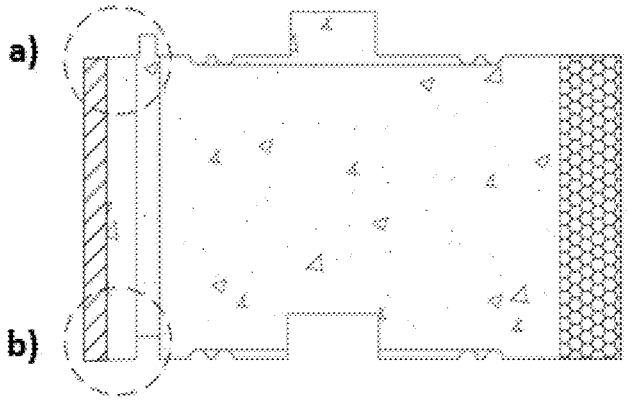
Figure 1G:
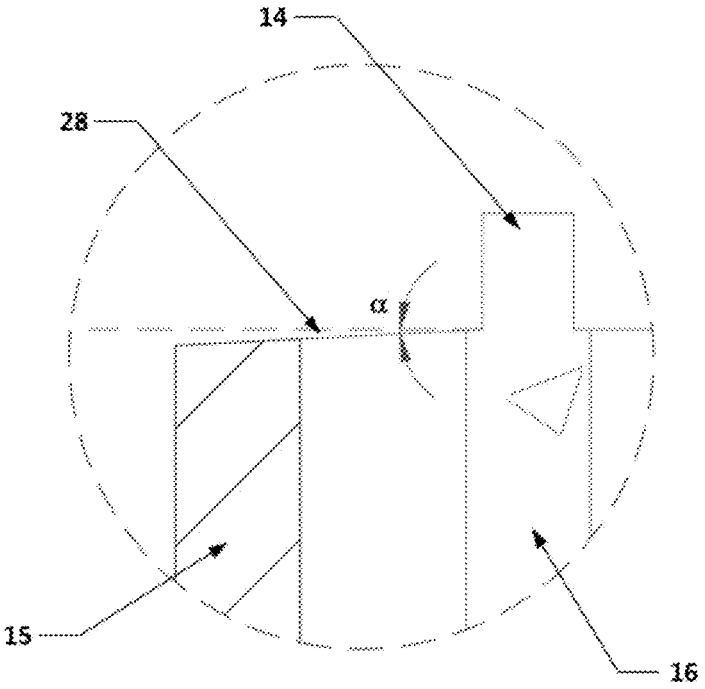
Figure 1H:
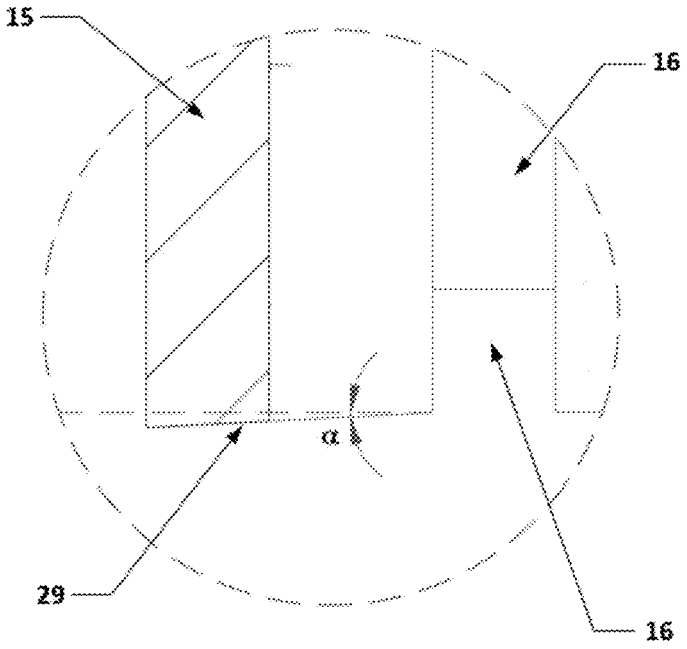

As can be observed in FIG. 1*c*, another important characteristic of the primary masonry unit is that the part of the block which develops forward can be affected by a small slope that goes from the upper and lower edges of the front face of the unit to the secondary channels and ridges thereof. This slope, herein denominated a, is also present on the upper (28) and lower (29) edges of the final finishing coating layer and the function thereof is to drain any excess water that may penetrate in the joints, preventing accumulation of the same inside the wall.

Figure 6A:
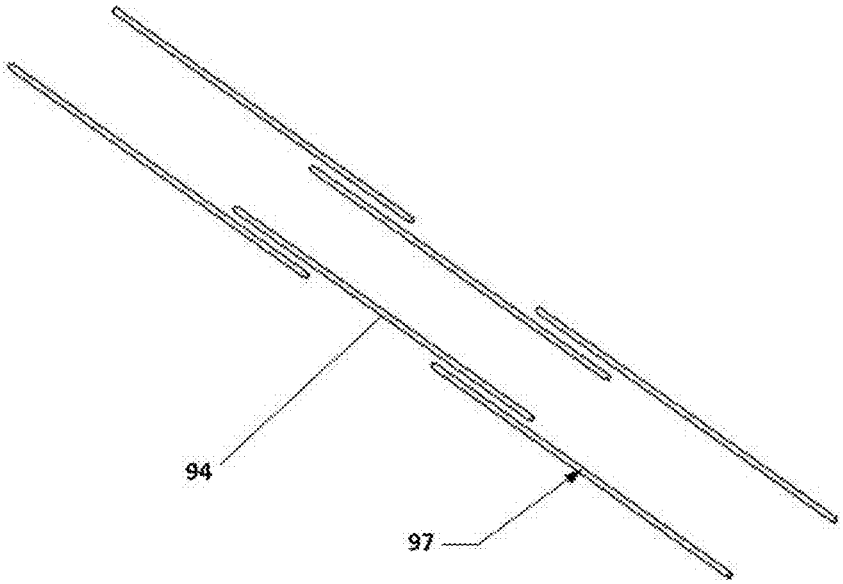
FIG. 6*a* illustrates three different types of reinforcement bar units.
Figure 6B:
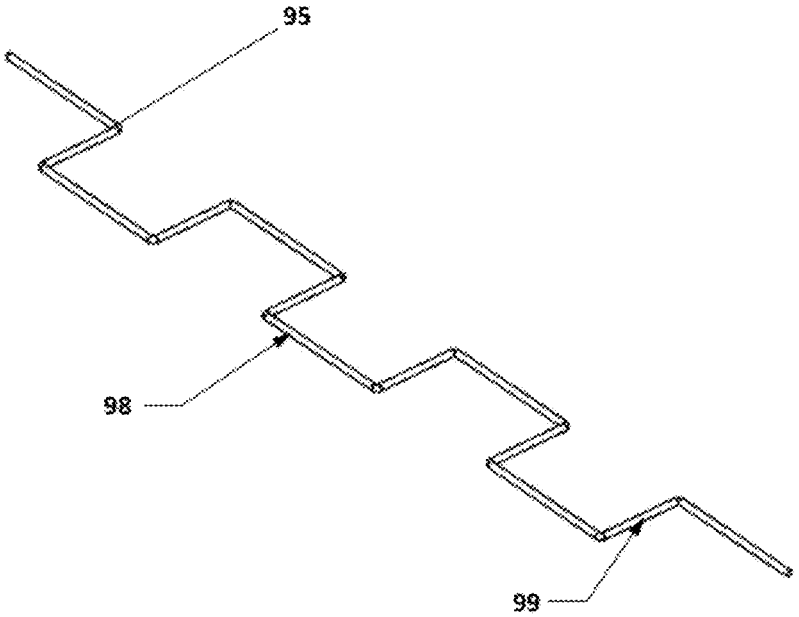
FIG. 6*b* illustrates a row of primary masonry units with insulation layer from the inside and the manner in which three different types of reinforcement bar units fit into same.
Figure 6C:
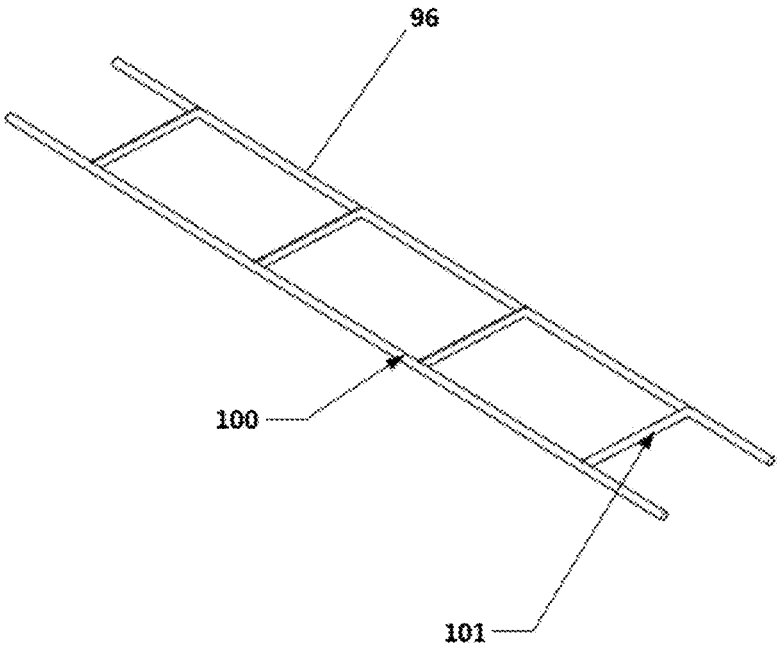
FIG. 6*c* illustrates a top view of three possible configurations for a wall comprised by several primary masonry units with insulation layer from the inside. To each configuration there is an introduction of three different types of reinforcement bar units which fit into the primary masonry unit channels.
Figure 6D:
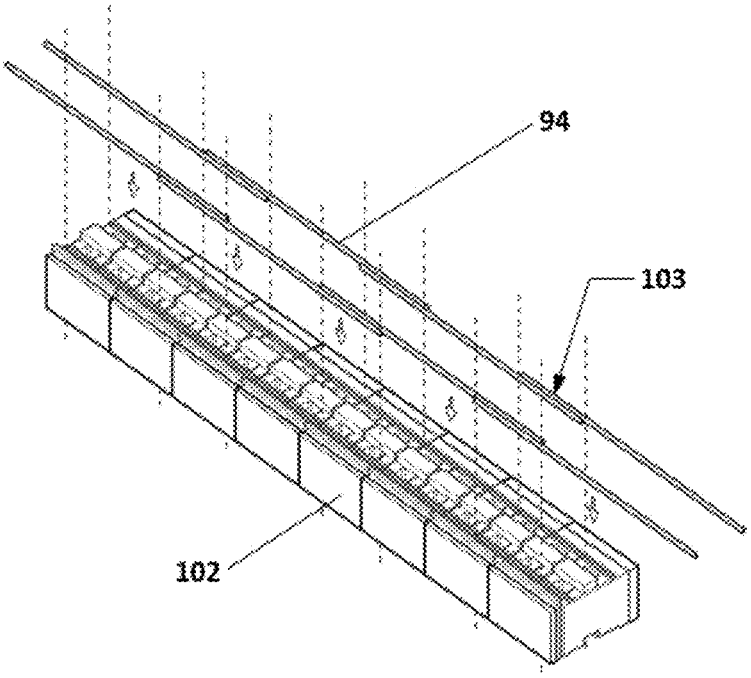
Figure 6E:
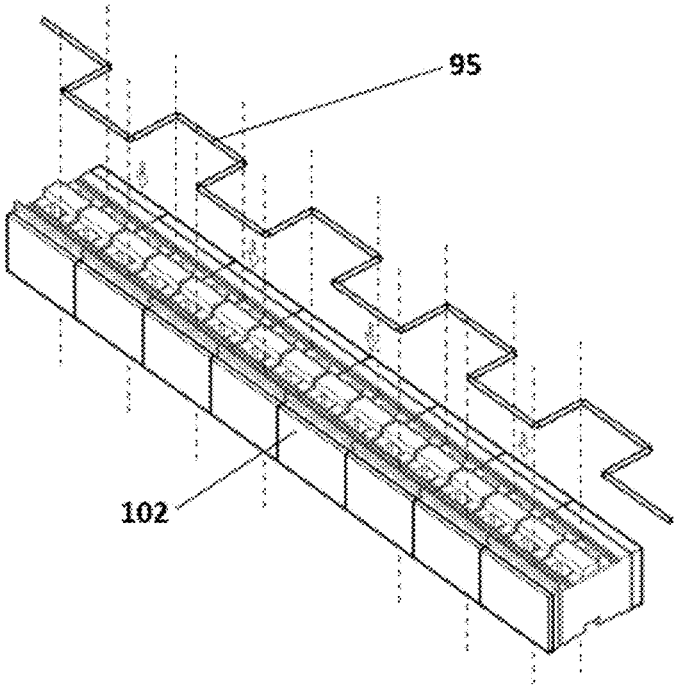
Figure 6F:
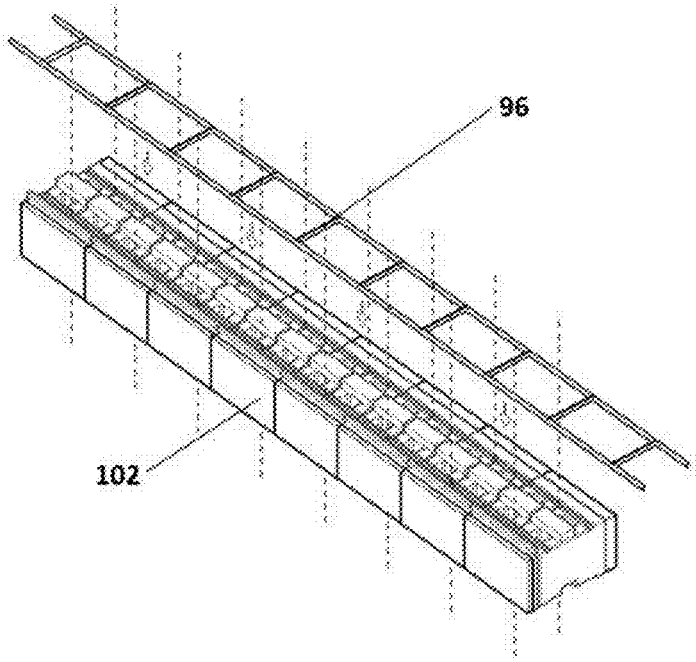
Figure 6G:
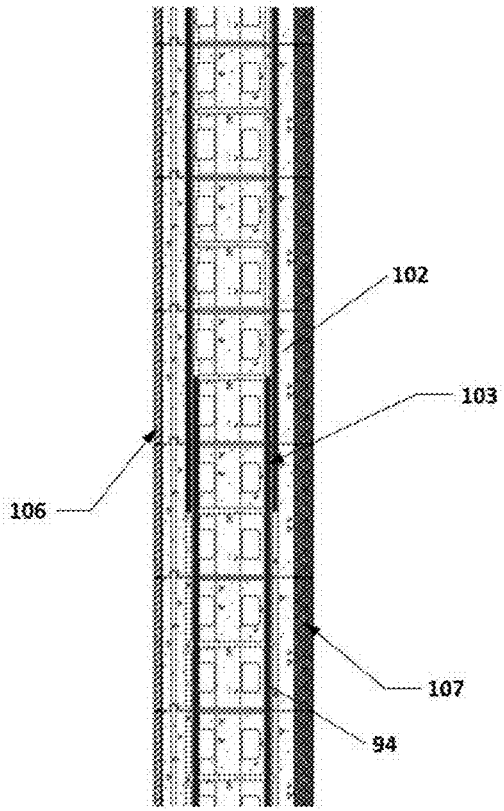
Figure 6H:
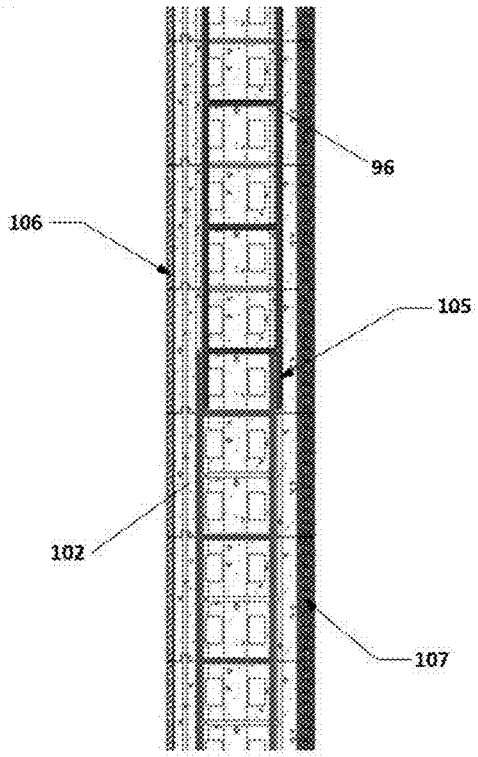
Figure 6I:
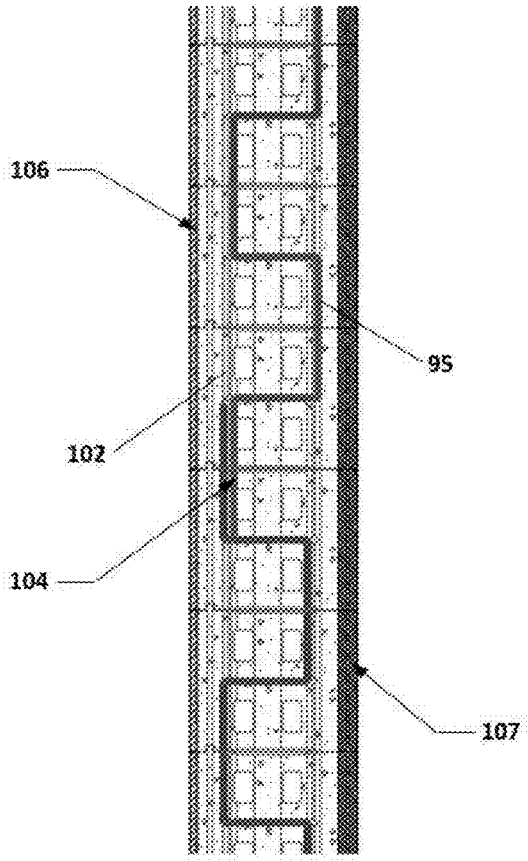
Figure 10A:
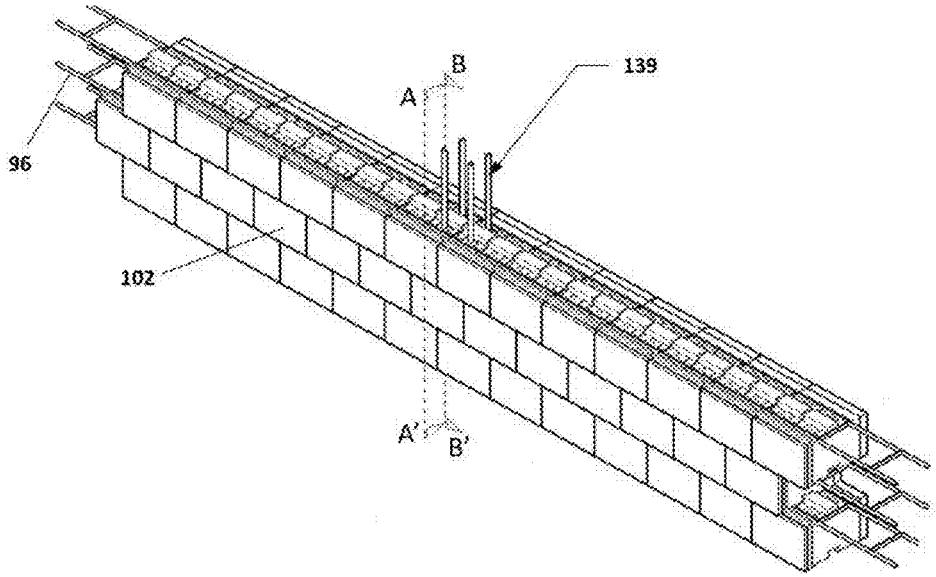
FIG. 10 illustrates the possibility which the present masonry system enables, and which is related to the capacity it has to accommodate vertical reinforcements which allow incrementing the general stability of the constructed wall.
Figure 10B:
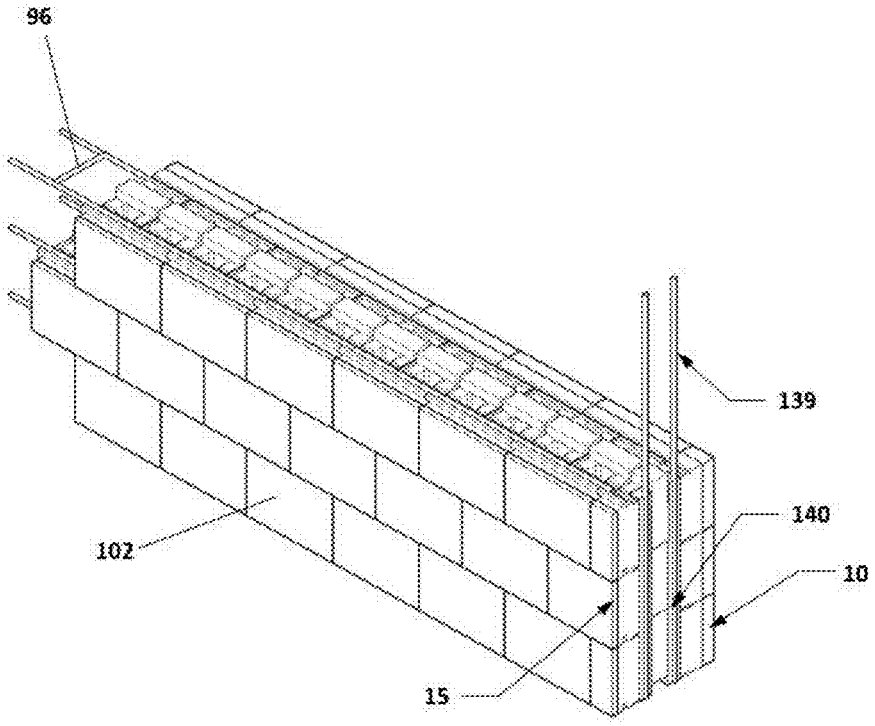
Figure 10C:
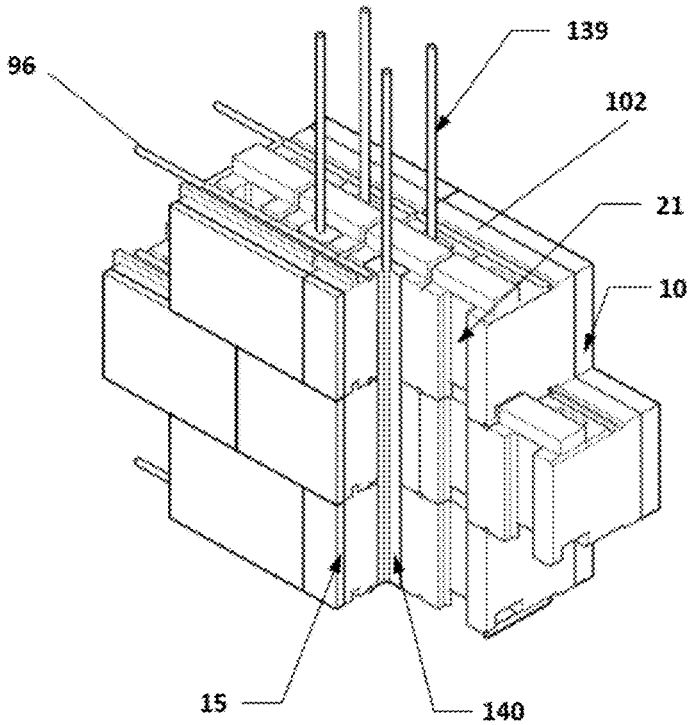

Another interesting characteristic of the primary masonry unit is that it has two pairs of longitudinal semicircular channels on its upper (11) and lower (19) faces, which channels, in both cases, are interlinked with two transverse quarter circle channels existing on the lateral edges (13 on the upper part and 18 on the lower part) and having a semicircular channel present in the center (20 on the upper part and 22 on the lower part). This particular set of channels was conceived to accommodate, at least, three different types of reinforcement bar units, as illustrated in FIGS. 6*a* and 6*b*, which allow interconnecting the masonry units to each horizontal joint. The central semicircular channel on the upper part of the primary unit (13) is responsible for dividing the main ridge in two, which allows the reinforcement to be fitted on the upper part of the unit. The main central channel which is present on the lower part of the unit, interrupts the semicircular transverse channels (22) and the quarter circle channels (18) molded on the lower part of this same unit. Another characteristic of the main masonry unit refers to the fact that this presents four vertical cavities (21). These cavities are responsible for decreasing the weight of the unit itself and, at the same time, for improving the acoustic and thermal behaviors. It is also interesting that these cavities appear arranged on the unit in such a manner that the perfect alignment thereof is possible with the cavities of the remaining primary units, in case these units are laid with unaligned vertical joints with a half unit displacement. Both with coincident vertical joins as with unaligned vertical joints at half unit, it is possible to easily fill in the alluded cavities with insulation material, such as some foams usually used in the art of masonry, such as for example the polyurethane foam. This same alignment of the cavities also allows creating a matrix of rigid channels due to the filling of two consecutive pairs of cavities with binding material, such as Portland cement, as illustrated in FIG. 10. There can further be arranged steel beams soaked in the binding material. In this manner, rigid vertical reinforcements are warranted, which enable an increase in performance of the wall when subject to horizontal demands, in a similar manner as that which occurs when pillars/ties are foreseen in regular block or brick walls. The transverse sections of the primary masonry unit A-A' (7), B-B' (8) and C-C' (9) clarify the arrangement of the cavities and the main and secondary channels and ridges inside the primary masonry unit. It is also interesting the fact that one of the faces of each of the four cavities (21) ends exactly where the main central channel (17) begins. This configuration of the cavities enables, in the case of laying by wet process, that the binding material better surrounds the upper and lower masonry units, maximizing the "wet" area of the tongue and groove system configured by the main channels and ridges, contributing for a better resistance in the contact between the units.

The primary masonry unit was designed to be as flexible as possible. This manner of thinking led to front dimensions of approximately 30 cm length and 20 cm height. The referred dimensions, together with the provision of a primary masonry half unit of 15 cm length, as illustrated in FIG. 8—vi) allow overcoming any multiple gaps of 15 cm between two pillars, which enables constructing a wall for many of the existing structures with minimal adaptations, providing even more flexibility for the gaps chosen in a project where the masonry solution now described is considered. The width of the primary masonry unit, on the other hand, is foreseen with around 30 cm. This dimension was designed to allow totally contouring a reinforced concrete structural element with 25 cm width and, simultaneously, allow that a secondary unit with 5 cm width, which is a cover for a structural element, fit into the primary unit and cover the structural element at the same time. The rear face of the body of the main masonry unit, in its turn, is aligned with the rear face of the structural element to be contoured, so that the insulation boards of the primary unit can be aligned with other insulation boards that cover the rear face of the contoured structural element, guaranteeing the continuity of the insulation. It must be noted that the dimensions presented for this masonry unit are preferred dimensions, whereby it is possible to have embodiments of the same with different dimensions than those indicated.

The core of the main masonry unit, as well as the cores of the secondary masonry units are designed to be made from a geopolymer or an alkaline activated material obtained from construction and demolition waste. Expanded clay is added to these constituents which, apart from the acoustic and thermal advantages that it brings, is intended to reduce the weight of the units themselves. Therefore, it is emphasized that these masonry units can be made of any material, namely the materials from which the current masonry units are made. The final finishing coat layer, in its turn, is also designed to be formed by a geopolymer or an alkaline activated material obtained from construction and demolition waste, but with lower granulometry, to reduce the porosity and achieve a uniform and aesthetically pleasant aspect. Once again, this layer can be made from other materials that guarantee a good appearance and low permeability. The insulation layer is designed to be embodied by an expanded cork granulate board, although it may be made from any other type of insulation material currently used in the construction sector.

Figure 2A:
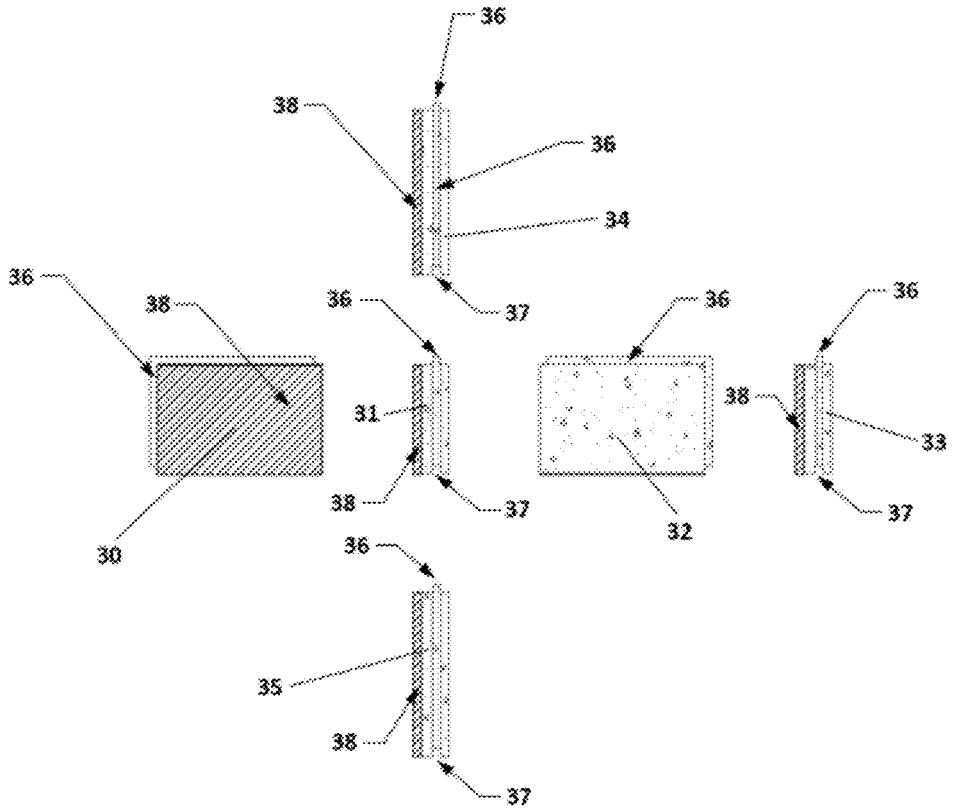
FIG. 2*a* illustrates a secondary masonry unit suitable to the variation of the masonry system with insulation guaranteed on the inside, concretely a beam covering unit in its 2D projections. Although this unit is primarily conceived to contour beams and slab edges, it can also be used to contour other structural elements in combination with other types of secondary masonry units.
Figure 2B:
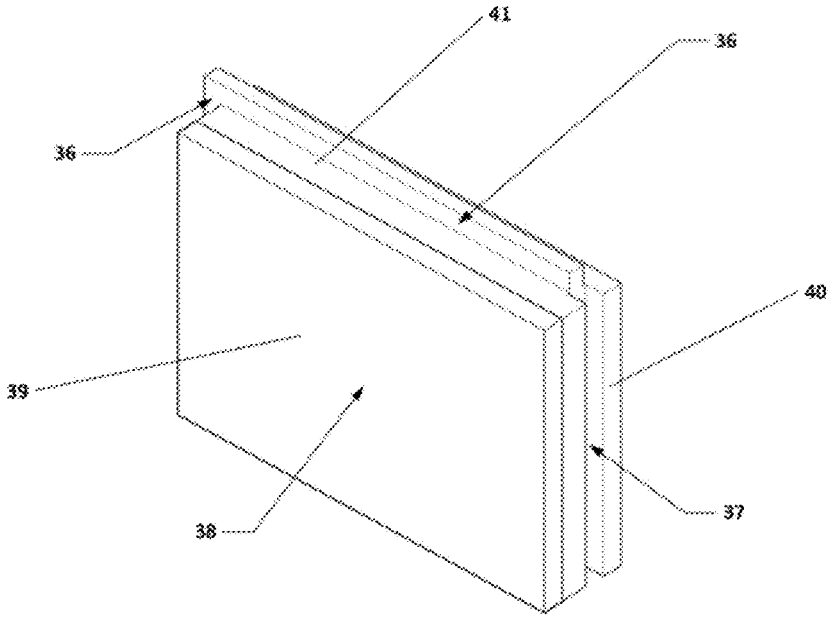
FIG. 2*b* illustrates a top perspective view of a beam covering unit suitable to the variation of the masonry system with insulation guaranteed from the inside, wherein the top ridge and the lateral channel thereof can be seen.

Referring now to FIGS. 2*a* and 2*b*, both show a secondary masonry unit which is a beam covering unit and which is designed to integrate the variation of the masonry system which guarantees insulation from the inner side of the wall. This unit is graphically described by its front projection (30); left side projection (31); rear projection (32); right side projection (33); top projection (34) and bottom face projection (35), all visible in FIG. 2*a* and by the perspective view thereof provided in FIG. 2*b*, which shows the front face of the beam covering unit (39), the left face thereof (40) and the top face (41). This unit in particular has the purpose of allowing the masonry system that integrates the same to cover structural elements such as beams and slab edges, contouring them. However, said units can also be applied in other singularities of the wall, complementing other masonry units. Units such as these are designed in an integrated manner, guaranteeing that the wall presents a good aesthetic and a uniform aspect, providing the same coating in all the units thereof. For this purpose, the secondary unit under analysis is comprised of a final finishing coat layer (38) executed in the same material as the final finishing coat layer of the primary masonry unit. The body/core of this unit is also comprised of the same material as the body of the primary masonry unit. The beam covering unit has around 5 cm width and, due to its small ridges present on the upper and left faces (36) and the small channels that are developed on the right side and lower face (37), it can fit perfectly in the small channels and side projections which are comprised within the primary masonry units and other secondary units. The length and the height of the beam covering unit are, preferably, equal to the corresponding dimensions of the main masonry units, as illustrated in FIGS. 1*a* and 1*b*, and main masonry half unit, illustrated in FIG. 8, however they can change according to the structural elements which it is intended to cover. For this, the masonry system can foresee beam covering units with heights which vary from 20 cm to 35 cm, the height range having variations foreseen in 5 cm intervals, since the heights of the reinforced concrete beams usually also vary in 5 cm intervals. However, other dimensions can be produced.

Figure 3A:
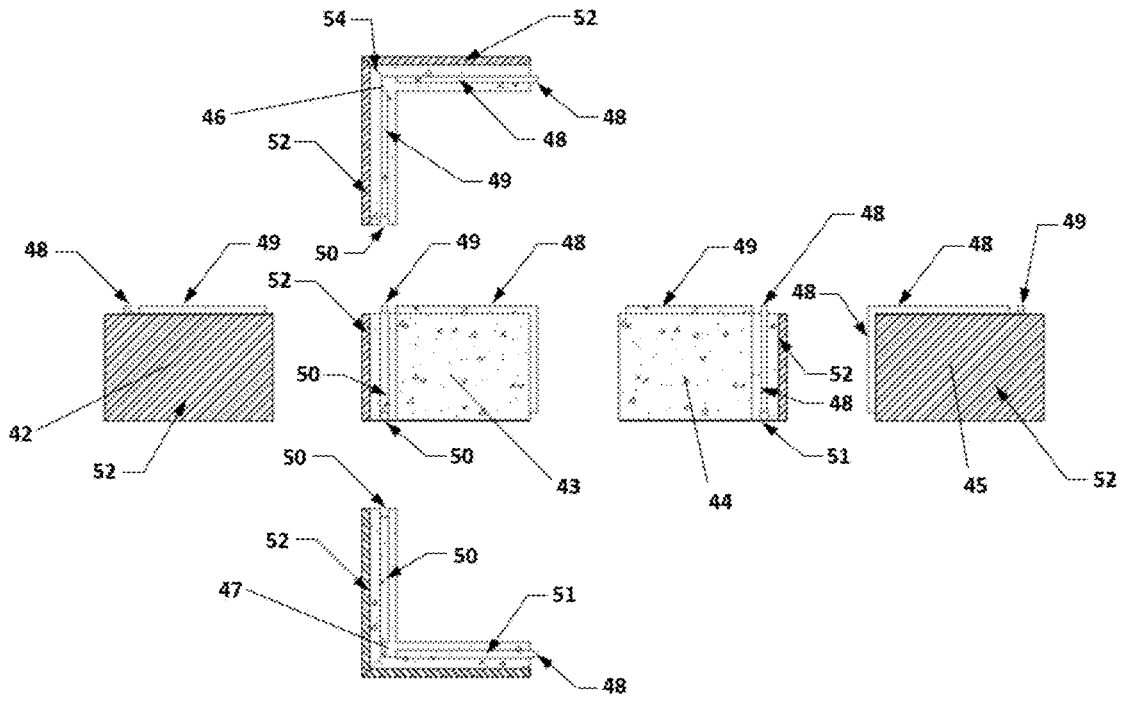
FIG. 3*a* illustrates the 2D projections of a secondary masonry unit suitable to the variation of the masonry system with insulation guaranteed from the inside which is an "L" shaped pillar covering.
Figure 3B:
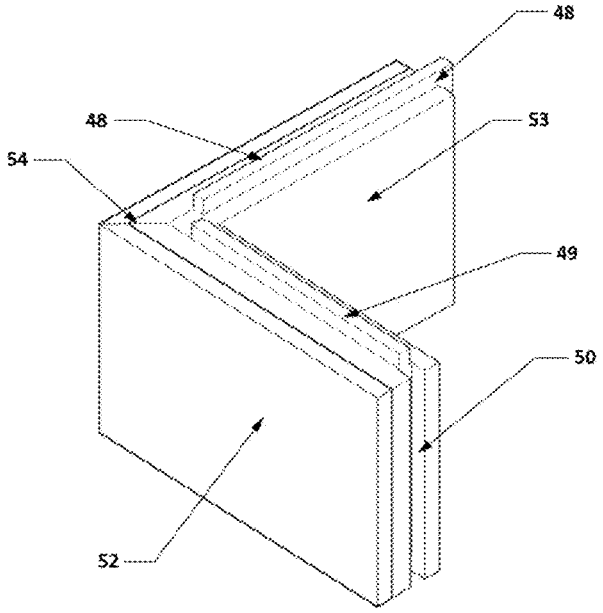
FIG. 3*b* illustrates a top perspective view of an "L" shaped pillar covering, suitable to the variation of the masonry system with insulation guaranteed from the inside, wherein there can be seen the ridges and channels thereof which allow the fitting with other units.

To cover pillars and to circumvent singularities, such as corners of vertical structural elements, other secondary units are foreseen in the referred masonry system. FIGS. 3*a* and 3*b* show another secondary masonry unit which is an "L" shaped pillar covering unit. This unit is graphically described by its: front projection (42); left side projection (43); rear projection (44); right side projection (45); top projection (46) and bottom face projection (47), all visible in FIG. 3*a* and by a perspective view disclosed by FIG. 3*b*. The function of this unit, once integrated in the masonry system, is to allow covering and contouring structural pillars or any structural element, particularly when it is necessary to cover a corner and thus change the development plan of a wall. Similarly to what happens with the other referred masonry units, this unit in particular has its core made of the same material as the others and also comprises a final finishing layer which covers all the front face thereof (52) and which is developed by the "L" shape of the unit, further covering the outer face perpendicular to the front face. The rear face of the unit (53), in its turn does not have a coating, presenting solely a surface of the material which comprises the unit core, made from the same material as the remaining units of the referred masonry system. In order to adjust the other primary and secondary masonry units, the "L" shaped pillar covering unit comprises a ridge arranged along the upper and right tops of its right side face (48), a channel arranged along the bottom part of the right side fact of the unit (51), a ridge arranged along the top part of the front face of the unit (49) and a channel arranged both on the bottom part and on the top left side of the right side face (50). These ridges allow the "L" shaped pillar covering unit to fit into the channels present in other primary and secondary masonry units, while the channels fit in the projections of these same units. The dimensions of the "L" shaped pillar covering unit are preferably 30×30 cm adding the final coating layer thickness, this measuring the dimensions on the outer face, in the top and bottom projections of the part. Measuring these same projections, but by the inner faces, the dimensions of the part are 25×25 cm, which is due to the width of 5 cm of the "L" of the core thereof. Such as the beam covering unit shown in FIGS. 2*a* and 2*b*, the height of the "L" shaped pillar covering unit also can vary at each 5 cm in an interval from 20 cm to 35 cm. However, due to some specific needs, other dimensions of length, width, height, and thickness can be foreseen. Once again the ridges and channels that embody this tongue and groove fitting system differ slightly in the dimensions thereof, whereby the channels are slightly larger than the ridges due to the same reasons mentioned when describing the primary masonry unit, as illustrated in FIGS. 1*a*, 1*b* and 1*c*. Additionally, the small slope of the surfaces which is developed between the ridges and channels and the top and bottom edges of the set is maintained, allowing the continuity of the inclined plane presented in the remaining units and guaranteeing the draining of any excess water which can infiltrate in these joints. Due to the "L" shape of this unit in particular, two upper inclined planes and two lower inclined planes intercept each other and, consequently, an edge is formed both on the upper part (54) as on the lower part of the units where this interception occurs.

Figure 4A:
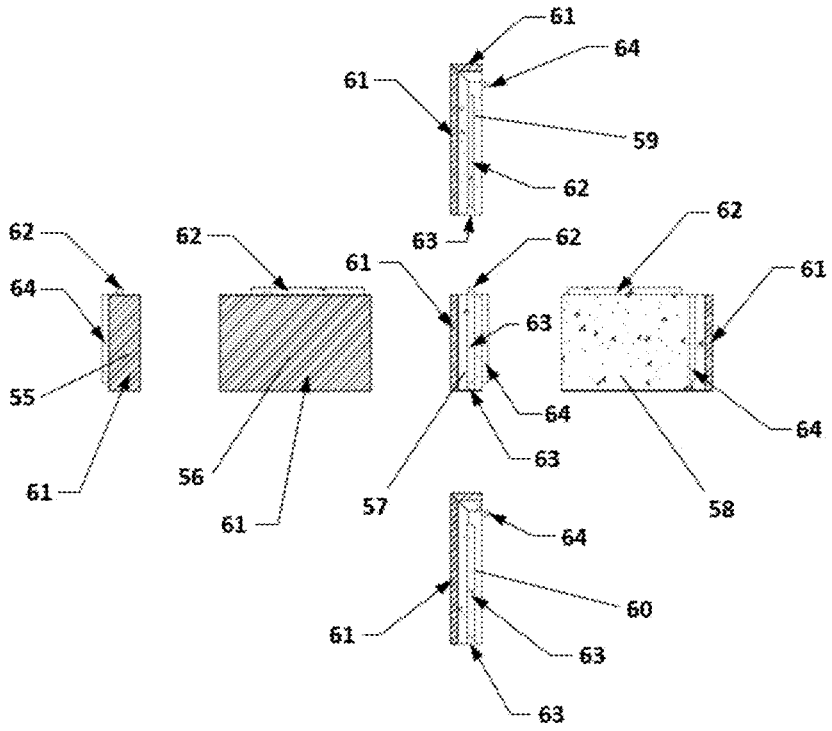
FIG. 4*a* illustrates the 2D projections of two possible embodiments of a secondary masonry unit suitable to the variation of the masonry system with insulation guaranteed from the inside which, in combination with beam covering units, represents an alternative to the "L" shaped pillar covering.
Figure 4B:
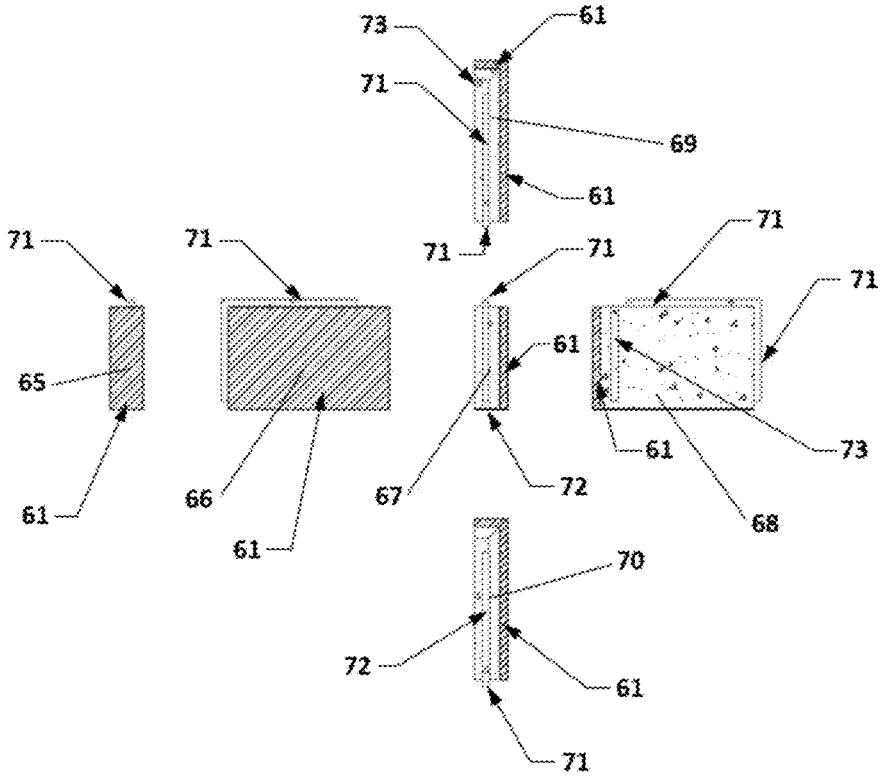
FIG. 4*b* illustrates a top perspective view of two possible embodiments of an alternative unit of the pillar covering suitable to the variation of the masonry system with insulation guaranteed from the inside, wherein the ridges and channels thereof can be seen.
Figure 4C:
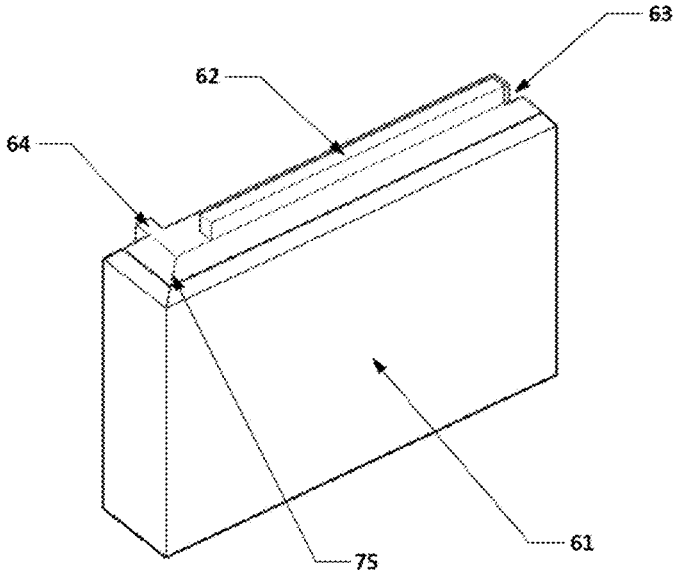
Figure 4D:
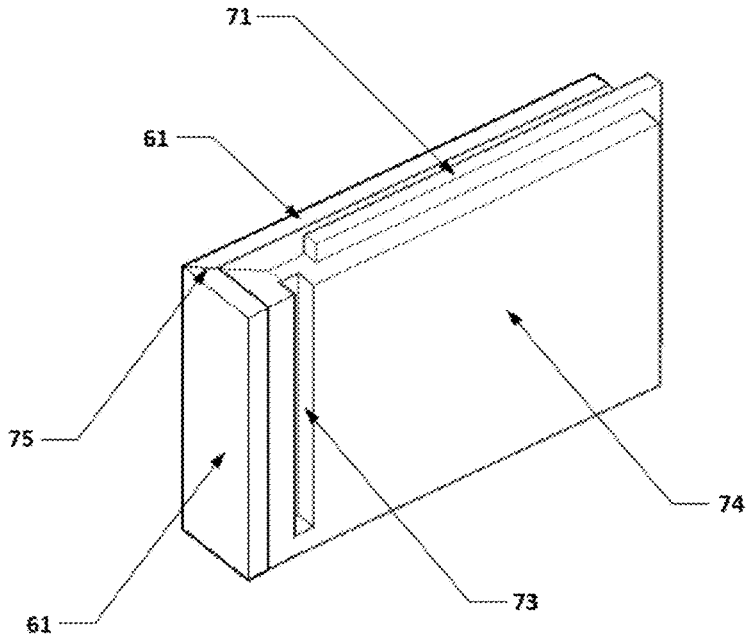

Referring now to FIGS. 4*a* and 4*b*, both show two possible forms of embodiment for a secondary masonry unit which is an alternative pillar covering unit, conceived to be used together with other secondary units, such as pillar covering units, illustrated in FIGS. 2*a* and 2*b*). As can be seen by observing FIG. 4*a*, the two embodiments of this unit are graphically described by their right side projection (unit i) —55; unit ii) —65), front projection (unit i) —56; unit ii) —66); left side projection (unit i) —57; unit ii) —67; rear projection (unit i) —58; unit ii) —68); top projection (unit i) —59; unit ii) —69) and bottom face projection (unit i) —60; unit ii) —70). FIG. 4*b* discloses a perspective view of the two embodiments mentioned of the alternative pillar covering unit from the top, rear, and left side. This unit in particular appears as a more flexible alternative to cover and "conceal" pillars and contour corners of structural elements and can be used together with other types of secondary masonry units, such as beam covering units. This type of unit for covering pillars can be prepared by many different ways. FIGS. 4*a* and 4*b* show only two of these ways. The referred embodiments comprise a final finishing coat layer (61) made with the same material and with the same thickness as the final finishing coat layers of the other masonry units. This layer coats the faces of the unit which it is intended to show on the outer side of the wall to which this unit will belong. The rear face (74) and the opposite side face do not present final finishing coat, the surface thereof being in the same material which constitutes the core of this unit. The core of the alternative pillar covering unit is constituted by the same material as the cores of other masonry units. What distinguishes the several forms of embodiments that the alternative units of the pillar covering can assume is, apart from the variation in the dimensions thereof, the arrangement of the ridges and channels, which can change according to the needs. For example, the alternative unit referred to in FIGS. 4*a* and 4*b* as i), has an upper ridge along its top face (62), a channel which develops along the lower and left side faces of the unit (63) and a vertical ridge which is outlined in the rear face of the unit (64). On the other hand, the alternative pillar covering unit represented as ii) presents a different configuration. This piece has a ridge which is developed along the upper and lateral right faces of the unit (71), a channel which is developed by means of the lower face of the unit (72) and a channel embedded on the rear face of the unit (73) with shape and dimensions such that enables it to "receive" a ridge of the same and other types of secondary masonry units. These ridges and channels have the purpose of fitting, respectively, in channels and ridges of another unit which it is desired to fit in the unit that comprises them. Once again, the ridges present a slightly smaller dimension than that of the corresponding channels. The small slope present from the ridges and channels to the upper and lower edges of the front face is also visible in this unit and, due to the intersection of the planes which this slope forms, a small edge is visible both on the top (75) of the unit as on the bottom face.

Figure 5A:
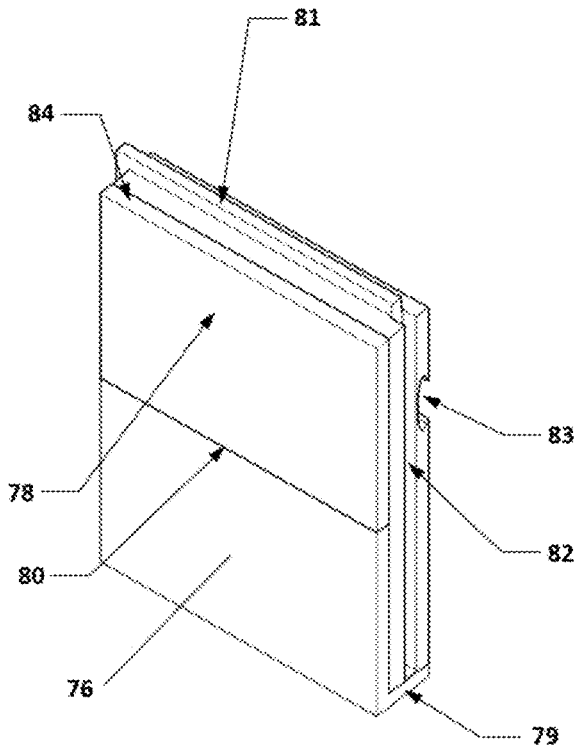
FIG. 5*a* illustrates a pair of masonry units suitable to the variation of the masonry system with insulation guaranteed from the inside and which consists in a primary modified masonry unit which presents an elliptical prismatic protuberance ready to fit into a depression which is an identical negative thereof, inverse, arranged longitudinally along the inner face of the other masonry unit. This other masonry unit is a special unit coating unit which has the function of covering the masonry unit in which it fits and the structural element or the singularity which is presented below the masonry unit in which it fits.

Referring now to FIG. 5*a*, this shows a combination of two different masonry units which can form part of a wall, assuming special functions. This pair of units consists of a modified primary masonry unit (77) which is capable of receiving another unit, which is a special covering unit (76) and which main function is to cover not only the modified primary unit, but also some singularities which can occur below this same primary unit, such as beams, slab edges, or even lintels above doors and windows. Thus, this combination of masonry units is preferably used whenever it is necessary to cover and "conceal" some structural element or singularity and there is no way to provide support due to the lack of existence of units in the rows below. Referring now to the particular case of the modified primary masonry unit (77), this unit maintains most of the main characteristics of the primary masonry unit, such as illustrated in FIGS. 1*a*, 1*b* and 1*c*, including: the insulation layer (86); the main central ridge on the top face (87) and the main central channel on the bottom face (88); the set comprised by the intermediary transverse upper semicircular channel (90), by the upper transverse quarter circle channels embedded on the side faces (91) and by the two pairs of upper longitudinal semicircular channels present on top (89); a similar set of pairs of longitudinal semicircular pairs of channels, of transverse semicircular channels and of quarter circle channels patterned on the lower face, of which one quarter circle side channel can be seen (92) and a larger main channel arranged halfway the lower face (88). The modified primary masonry unit also maintains the four cavities (93), such as occurs in the original primary masonry unit. All these elements assume the same functions and have the same proportions of the corresponding elements relative to the primary masonry unit. However, the main differences between the modified primary masonry unit and the original primary masonry unit are essentially that the first does not comprise ridges nor secondary channels to adjust to the secondary channels and ridges of other primary masonry units or to adapt to other channels and ridges of other secondary masonry units. It does not comprise either a final finishing coat layer. Instead, the modified primary masonry unit (77) presents an elliptical prismatic protuberance (85) ready to receive a special covering unit (76) characterized by having a channel with the reverse form (86) of that protuberance. It is this covering unit that assumes the functions of the "missing part" of the modified primary masonry unit, since this new covering unit presents a final finishing coat layer (78) and has a side channel along all the left face thereof (82) and a ridge that is developed along the top and lateral right faces (81) thereof. These ridges and channels present the same transverse section as the ridges and channels of the other masonry units. It is important to emphasize that the final finishing coating layer (78) can extend from the bottom face of the unit (79) for aesthetic reasons, allowing a better finishing in the lower ends of the wall which it is intended to remain "visible". For aesthetic reasons, a false joint (80) is engraved on the outer face of the covering unit, standing out on the final finishing coating layer. With this false joint (80) it is intended to guarantee an apparent continuity of the joints originating from other masonry units present in the same wall. The small slope planes developed from the upper ridge and the lower channel to the upper and lower edges of the front face, respectively, are another of the characteristics that this covering unit comprises (84). The width of this unit has exactly the dimension which was missing to, together with the alternative primary masonry unit, totally make up the width of the original primary masonry unit as the one shown in FIGS. 1*a*, 1*b* and 1*c*. The length foreseen for this covering unit is the same as the length of the unit which it must cover, while the height can be the height of the unit that covers and which offers it support, plus the height of the structural element which it is intended to conceal. As regards this particular covering unit, the masonry system proposed further foresees other forms and configurations which are not shown herein. Logically, the forms and dimensions thereof depend on the singularity to be covered and the desired aesthetic effect for the real and false joints.

Figure 5B:
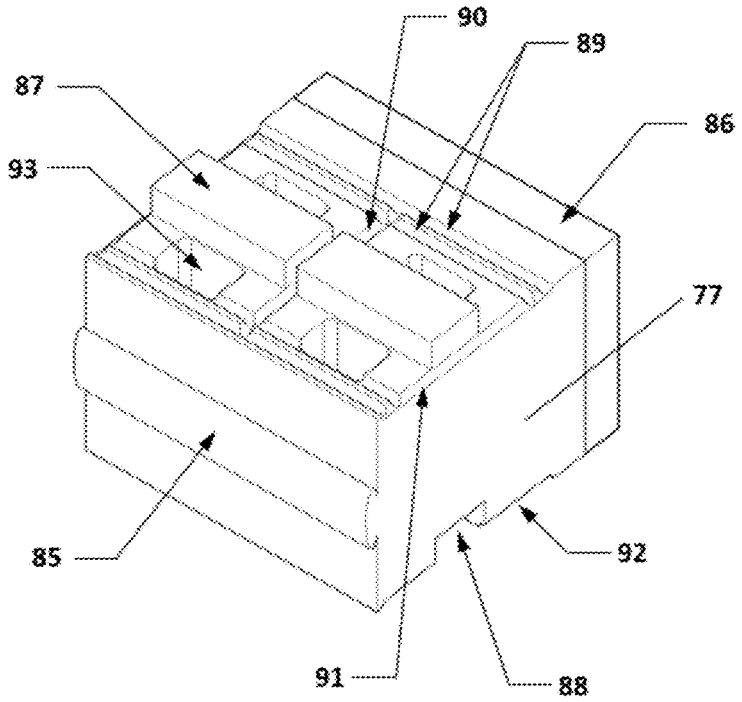
FIG. 5*b* illustrates the fitting process of the two masonry units described in FIG. 5*a*, and which are a modified primary masonry unit and a special coat unit.
Figure 5C:
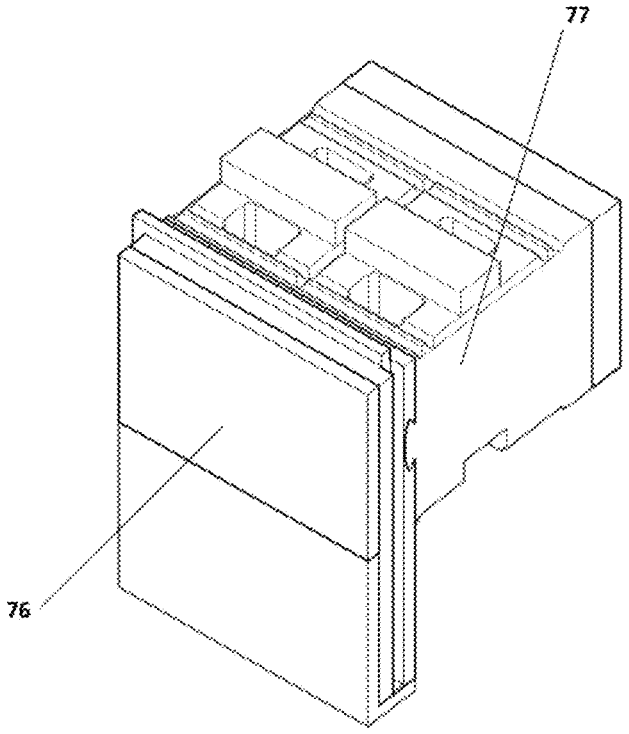
Figure 5D:
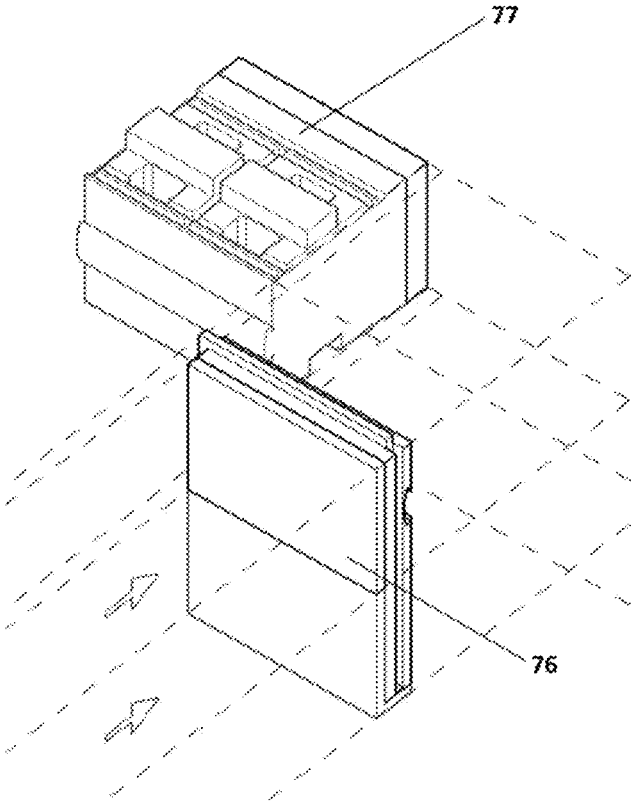
Figure 5E:
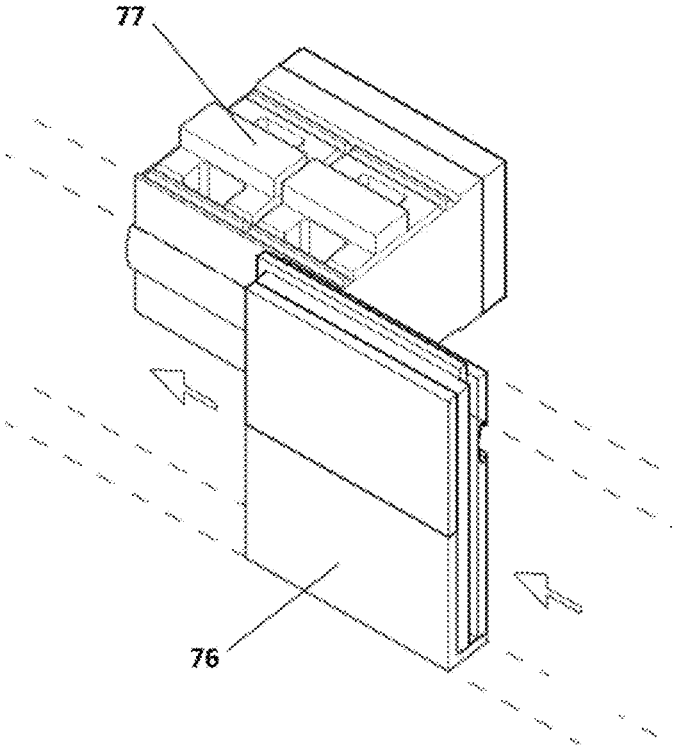
Figure 5F:
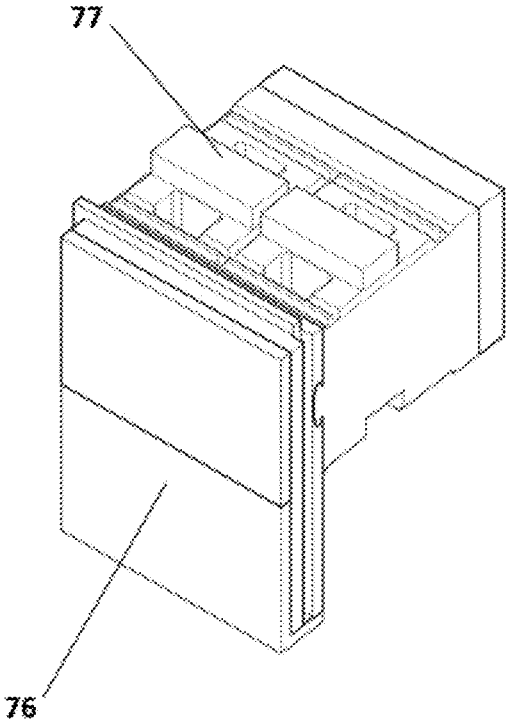

Framing the analysis in FIG. 5*b*, the same shows the manner in which the two masonry units disclosed by FIG. 5*a* can fit. In a first instant, the modified primary masonry unit (77) must be laid at the desired location. Next, according to the scheme i), the special covering unit (76) must be moved in such a manner that it remains in the same plane as the plane that contains the modified primary masonry unit fitting, and in a position slightly beside this same unit. The alignment of the units must be such that the elliptical prismatic channel of the covering unit is perfectly aligned with the elliptical prismatic protuberance of the modified primary masonry unit. Phase ii), in its turn, involves sliding the covering unit so that this fits the elliptical prismatic channel in the elliptical prismatic protuberance of the modified primary masonry unit. Once the covering unit is fully arranged in the desired position, the fitting process will be complete (iii)).

Referring now to FIG. 6*a*, this shows three different types of reinforcement bar units which can be part of the proposed masonry system. FIG. 6*b* shows the manner in which the same three reinforcement bar units can fit in a wall. The first reinforcement unit possible is nothing more than a set of simple circular section bars (94). In this type of reinforcement, each simple bar (97) is longitudinally arranged on the pairs of longitudinal channels of the primary masonry units (102). Each time it is necessary to insert a new bar, this insertion must be made in the lateral semicircular channels, not filled yet, guaranteeing an overlap of the reinforcement bars (103), as can be observed by the situation i) appearing in FIG. 6*b*. The way to fit these reinforcement bar units consists in positioning them in one of the two upper longitudinal channels which each pair of side channels of the main masonry units (102) comprises. Next, a new pair of reinforcement bars can be inserted in the empty upper longitudinal channels, always guaranteeing an overlap with the length of a primary masonry unit, at least. The corresponding channels on the lower part of the primary masonry units which will be laid above will involve the remaining portions of the reinforcement bar units. This type of reinforcement bar unit, as illustrated in FIG. 6*a*—i) can be used essentially to prevent cracking phenomena in case the laying of the masonry units is processed by wet process.

Another possibility of reinforcement disclosed in FIG. 6*a*—ii) is the reinforcement bar unit of the type "reverse C-C" (95). This type of reinforcement unit can be produced by folding a single simple bar in segments which repeatedly acquire longitudinal (98) and transverse (99) directions in lengths such that allow the fitting thereof in the transverse and longitudinal semicircular channels and in the transverse quarter circle channels present in the primary masonry units (102), in a similar form as that graphically described in FIG. 6*b*—ii). Once again, in cases where the length of the reinforcement unit is not sufficient, the pairs of longitudinal semicircular channels allow the establishment of two distinct paths for the fitting of these reinforcement units, allowing inclusively the overlapping between the last section of a reinforcement unit and the first section of another. The corresponding channels on the lower part of the primary masonry units which will be laid above will involve the remaining portions of the reinforcement bar units. This reinforcement bar unit in particular, as illustrated in FIG. 6*a*—ii), configures the right choice for laying by wet process and by dry process of the masonry units, whenever it is desired to construct a wall which unites high structural integrity and good anti-seismic behavior. Apart from the improvement in behavior in face of the cracking phenomena which can be felt with the option of laying by wet process, this unit of reinforcement bars can also guarantee a wall with high performance in the dry process option. In fact, due to the shape which the "reverse C-C" reinforcement bars have, whenever a transverse segment (99) crosses the main central ridges of a primary mason unit and, by the longitudinal segments thereof (98) joins the other transverse segment (99) which passes through the main central ridge of the other primary masonry unit, it is possible to obtain the locking of the primary units present in the row which received the reinforcement. This locking mechanics is responsible for the structural integrity of the wall, especially when the units are laid by dry process. Another quite interesting characteristic of this reinforcement unit is that due to its "reverse C-C" shape, the unit can act as a spring present in the horizontal joints between the rows of the masonry units. This possibility is of particular interest in the area of anti-seismic behavior, since it brings flexibility to the wall, allowing the same to accommodate a certain level of deformation in the horizontal planes and to recover, in what can be understood as an elastic behavior.

A third type of reinforcement bar unit can be seen in FIG. 6*a*—iii). This is a ladder-shaped reinforcement bar unit (96) which consists in two longitudinal bars (100) united by transverse bars (101) which dimensions allow this unit to accommodate in the semicircular channels and in the quarter circle channels arranged on top and in the lower face of the primary masonry units, such as can be observed in FIG. 6*b*—iii). Such as happens with the "reverse C-C" unit, the ladder-shaped reinforcement units, can take advantage of the pairs of longitudinal semicircular channels present on the top and bottom faces of the primary masonry units, whenever the length of the reinforcement unit is not sufficient to surmount all the wall development. Thus, it becomes possible to overlap the points of the reinforcement unit which end with the points of the reinforcement unit that begins. This type of reinforcement unit is destined to be used both in the case of laying by dry process as in the case of laying by wet process, the reinforcement being indicated to obtain a more rigid wall. The three reinforcement bar units (94, 95 and 96) were designed to be produced in metallic material, concretely in material obtained from steel waste originating from the most diverse sectors of the industry. However, any material having suitable flexibility and resistance, preferably of metallic nature, can be used.

Now analyzing FIG. 6, this discloses an upper view of a row of primary masonry units (102) present in a wall in three different situations, which are: i) a wall which includes simple reinforcement bar units (94), being visible the overlapping of these same units (103) which take advantage of the existence of two pairs of longitudinal semicircular channels on the upper and lower faces of the primary masonry units; ii) a wall which includes ladder-shaped reinforcement bar units (96), where it is visible the overlapping (105) between two pairs of segments, taking advantage of the existence of longitudinal semicircular channels and transverse channels on the upper and lower faces of the primary masonry units; iii) a wall which includes "reverse C-C" reinforcement bar units (95), being visible the overlapping (104) which equally takes advantage of the existence of longitudinal semicircular channels and of transverse channels at the top of the main masonry units and in their lower faces. What can also be noticed is the final finishing coating of the wall (106) obtained by successive layers of finishing coating of the primary masonry units and the internal insulation layer (107), also obtained by the junction of the insulation layers of these same primary masonry units.

Figure 7A:
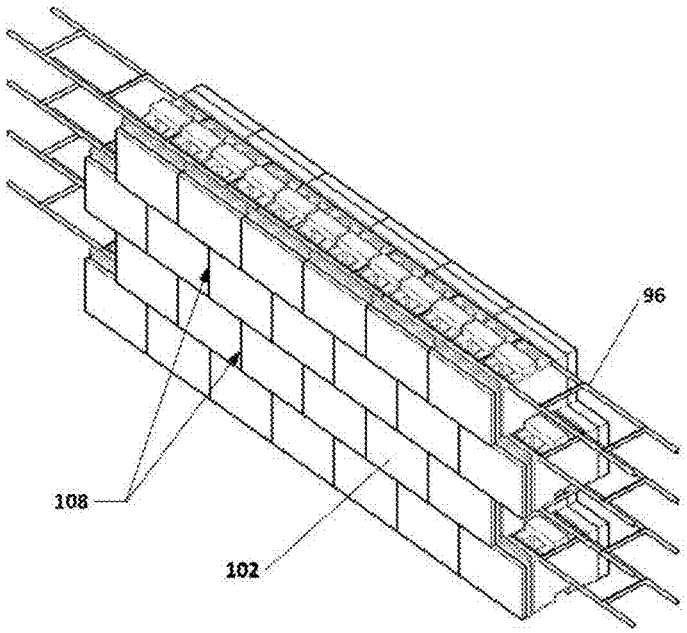
FIG. 7 illustrates top perspective views of a set of primary masonry units with insulation layer from the inside with reinforcement units between them. Two situations are visible: the masonry units laid with aligned vertical joint and the masonry units laid with unaligned vertical joint at half unit.
Figure 7B:
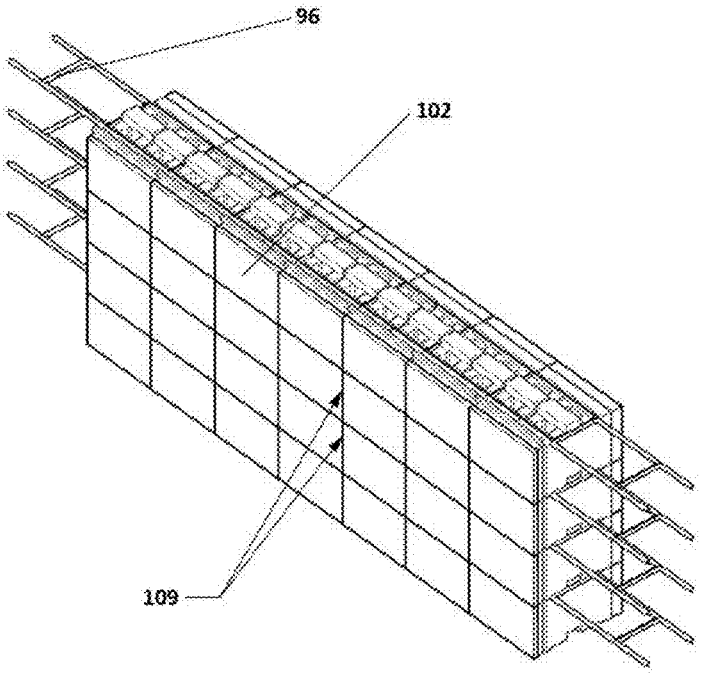
Figure 8A:
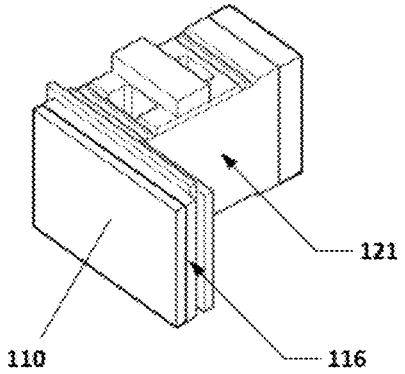
FIG. 8 illustrates six masonry units based on the variation of the primary masonry unit with insulation layer from inside and which enable overcoming some singularities which can occur when a masonry wall is constructed.
Figure 8B:
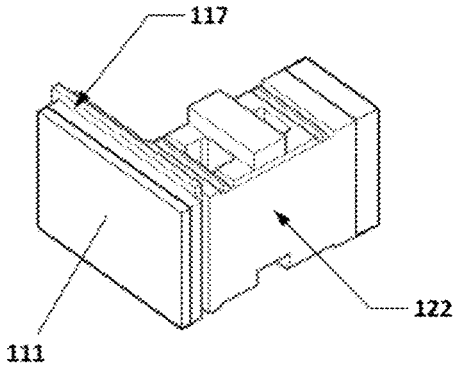
Figure 8C:
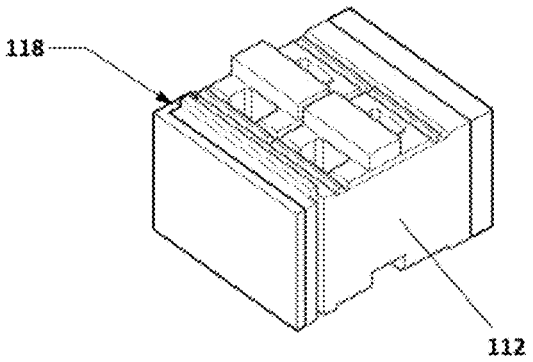
Figure 8D:
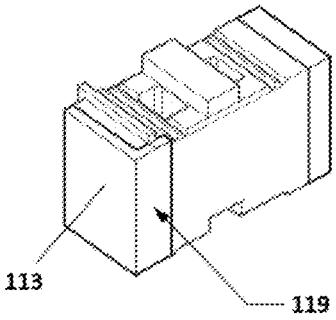
Figure 8E:
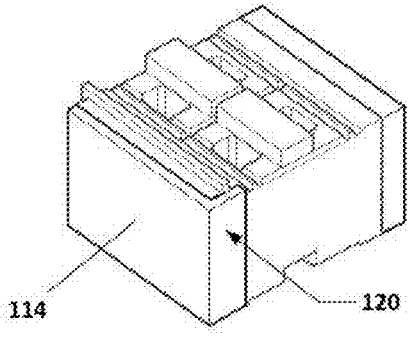
Figure 8F:
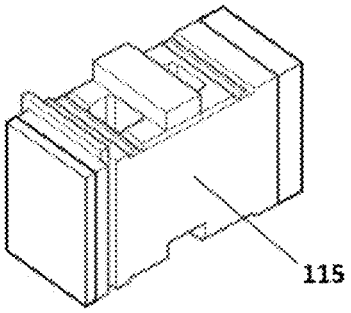

FIG. 7, in its turn, refers to two walls constructed with primary masonry units with insulation layer from the inside (102) and with ladder-shaped reinforcement bar units (96). What is also visible in this figure, is a characteristic of the present masonry system, which is related to, once any of the three reinforcement bar units is inserted, the possibility of constructing a wall with unaligned vertical joints (108) —as can be seen observing the situation i), or the possibility of constructing with aligned vertical joints—(109) —as can be observed in ii). In fact, using exclusively the primary masonry units, that is, units without reinforcement, the laying of the units must be made only with the vertical joints unaligned, since this will be the manner to obtain a good stability for the project, since in this manner the vertical joints will not run in the same vertical plane. On the contrary, if a ladder-shaped (96) or "reverse C-C" (95) reinforcement bar unit is inserted, the stability of the set improves in case there exist unaligned joints. Additionally, the laying of the masonry units with coincident vertical joints, is now possible, since the reinforcement bar units, due to their shape, "lock" the primary masonry units between themselves, even without using any binding material between them.

Focusing the analysis of FIG. 8 this shows some other embodiments of the masonry system which is now disclosed. All these embodiments are derived from the primary masonry unit (102) and were designed to overcome some singularities which occur, sometimes, when a wall is constructed. As can be seen in i), a special masonry unit which can be part of the masonry system presented herein is a primary masonry half unit with an extension of its covering portion to the left (110). This extended covering portion (116) enables this unit to partially cover a singularity such as a structural pillar which occurs in the development plane of a masonry wall. To cover the other side of the column, and "embrace" it, an additional unit (111) with its covering portion extended to the other side (right side) (117) is also foreseen. This unit can be observed in drawing ii).

Both masonry units (110 and 111) present the same length, height, and width dimensions as the primary masonry unit (102), however the main bodies thereof (121 and 122) have only half the length dimension. Other singularities which frequently occur in the construction of a masonry wall are the need to contour windows and doors or any opening in the wall that may exist. Naturally, the present masonry system also needs to be capacitated to contour these singularities. Thus, the referred system foresees some units which have a mortise in the final finishing coating layer thereof, which mortise provides the cover of the outer borders of the opening with the same material and with the same aspect as the external face of the remaining masonry units. The masonry units, as the primary masonry units for borders of gaps (112 and 114) and half primary masonry units for borders of gaps (113) assume this function. As such, FIG. 8 shows in drawing iii) a primary masonry unit for borders of gaps with the mortise of the final finishing coat layer (118)

on the left side (112); in drawing iv) is represented a half primary masonry unit for borders of gaps with the mortise of the final finishing coat layer (119) on the right side; in drawing v) is seen a primary masonry unit for borders of gaps with the mortise of the final finishing coat layer (120) on the right side thereof (114). The materials, dimensions and overall characteristics of the primary masonry units and primary masonry half units are maintained by the derivations of the referred masonry units (112, 113 e 114). The drawing vi), in its turn, presents a fundamental masonry unit for the referred masonry system, which is a primary masonry half unit (115). This unit is nothing more than a derivation of the primary masonry unit which has half its length, maintaining the remaining characteristics, however without having the central semicircular channel and with only two cavities instead of the four cavities present in a primary masonry unit (102). Any one of the units indicated in i), ii), iii), iv), v) and vi) is comprised by the same materials as the remaining units, presenting the same final finishing coating and insulation layers. Additionally, they all maintain the same characteristics of the primary masonry units, such as their cavities, ridges, and channels, conveniently adapted to the requirements of each one of these units. However, it must be remarked that only some of the masonry units that the system comprises are disclosed herein. The system comprises other embodiments which are not revealed in the referred drawings nor discussed herein, but which, however, are not beyond the inventive scope of this application.

Focusing the analysis on FIG. 9, this shows an example of how the present masonry system, in its variation of insulation from inside, can be constructed around a reinforced concrete structure. To exemplify, FIG. 9*a*) shows part of a generic reinforced concrete structure having a pillar which goes from the foundation to the upper floors (123), a pillar which goes from the foundation to the ceiling of the 1st floor (124) and a pillar which begins on the 2nd floor and continues to the upper floors (125). The floors are embodied by massive reinforced concrete slabs with 20 cm thickness, whereby (126) is the massive reinforced concrete slab of the 1st floor and (127) is the massive reinforced concrete slab of the 2nd floor.

The example given herein presents some challenges for a masonry system already coated and insulated when one of the purposes is to guarantee a uniform final finishing coat for the exterior of a building and the total insulation of the inner space. Obtaining this is particularly difficult when it comes to coating and insulating the transitions from a masonry wall to the structural elements, as occurs with pillars, beams, or with slab edges of the example (128 and 129). The challenge is even greater if the laying by dry process of the masonry units is another of the objectives. To begin the construction of a wall with the masonry system described herein, having as basis a reinforced concrete structure such as exemplified, the first row of primary masonry units must always be laid over a layer of mortar or other binding material (130), regardless of whether it is desired to construct a wall laying the masonry units by wet process or by dry process. This is due to the absence of any ridge that allows receiving and "locking" the first masonry units on the slabs or on the beams of any other possible structure.

Figure 9A:
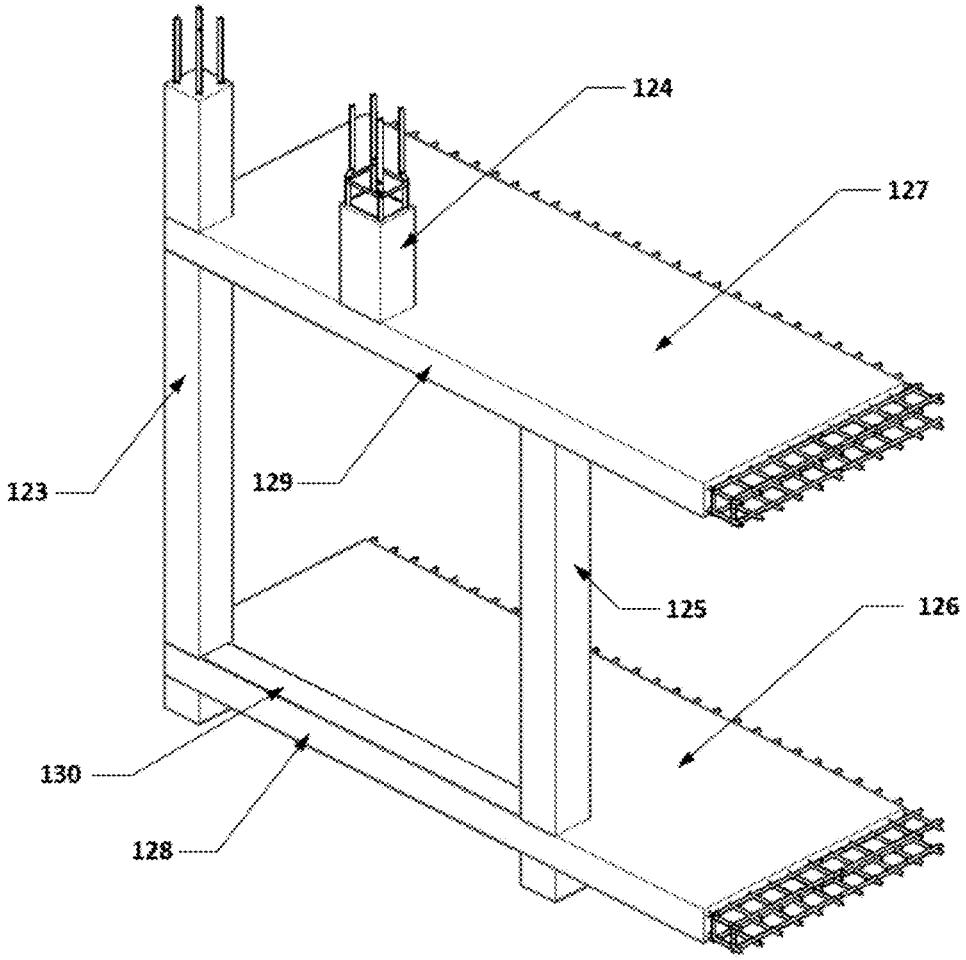
FIG. 9*a* illustrates an example of part of a reinforced concrete structure in which a masonry wall can be constructed in accordance with the masonry system now described.
Figure 9B:
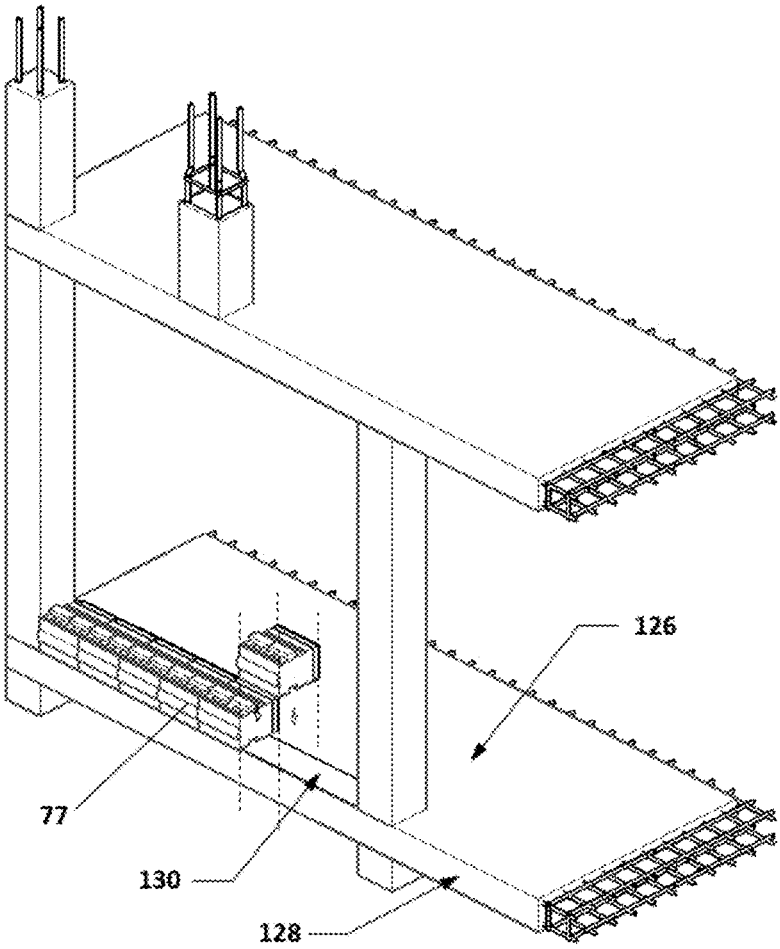
FIG. 9*b* illustrates the laying of a first row of masonry units with insulation layer from the inside in the same example of FIG. 9*a*.

Focusing the attention on FIG. 9*b*, this shows, in situation i), some modified primary masonry units (77) to be laid to form the first row of the front wall. The option for this type of unit refers to the elliptical prismatic protuberance thereof (85) which enables receiving a special covering unit (76) capable of covering both the modified primary unit (85) as the reinforced concrete slab edge (128). The situation ii) shows the manner of laying a modified masonry unit which must be aligned with the remaining modified primary masonry units and placed vertically contacting with the lateral face of the unit next to it.

Figure 9C:
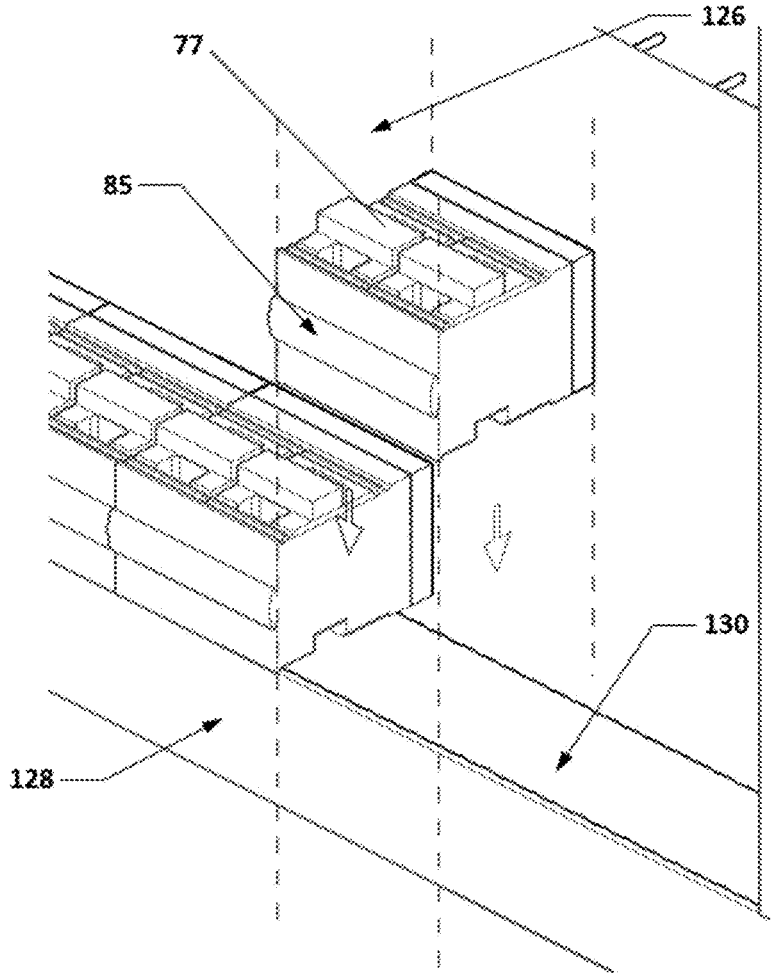
FIG. 9*c* illustrates the process of fitting a special coat unit in a modified primary masonry unit and the introduction of a unit of reinforcement bars.

Analyzing now FIG. 9*c*, this shows in situation i), the covering of the modified primary masonry units (77) which form the first row of the wall together with special covering units (76). These special covering units (76) allow covering and concealing not only the front face of the modified masonry unit (77), but also the slab edge of the 1st Floor (128). As can be seen in situation iii), the special covering unit (76) matches the modified masonry unit (77) by fitting the elliptical prismatic channel thereof arranged over all the length of its rear face to the elliptical prismatic protuberance arranged along the length of the modified masonry unit, in an approximation and sliding process illustrated in FIG. 5*b*). Another situation illustrated in FIG. 9*c*, is the introduction of reinforcement bar units which perform a fundamental role in the dry process laying of the masonry units. In this example, closely observed in situation ii), there exist ladder-shaped reinforcement units (96) which fit into the semicylindrical longitudinal channels and semicylindrical and quarter circle transverse channels on the top of the masonry units, as soon as this reinforcement unit is aligned vertically with these channels.

Figure 9D:
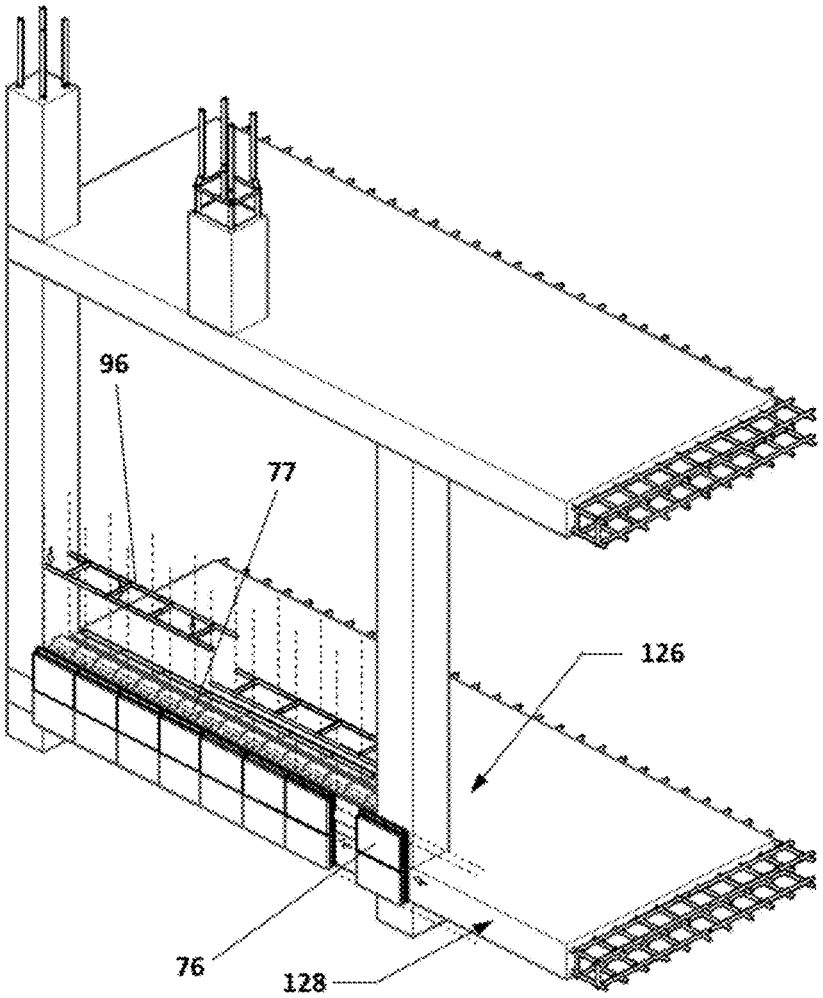
FIG. 9*d* illustrates another stage of the construction of a wall with insulation from inside, with the fitting of secondary coating units to coat and "conceal" a pillar.

FIG. 9*d*, in turn, shows another step of the construction of the example wall. This represents the manner of covering reinforced concrete pillars, such as the pillars (123 and 125), wherein two orthogonal faces must present the same final finishing as the remaining masonry units. In the example given, the pillars (123 and 125) have a transverse section of 25×25 cm. To guarantee two coated, orthogonal faces, units such as the "L" shaped pillar covering unit (132) only or the combination of a beam covering unit with 25 cm (131) with one of the embodiments of the alternative pillar covering (133) can be used. The example given shows a combination of both solutions. The manner of applying and fitting these covering units is illustrated by situation ii) which shows that, initially, the first unit (a beam covering unit (131)) is pasted to the pillar, guaranteeing that the channel thereof adjusts to the ridge of the special covering unit (76) which is next to it. Next, one embodiment of the alternative pillar covering unit (133) is also pasted to the pillar, in such a manner that the channel of its rear face adjusts and fits in the ridge of the reception unit. Above these two units, an "L" shaped pillar covering unit (132) is placed, fitting the lower channels thereof in the upper ridges of the units (131 and 133). However, an observation is necessary about the covering of the column. Due to the reduced thickness thereof, the units destined to pillar coverings must use adhesive cement or other binding material to paste them to the column, regardless of the laying of the remaining units being carried out by dry process or wet process. One manner to avoid the excessive use of adhesive cement or other binding material with analogous functions can consist in pasting the first covering unit or units and, next, placing the covering unit or units immediately above by dry process, guaranteeing once again binding material to paste the third unit or units and, next, once again dry placing the fourth unit or units, proceeding with this logic of pasting rows of covering units alternatively thereafter. As a result of this process, the dry laid units will support themselves on the units pasted to the pillar and, as such, the stability thereof will be guaranteed.

Figure 9E:
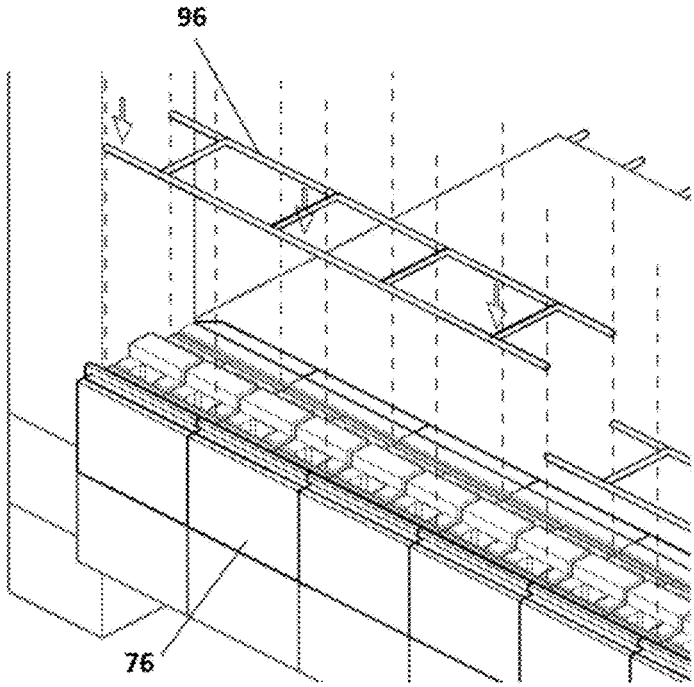
FIG. 9*e* illustrates the beginning of a process for overcoming a difficulty which is related to a singularity that frequently occurs in a wall, which singularity is the existence of a window.

Referring now to FIG. 9*e*, this discloses the initial steps of a process for overcoming the existence of openings in the wall to be constructed, as occurs with the windows. As can be seen in situation i), the lower borders of the window are formed by primary masonry units (102), which main projections were removed, which can be done in construction using mechanical means. The side borders of the window, in turn, are embodied by units derived from the primary masonry units, which front borders comprise the same final finishing coating layer as the front face of the remaining masonry units. Units such as the primary masonry unit for borders of gaps (114), shown in detail in situation ii), or the primary masonry half unit for borders of gaps, must be used. The ladder-shaped reinforcement bar units (96) are once again ensured in the horizontal joints.

Figure 9F:
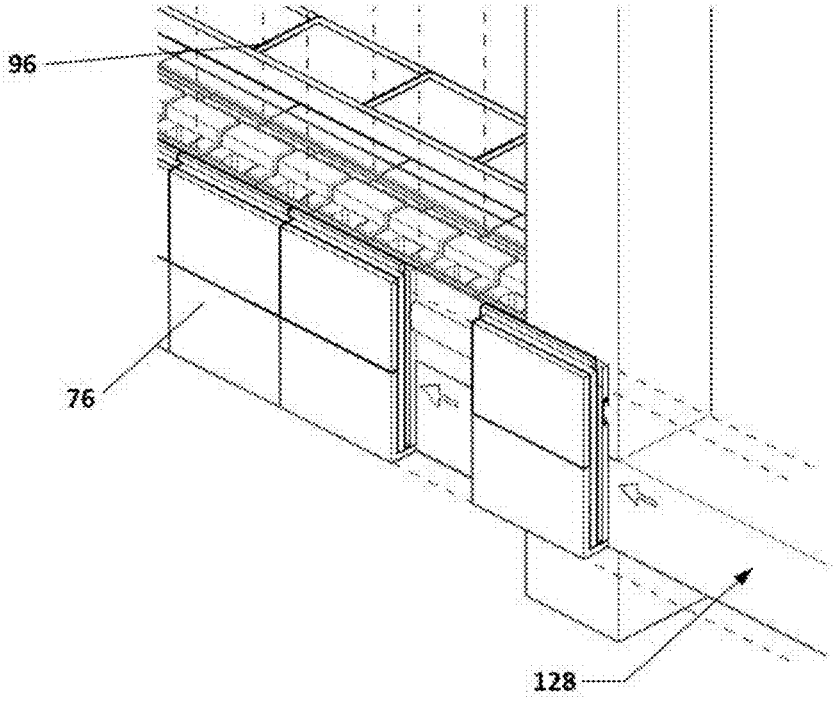
FIG. 9*f* illustrates a stage of a process for overcoming a difficulty due to a singularity which occurs in a wall which is the existence of a window.

Analyzing FIG. 9*f*, a more advanced step of the process for overcoming, with the presented masonry system, the existence of a window, can be seen. The lower and lateral borders of the window are already embodied, however there now exists the need to foresee some element that allows the execution of the upper borders. For this function, a locally molded or prefabricated lintel (134) can be used.

Figure 9G:
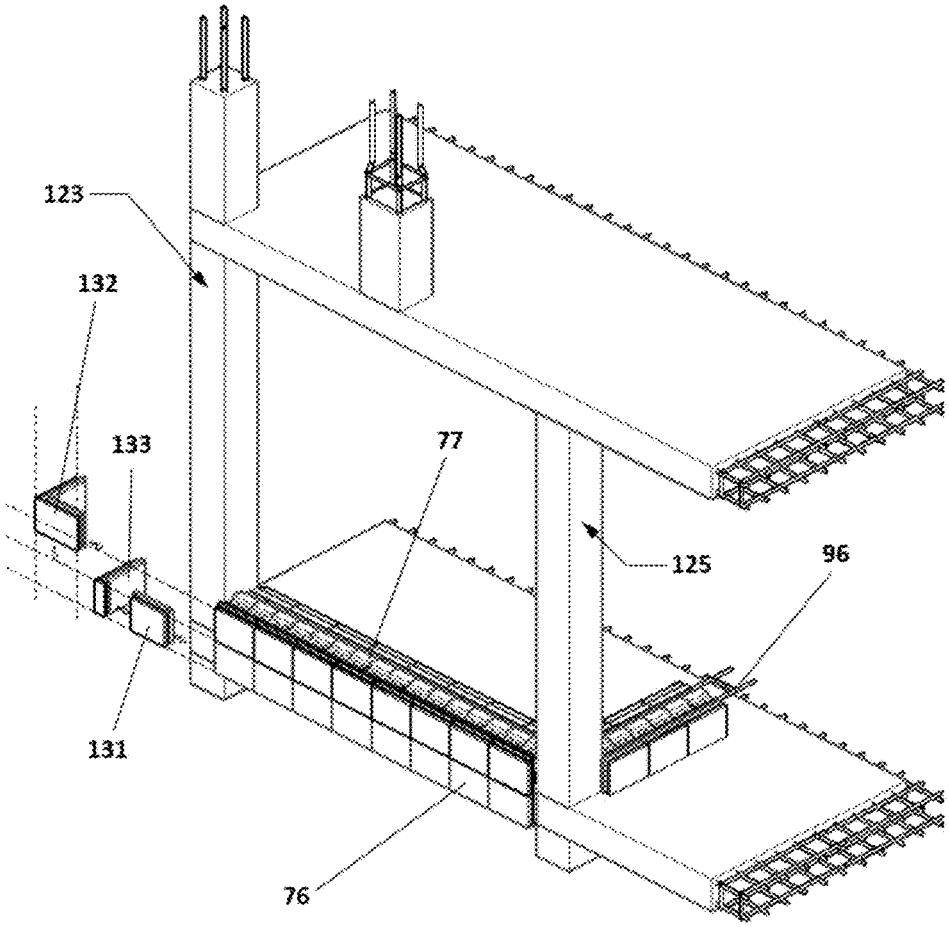
FIG. 9*g* illustrates the final stage of a process for overcoming a difficulty due to a singularity which occurs in a wall which is the existence of a window.

Focusing on FIG. 9*g*, this shows the final steps of the process for overcoming the existence of a window in the masonry wall by means of drawings i) and ii). The way to guarantee the covering and an aesthetically pleasant appearance to the upper borders of the window involves laying the modified primary masonry unit (77) above the previously provided lintel (134). These units will be responsible for ensuring the support for the special covering units (76) which adjust to modified primary masonry units as described in FIG. 5*b*). The small mortise of the final finishing coating layer which the lower part of the special covering unit (76) comprises, guarantees the final finishing coat to the upper border of the window. On the corners of this same window, another embodiment of the special covering unit having a front face of 30×20 cm (length×height) (136) is fitted in a modified masonry unit (77) which main central ridges must be removed by mechanical means, enabling this unit to fit in the space between the lintel and the upper slab, which in this example as a height that is approximately equal to the heights of the body of this masonry unit, after discounting the height of the ridges. The space left to cover can be covered by a beam covering unit of 15×20 cm (135).

Figure 9H:
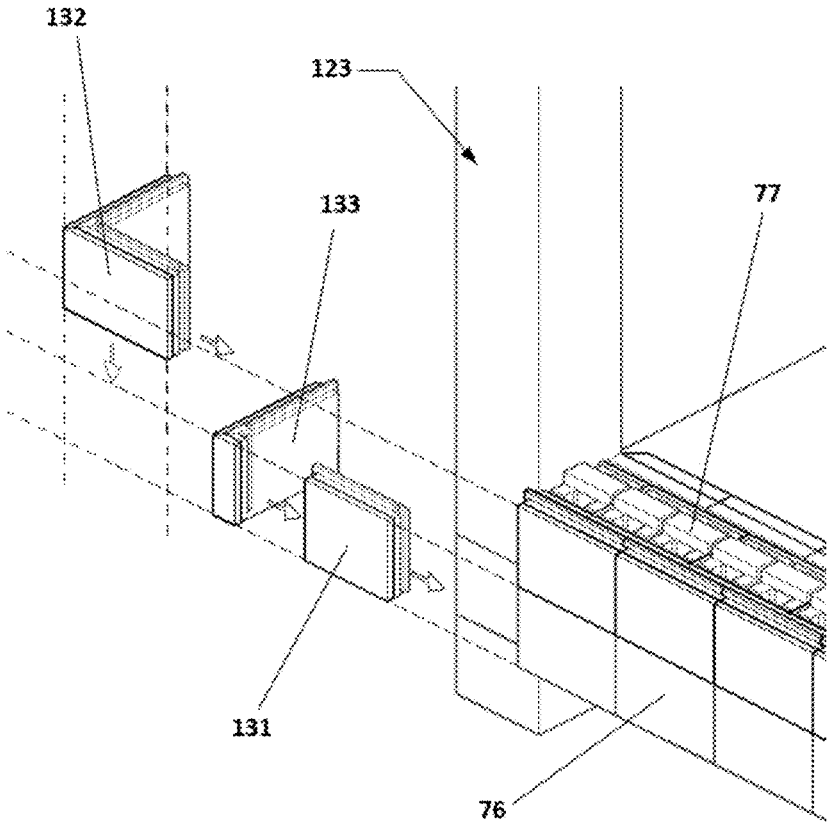
FIG. 9*h* illustrates a process for overcoming a singularity which can occur in the construction of a wall using the masonry system herein described, and which is related to the manner of covering and "concealing" the edge of a slab without the existence of any masonry unit below to provide support.

With reference to FIG. 9*h*, this shows the process of covering the border of the slab of the 2nd floor (129), with the laying of the first row of masonry units of the 2nd floor, the beginning of the process of covering the pillar which goes from the 2nd floor (124) and the first steps to conceal the border of the slab of the 2nd floor, where there do not exist masonry units below to support the covering units. Providing the support ensured by the masonry units below is guaranteed, the borders of the slab can be covered by regular beam covering units (137) and, consequently, the first row of the 2nd floor is embodied by regular primary masonry units (102). The same regular beam covering units (137) can be used to cover some sections of the pillar (124). However, when there is no support ensured by the masonry units below, a solution such as shown in situation ii) can be carried out. In this case, the modified primary masonry units (77) are part of the first row of units of the 2nd floor which, due to the elliptical prismatic protuberance thereof, enables the fitting of the special covering units (76). These special covering units, once fitted, will cover the masonry unit where they fit and the border of the slab below (129). To fill the spaces not covered by these special covering units there can be used secondary masonry units, such as the beam covering unit of 15×20 cm (135).

Figure 9I:
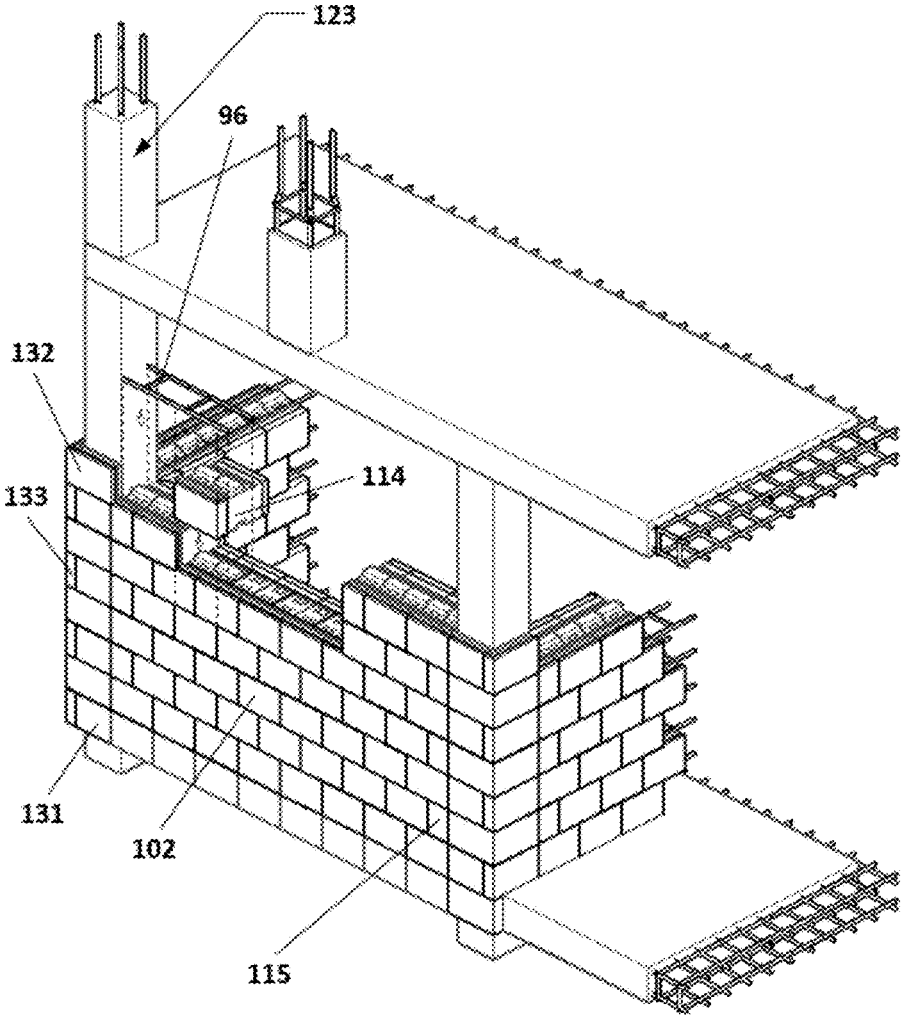
FIG. 9*i* illustrates a process for overcoming another singularity which can occur in the construction of a wall using the masonry system herein described, and which is related to the manner in which the wall can "embrace" a pillar which occurs somewhere within the planar wherein the construction of the wall is developed.

Referring now to FIG. 9*i*, the same shows a way to overcome another singularity which occurs in the given example, and which refers to the existence of a pillar somewhere (124) in the place where the wall develops. In the particular case of this example, this pillar (124) presents a transverse section of 30×25 cm. The way to "embrace" this pillar in the masonry system described herein is shown by the drawings i) —where a generic part of the wall is shown—and ii) —where this is shown with a more detailed zoom. As in the given example, the wall is constructed with unaligned vertical joints, one in each two rows of the masonry units must present a different solution from that which makes use of a regular beam covering unit (137). As such, the masonry system foresees two complementary masonry units, both being a primary masonry half unit with an extension in the covering portion thereof to the left (110) and a primary masonry half unit with an extension of the covering portion thereof to the right (111). Both units are vertically laid in a way that the flat side face abuts the side face of the other masonry unit, while the side face of the extension side abuts the pillar face.

Figure 9J:
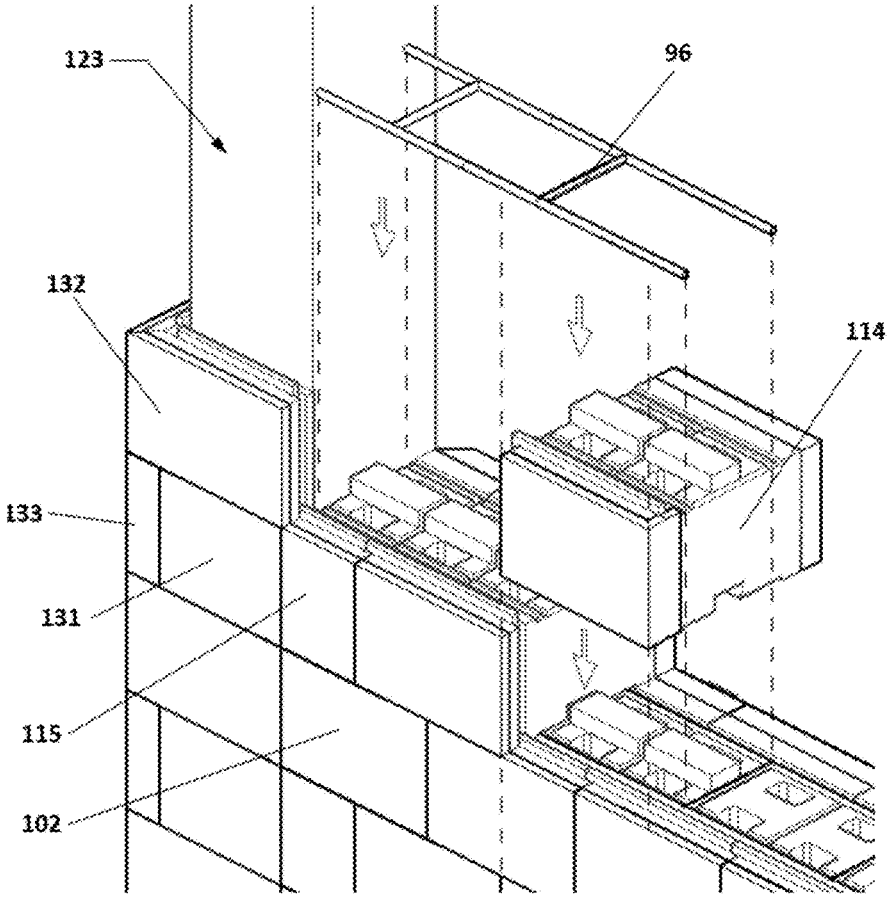
FIG. 9*j* illustrates a wall constructed with units developed for the variation of the masonry system with insulation from the inside, wherein all the previously mentioned singularities are overcome.

FIG. 9*j*, in turn, shows an upper left front projection of a portion of the wall with all the previously mentioned masonry constructive processes and with insulation boards (138) arranged on top of the slabs of the 1st and the 2nd floors, so as to completely insulate all the interior environment.

Figure 9K:
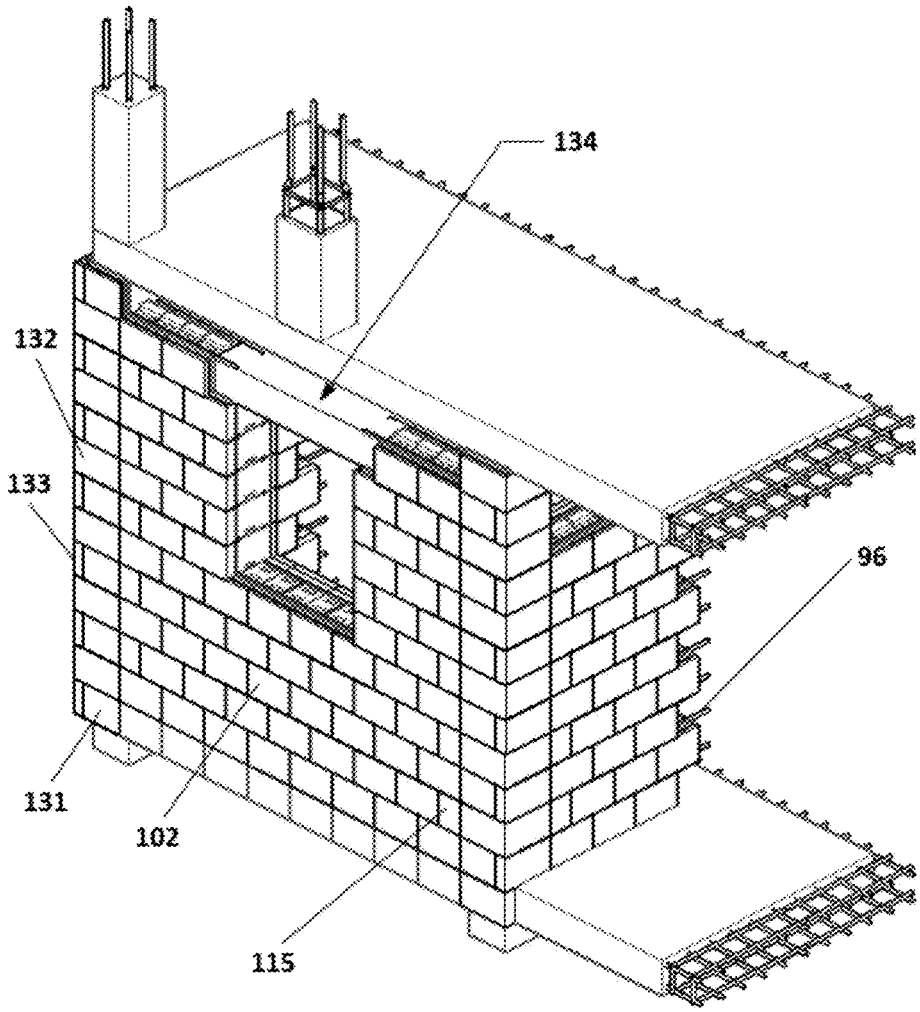
FIG. 9*k* illustrates the same wall of FIG. 9*j* in a perspective viewed from the inner side.
Figure 9L:
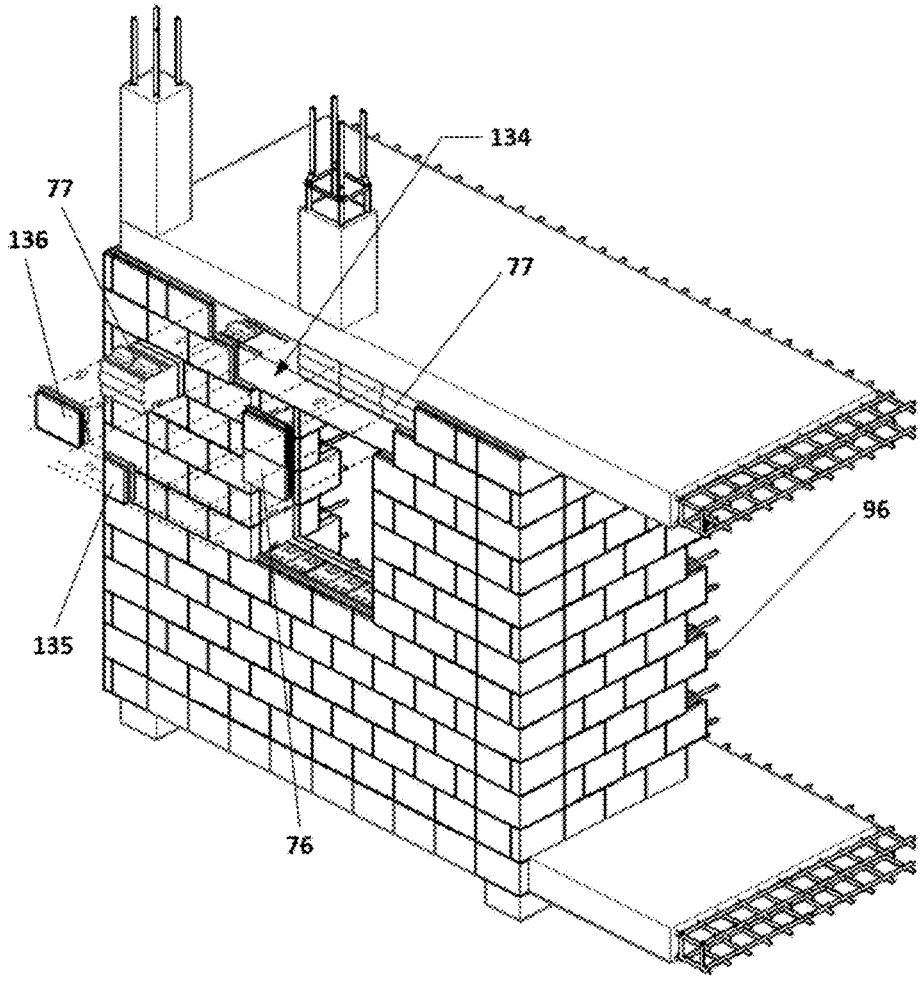
Figure 9M:
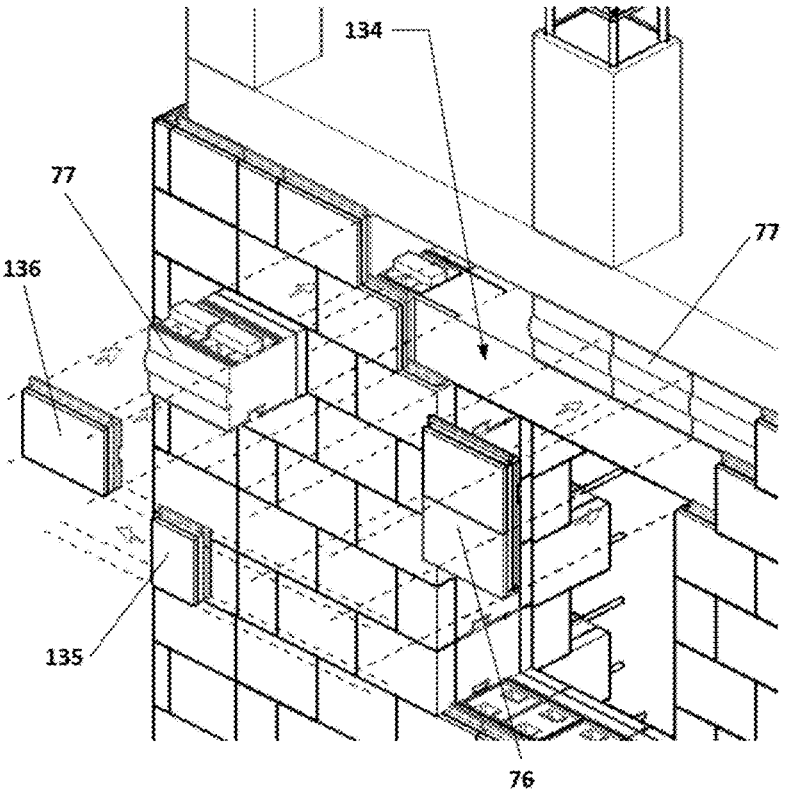
Figure 9N:
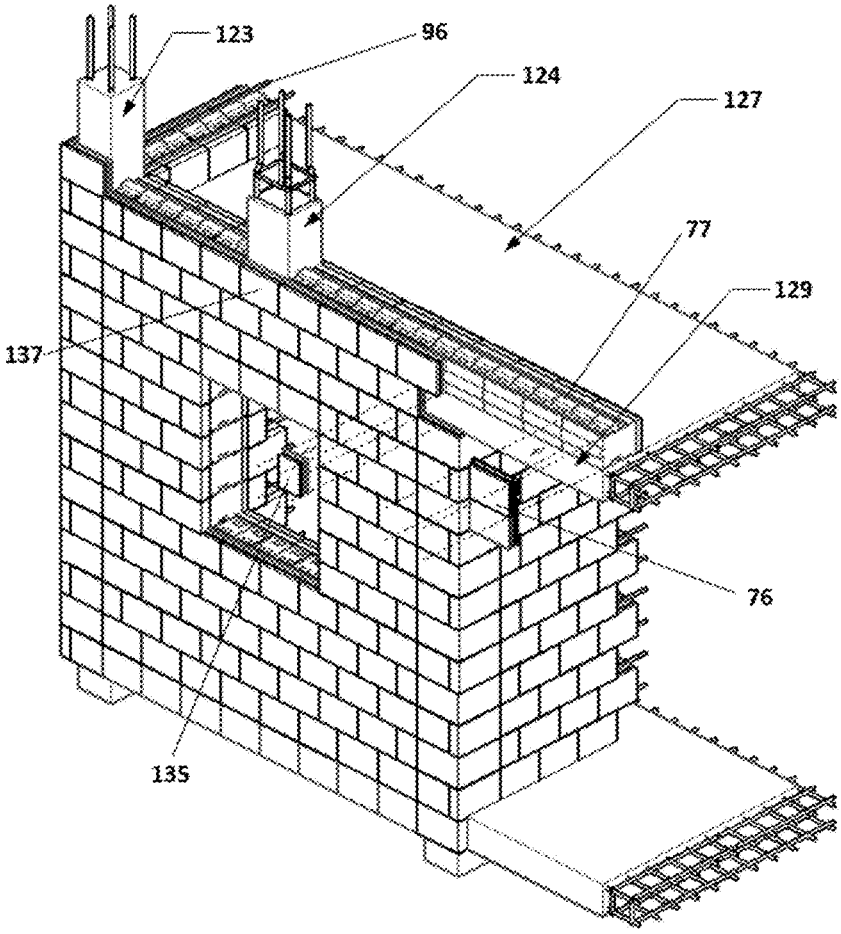
Figure 9O:
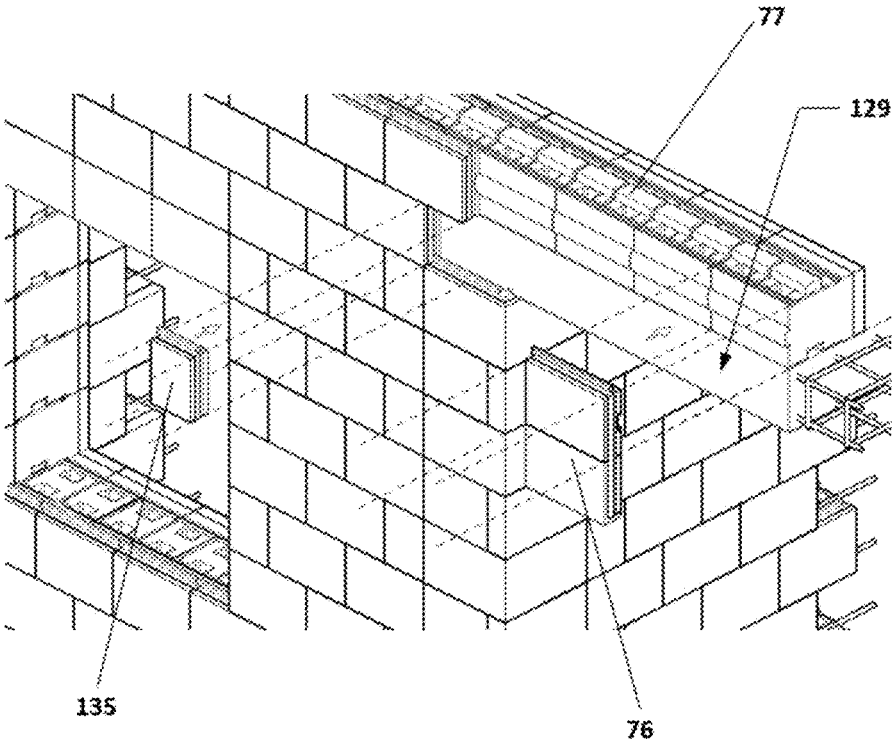
Figure 9P:
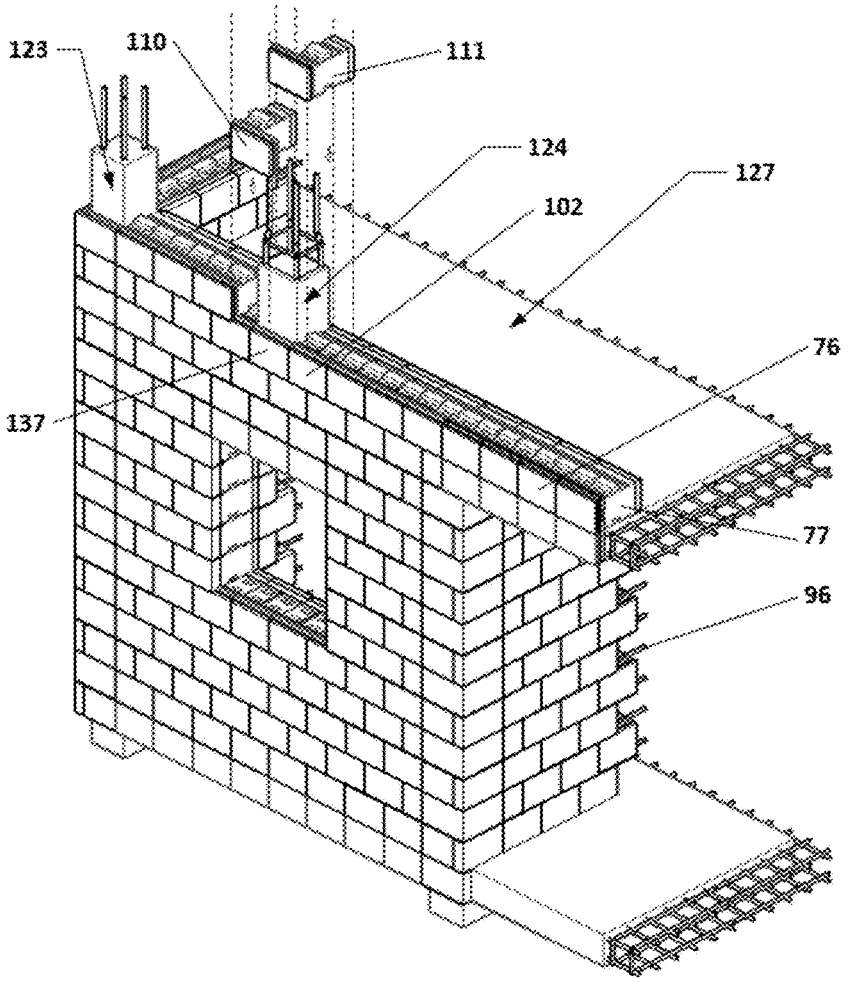
Figure 9Q:
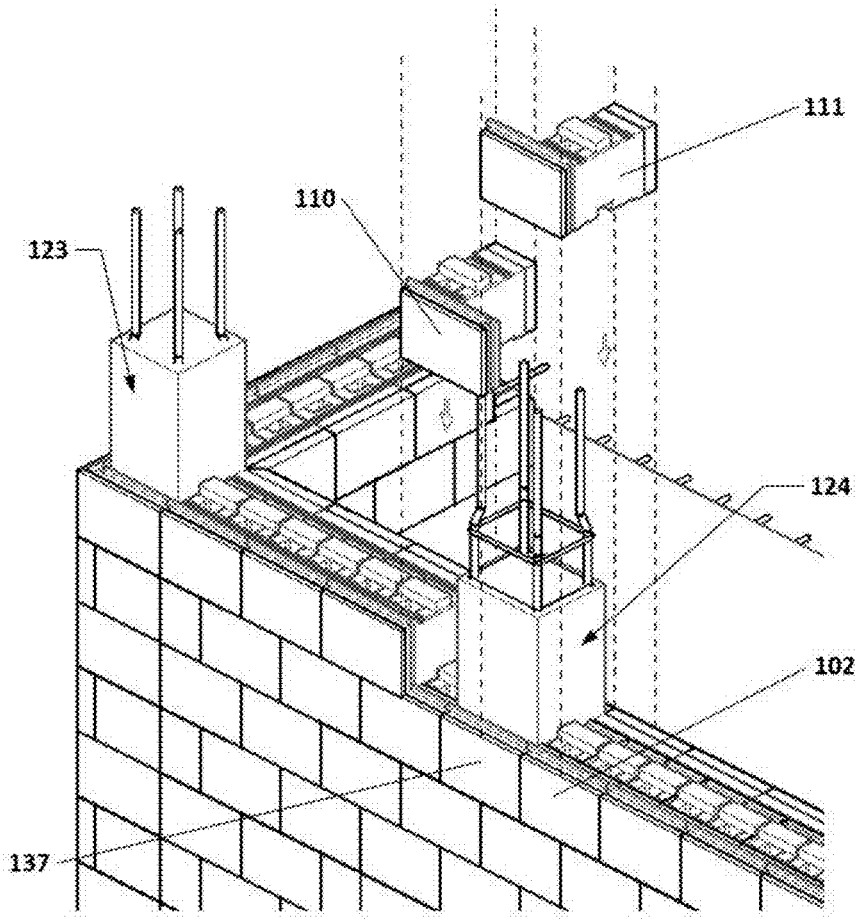
Figure 9R:
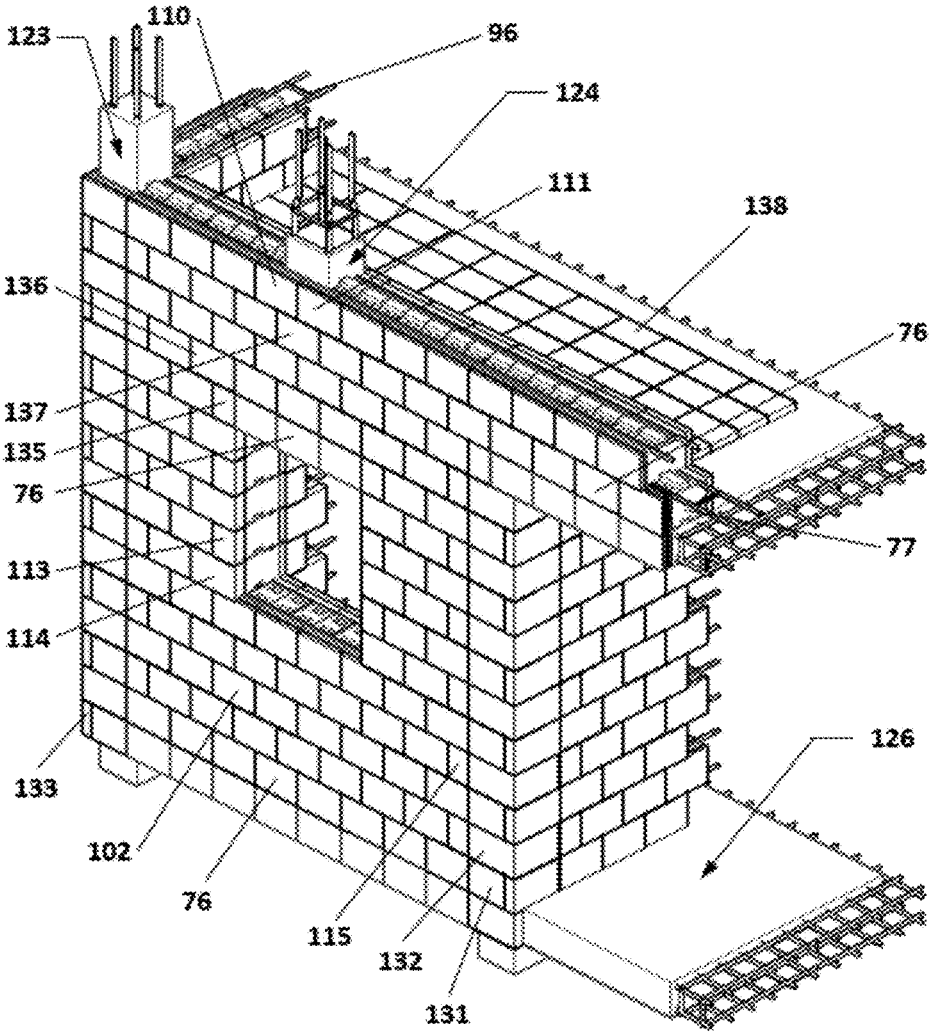
Figure 9S:
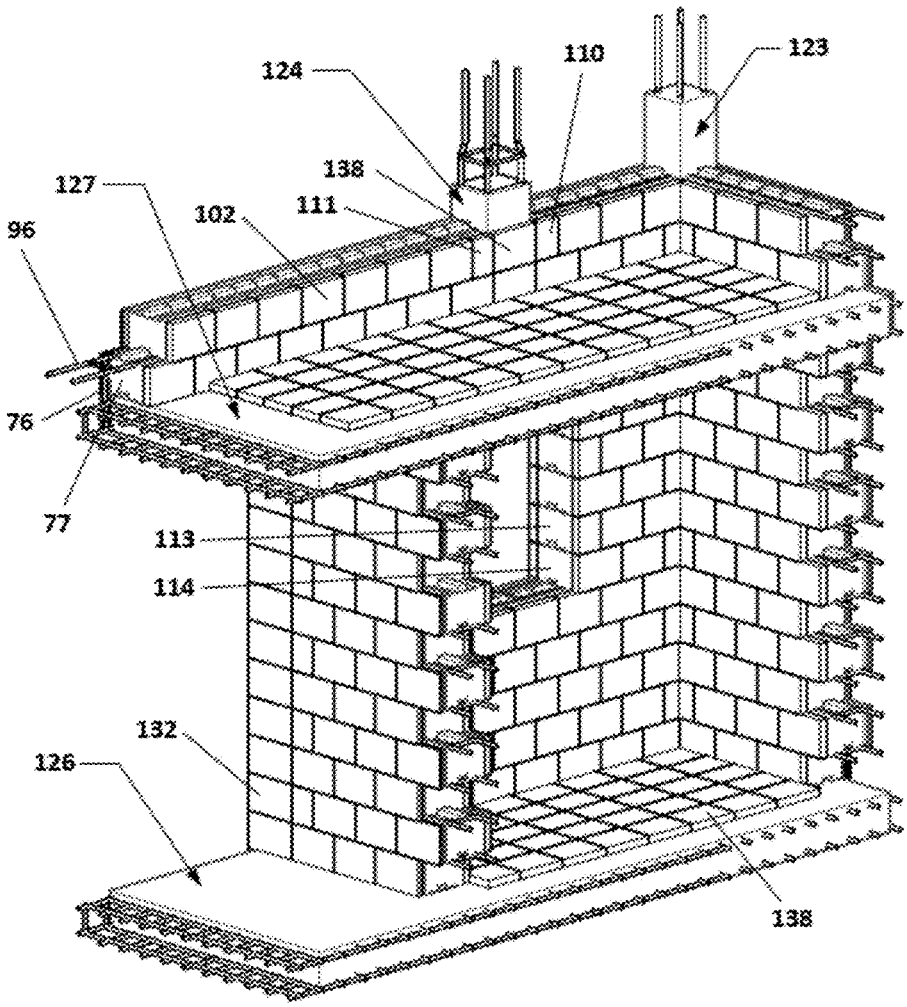

Focusing on FIG. 9*k*, this shows an upper left side projection of the rear part of the example given, wherein it is seen a wall portion with all the previously referred masonry constructive processes and with insulation boards (138) arranged on top of the slabs of the 1st and 2nd floors, in order to completely insulate the division. It is clear that any division of a building can be insulated with the present masonry system. In the stage shown in FIG. 9*k*, with all the outer wall constructed and all the surrounding interior conveniently insulated, the internal faces of the wall are ready to receive a plasterboard covering and the respective support structure or a covering of any type of boards usually used to coat a wall internally. The space left between the insulation layers of the masonry units and the internal coating panels of the wall, can be used to house water supply piping, sewer drainage pipes, electricity and telecommunications wires and cables, plumbing and heating ducts, ventilation and air conditioning (AVAC) and wires and cables or any other installations of the system.

FIG. 10, in turn, shows another characteristic of the present masonry system related to the possibility of allowing vertical reinforcements at any point in the wall, improving the general stability of the same. This may be achieved both in cases where the laying process of the masonry units is carried out with coincident vertical joints, as in the cases where the laying is carried out with vertical joints unaligned at half unit. To embody these vertical reinforcements, the cavities (21) of the primary masonry units (102) can accommodate steel beams for reinforcement (139), which can be surrounded by binding material (140), such as concrete poured on all the cavities that receive this reinforcement, such as can be seen in drawing i) and by the observation of the transverse sections A-A'—drawing ii) and A-A'-B-B'—drawing iii). By executing these reinforcement points, a matrix of "rigid vertical channels" is created, which improves the stability of the wall, helping it to resist generic horizontal forces, also increasing the capacity thereof of resisting vertical demands and improving the anti-seismic behavior of the wall in general.

Figure 11A:
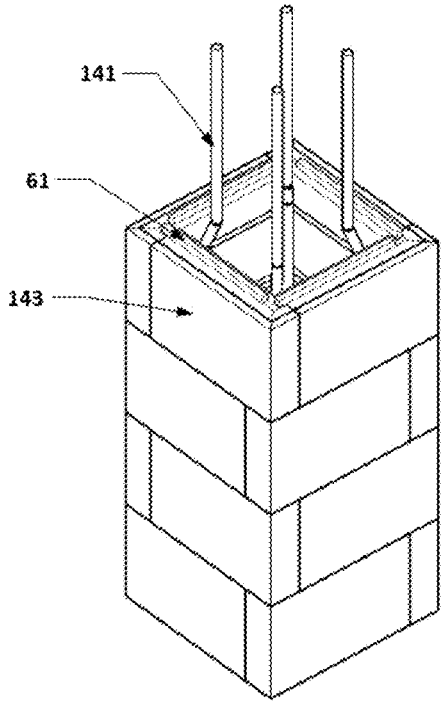
FIG. 11 illustrates another function which the present masonry system can assume, and which is of pre-casting structural elements to enable these elements to be concreted with concrete or with another type of binding material to form these same structural elements. However, for said function to be carried out, the masonry units used to pre-cast the structural elements must be conveniently anchored.
Figure 11B:
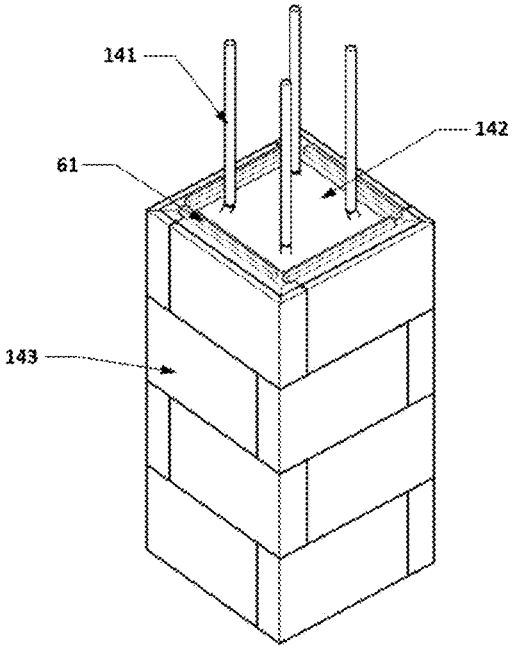
Figure 12A:
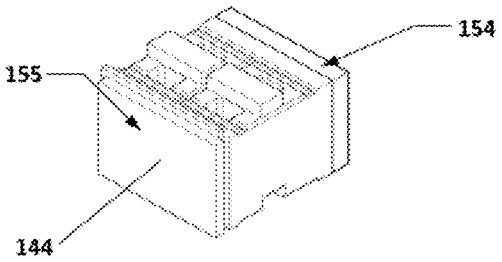
FIG. 12 illustrates several masonry units derived from the primary masonry units and the primary masonry half unit, which can be further produced to integrate the construction of sealing walls, inner walls and outer walls which do not need to meet thermal and acoustic requirements. These units correspond to the variation of the masonry system which foresees insulation from the inner side of the wall.
Figure 12B:
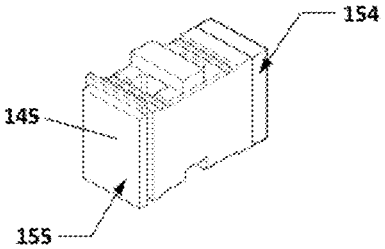
Figure 12C:
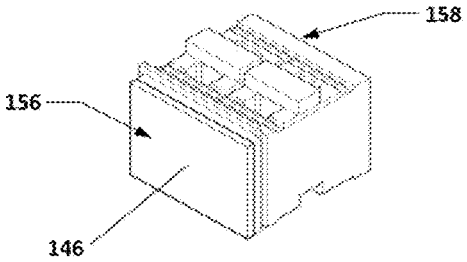
Figure 12D:
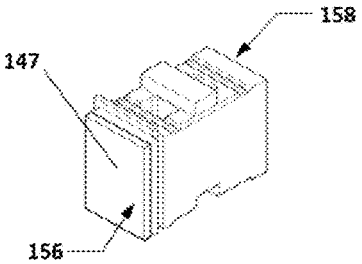
Figure 12E:
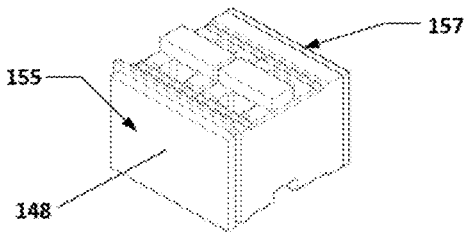
Figure 12F:
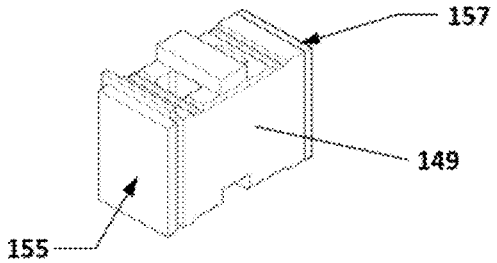
Figure 12G:
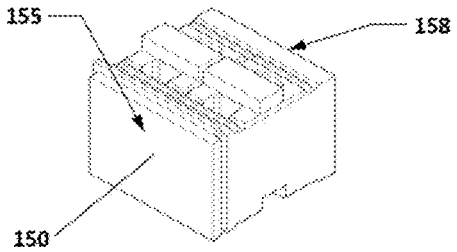
Figure 12H:
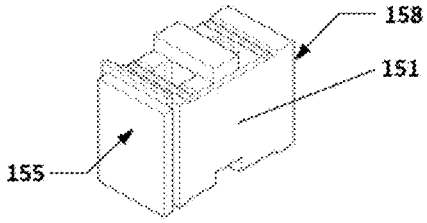
Figure 12I:
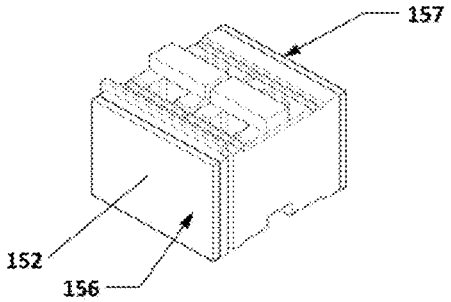
Figure 12J:
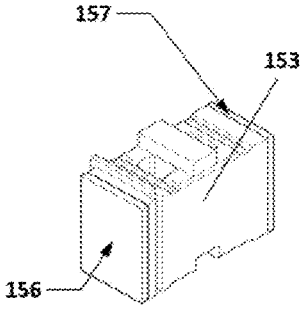

Analyzing FIG. 11, this shows another characteristic of the present masonry system which is its capacity of serving as formwork for a reinforced concrete structure. The example provided consists in a pillar which it is desired to fill with concrete. By laying successive embodiments of the alternative pillar covering units (143) which fit the channels thereof in ridges of other units (61), the formwork is assembled and, once the steel framing (141) is conveniently positioned, such as can be seen in situation i), the concrete or other binding material (142) can be poured, filling the space between the masonry units used to formwork the pillar. As soon as the concrete or other binding material hardens (is fixed), the already coated structural element is concluded, such as can be observed in drawing ii). It must be noted that, the masonry units used for the formwork of the reinforced concrete structural elements must be conveniently anchored with external elements, such as props and shoring. This characteristic of the masonry system is not restricted to the formwork of pillars, on the contrary, when selecting the correct masonry units, other structural elements, such as beams and structural walls can be assembled in formwork.

As regards FIG. 12, the same shows several derivations of the primary masonry unit (102) and of the primary masonry half unit (115). The drawings i) and ii) show a primary masonry unit (144) and a primary masonry half unit (145), which respectfully comprise only the insulation layer (154) in their rear faces. In this case, the front face presents itself "bare" (155) and is ready to be coated with any other coatings usually applied in masonry walls. The drawings iii) and iv) show a primary masonry unit (146) and a primary masonry half unit (147), respectively which have the front face thereof coated by a final finishing coat layer (156), while the rear face does not exhibit coating or insulation layers (158). Thus, the rear face of the masonry units is free to receive any internal coating solution or insulation solution that the client wishes.

The drawing v) shows a primary masonry unit (148) of which only the rear face is coated with a final finishing coat layer (157), while the front face thereof (155) is "bare", not presenting layers of coating or insulation. The same combination can be seen in drawing vi) which shows the corresponding primary masonry half unit (149). Both units have a final finishing coat layer in their inner side, while the outer side is free to be coated with any other material or solution normally used to coat masonry. These units can further accept an external insulation solution similar to the solutions used currently to insulate walls from the outside.

The drawings vii) and viii), in turn, disclose a primary masonry unit (150) and a primary masonry half unit (151) which have both the faces, front (155) and rear (158), "bare", not exhibiting final finishing coat or insulation layers. These masonry units can carry out exactly the same role as a common brick or cement block and, similar to what happens with these masonry units, can receive any coating on both outer and inner side, with the advantage of being capable of being laid by dry and wet process and in this manner form a wall. On the contrary, common bricks and cement blocks need to be laid by wet process, using mortar or any other binding material with similar function. In short, the masonry units (150 and 151) are the embodiments of the masonry system most close to the common bricks and cement blocks, since they do not present significant aesthetic, thermal or acoustic improvements in comparison with the common units and since they always require other construction steps to guarantee the final finishing coating and/or thermal and acoustic insulation.

The drawings ix) and x) disclose a primary masonry unit (152) and a primary masonry half unit (153) which exhibit the final finishing coat layer in their outer (156) and inner face (157). These units can constitute, for example, fence walls, inner walls and outer walls without thermal and acoustic requirements and guarantee, from the beginning, a solution that is already coated for the wall which they will be a part of.

Another variation of the masonry system presented refers to the possibility of constructing walls within the underlying ideas of the present system, but locating the insulation layer on the exterior of the masonry units, guaranteeing an outer surrounding layer of thermal and acoustic insulation for the constructed wall. The basis of this variation of the system is the primary masonry unit in its variation with insulation from the outside, illustrated in detail, in one of the embodiments thereof, in FIGS. 13*a* and 13*b*. This variation of the primary masonry unit has in its front face, which can be seen in front projection (159) and in the perspective view (185) of the same unit, which is coated with a final finishing coating layer with low thickness (173), which enables a pleasant outer aspect to the wall which the unit integrates. Underlying the final finishing layer (173) of the masonry unit, there is found an insulation layer (168). This layer aims at granting high thermal and acoustic behavior standards to the wall which the masonry unit integrates, by means of the creation of an insulation surround on the external side of same, achieved with the junction of several insulation layers provided by the remaining masonry units which constitute the wall. The overlapping of these several units creates a continuous insulation surround which "seals" the wall from the outer side thereof. Similarly to that happens with the variation of the primary masonry unit with insulation in the inner face, the thickness of the insulation layer can vary in accordance with the desired requirements for the effect of thermal and acoustic insulation. The length and the height of the insulation layer, in turn, can be equal to the respective dimensions of the body of the primary masonry unit, but they can also be foreseen in slightly larger dimensions to compensate the dimensions of the joints, in case the laying of the masonry units occurs by wet process. Comparatively with the variation of the primary masonry unit seen in FIGS. 1*a* and 1*b*, which present the insulation layer in its rear face, in this variation, the rear face, which can be seen in the rear projection (161) and also by means of the perspective view (189) of the same unit, is released. Since there is no internal insulation layer, there are no impediments either for the pipes and cables relative to the several specialties comprised in a construction service which can be housed inside this variation of the masonry units. Thus, the rear face of the unit is released not only so that furrows may be opened to install diverse piping and cabling, as well as to enable the coating of the inner face of the wall with current solutions such as traditional plaster, ceramic coating, among others, slightly similar to what happens with traditional blocks and bricks. In order to facilitate the passage of pipes and cables inside the constructed wall, this variation of the primary masonry unit presents two supplementary vertical cavities, here described as rear cavities (181). These cavities assume dimensions such that enable accommodating piping and cabling and, given the position of symmetry with which they occur in the masonry units, further allows the passage thereof between units, without obstacles, providing the laying of these units occurs with aligned vertical joint or with unaligned vertical joint at half unit. In case the rear cavities (181) allow the passage of pipes and cables vertically between masonry units, there further exist small "windows" of inter-unit communication (183) which enable that this passage is carried out also horizontally. These communication windows can assume several forms and sizes and even occur in greater number than that illustrated in this document, as for example, in the illustrations of FIGS. 1*a* and 1*b* where the windows assume circular shape and occur only at one level, intersecting the side walls of the masonry unit, as well as the intermediary septum between cavities (184). In this manner the need to open furrows whenever the construction is well planned is minimized and whenever the architecture projects and those of the several specialties embraced by construction (civil, electro-technical, etc.) are duly compatibilized.

The remaining characteristics of this embodiment of the primary masonry unit are overall similar to those described for the variation with insulation layer on the rear face, illustrated by FIGS. 1*a* and 1*b*. Such as this one, the variation of the primary masonry unit with insulation from the outside, has a tongue and groove fitting system, embodied in part by a larger central channel (175) arranged along the lower face thereof (can be seen in the lower projection of the unit—163 and also by the perspective view of the same unit—188) and a larger central ridge (170) which stands out on the top face of the primary unit, which can be seen in the top projection (162) and in the perspective view (187) of the same unit. Secondary ridges in lateral position close to the outer face of the unit, which develop upwards and sideways (172) and secondary channels developed down and sideways (174) in the same plane as the secondary ridges grant the capacity of additional locking, allowing the fitting between primary units by the left (160, 186) and right (158) side faces. In this manner units are blocked along the vertical joints and the "sealing" of the joints between units is guaranteed, which, combined with the existence of a low pending slope on the top and bottom edges of the portion comprised between the outer face of the unit and the plane of the secondary ridges and channels reduces the water and air permeability of all the wall, as can be verified in FIG. 1*c*, which is also valid for this embodiment of the primary masonry unit. Such as happens with the variation of the system which guarantees insulation from the inner face of the wall, the secondary ridges and channels are extremely important, since it is also through these that it is possible to connect with the secondary units developed for the variation of the masonry system which guarantees the insulation of the wall, as can be verified in FIG. 3.

It is pointed out that both the larger central ridge (170), as the secondary ridges (172) have slightly smaller dimensions than the dimensions of the larger central channel (175) and of the corresponding secondary channels (174) for reasons already explained when of the description of the variation of the primary masonry unit with insulation on the rear face. It is added that the functions they perform are overall analogous to those performed by the corresponding elements of the other variation, allowing the correct alignment of the masonry units, incrementing the resistance of the wall to horizontal actions, allowing the laying of the units by dry and wet process, and enabling the minimization of the mortar or other similar bonding material used in the joints, in case it is opted for the laying by wet process.

Also, the possibility of incorporating units to the reinforcement bars, such as those illustrated in FIGS. 6*a* and 6*b*, is maintained. For this, this variation of the primary masonry unit maintains the two pairs of longitudinal semicircular channels on the upper (169) and lower (177) faces which, in turn, interconnect with two quarter circle transverse channels existing on the side edges (171 on the top part and 176 on the bottom part) and with a semicircular channel present in the center (178 on the upper part and 182 on the lower part). With this set of channels, the masonry units can accommodate the referred reinforcement bar units, as illustrated in FIGS. 6*a* and 6*b*, which allow connecting the masonry units in each horizontal joint.

The four vertical cavities (179) were maintained, being equally responsible for decreasing the weight itself of the unit and for improving the acoustic and thermal behavior thereof. As seen for the variation of the primary masonry unit of FIGS. 1*a* and 1*b*, whenever the masonry units are laid with aligned or unaligned at half-length vertical joints, this variation further allows the filling of the vertical cavities with insulation material or with binding material to soak steel beams placed vertically along the development of the prism formed by the overlapping of the vertical cavities of several successive masonry units, so as to create a matrix of rigid channels. The transverse sections of this variation of the primary masonry unit A-A' (164), B-B' (165), C-C' (166) and D-D' (167) clarify the arrangement of cavities and of the main and secondary channels and ridges inside the primary masonry unit. Focusing on the cuts A-A' (164) and D-D' (167) it is further possible to see with greater detail two of the great differences that this variation of the primary masonry unit exhibits comparatively to the primary unit which presents the insulation layer on the rear face: the rear cavities (181) and the communication "windows" inter-units (183), which intersect the side walls of the masonry unit and the septum (184) which divides the rear cavities (181).

Regarding the dimensions of this variation of the primary masonry unit, they are, roughly, maintained in face of those presented for the variation of the unit which presents insulation on the rear face, even though, due to the rear cavities, a preferred width is adopted for the body of the unit of 35 cm, not counting with the dimensions of the ridges and of the insulation and final finishing coating layers. The length and height dimensions are preferably maintained at 30 cm and 20 cm respectively (not counting with insulation and final finishing coating layers). The primary masonry unit was designed to be as flexible as possible. This design led to front dimensions of approximately 30 cm length and 20 cm height. The referred dimensions, together with the provision of a primary masonry half unit of 15 cm length, as illustrated in FIG. 17*b*—vii) allow overcoming any multiple gaps of 15 cm between two pillars, which enables constructing a wall for many of the existing structures with minimal adaptations, providing even more flexibility for the gaps chosen in a project where the masonry solution now described is considered. Considering that the preferred width of this embodiment of the primary masonry unit is preferably foreseen with around 35 cm, this embodiment of the primary unit allows contouring totally a reinforced concrete structural element with 30 cm height, further allowing, simultaneously, that a secondary unit with 5 cm width, for example, a structural element covering, fit in the primary unit and cover the structural element at the same time. To contour pillars or structural elements with width lower than 30 cm, it may be necessary to resort to beveled masonry units, such as for example can be verified in units 239, 240, 241 and 242 illustrated in FIG. 17*b* or the filling boards (261) illustrated in FIG. 19*i*).

As regards the constitution of the variation with external insulation of the primary masonry unit and of the corresponding secondary units, the preferred constituent materials adopted for the core, insulation layer and final finishing coat layer are maintained, although other materials can be adopted, namely any material commonly found in masonry parts and current insulations in the construction sector.

Figure 13A:
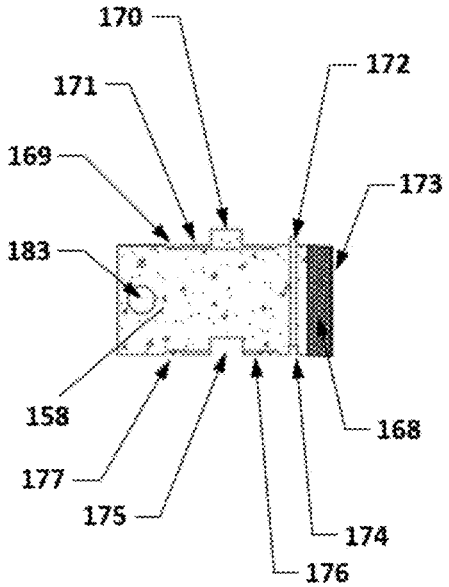
FIG. 13*a* illustrates another variation of the primary masonry unit, having insulation from outside, represented by means of its 2D projections and by cuts in the longitudinal and transverse sections.
Figure 13B:
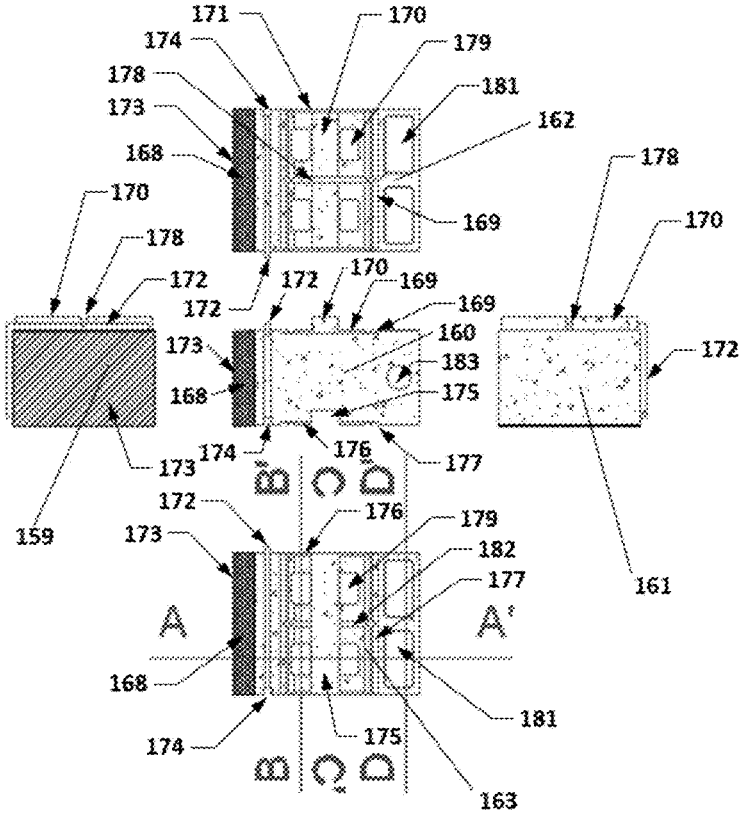
FIG. 13*b* illustrates a top perspective view (left side) and a bottom perspective view (right side) of one of the variations of the primary masonry system, with insulation on the inner side, wherein the cavities, ridges and channels, insulation and final finishing coat layers can be seen.
Figure 13C:
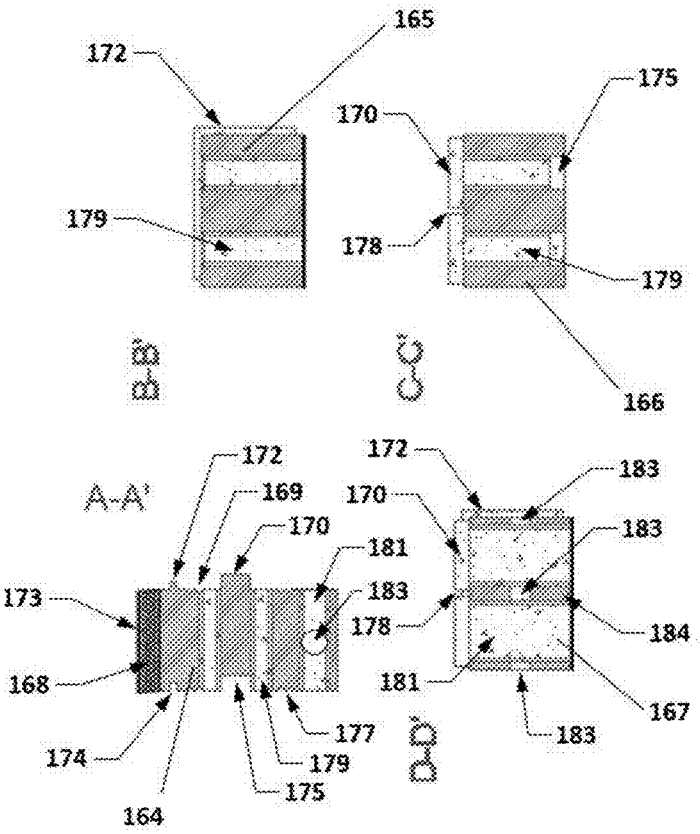
Figure 13D:
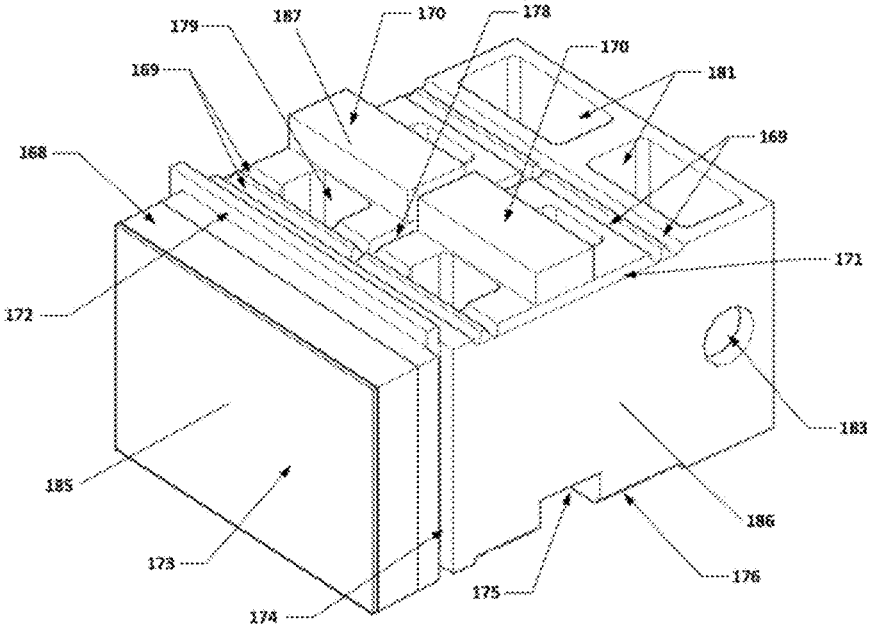
Figure 13E:
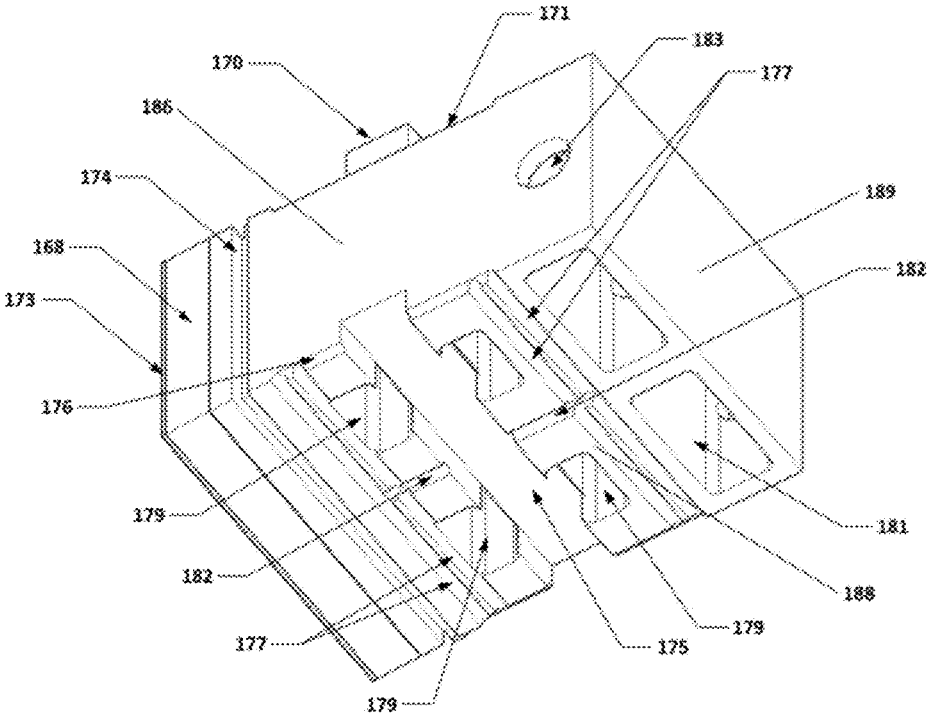
Figure 14A:
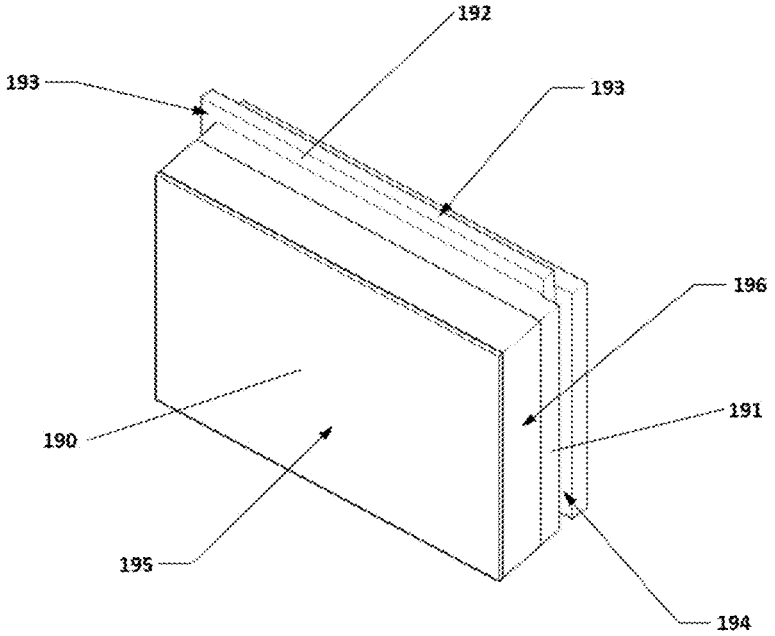
FIG. 14 illustrates, in i) a secondary masonry unit in top perspective, which is a covering unit for beams suitable to the variation of the masonry system with insulation guaranteed from the outside. This unit, which is primarily conceived to contour beams and slab edges, can also be used to contour other structural elements in combined use with other types of secondary masonry units. The same
Figure 14B:
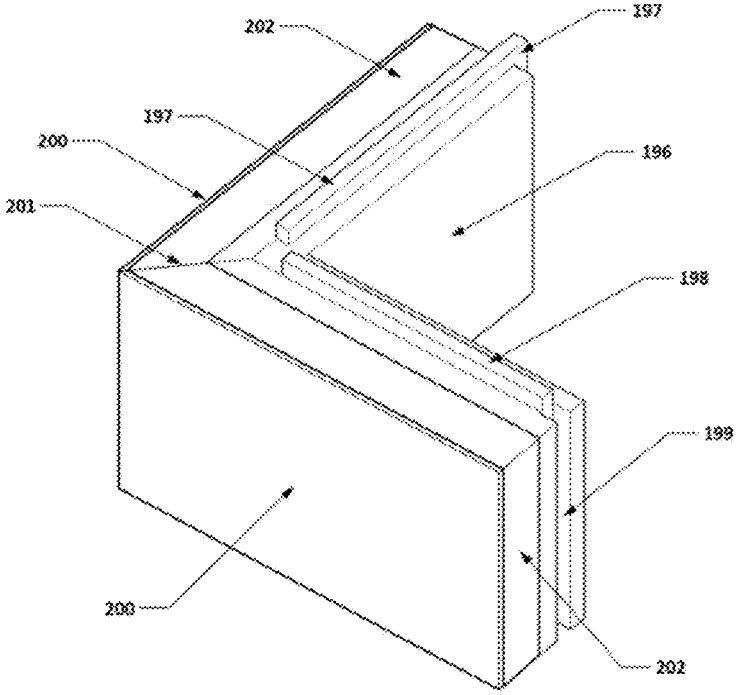

Focusing the analysis now on FIG. 14, this shows two different types of secondary masonry units adapted to the need of the variation of the masonry system which guarantees insulation from the outside: the unit illustrated in i) which is a beam covering unit, analogous to the unit of another variation of the masonry system shown in FIGS. 2*a* and 2*b*; and the unit illustrated in ii), which is an "L" shaped pillar covering unit, also analogous to the unit of the variation of the masonry system with insulation from the inside represented in FIGS. 3*a* and 3*b*. Both the unit i) as unit ii) are designed to assume the same functions as the corresponding units of another variation of the system, maintaining the same range of dimensions, with the necessary adaptations, and adopting the same materials for the core and coating layer. The great difference, however, is that, due to the fact that this variation of the system foresees insulation from the outside, these parts must further accommodate a thermal and acoustic insulation layer, from the external side, so as to guarantee the continuity of the insulation surround created by the primary masonry units, illustrated in FIGS. 13*a* and 13*b*, the material of this insulation layer being the same present as insulation of the primary units. Turning to a more detailed description of the secondary masonry unit i) present in FIG. 14, which shows the unit in perspective, it being possible to see the front (190), left (191), and top (192) faces, this is characterized by a body from which small ridges project developed along the top and left faces (193) and where the small channels integrate, which develop on the right side and on the bottom face (194). These channels and ridges allow the fitting with the remaining primary and secondary units of this variant of the masonry system, apart from enabling the "sealing" of the joints between them. In the illustration of this unit there are further visible the final finishing coat layers (195) and of thermal and acoustic insulation (196).

The secondary masonry unit ii) present in FIG. 14 is illustrated in perspective, being visible the final finishing coat layers (200) thereof and the insulation (202), which cover the outer faces and develop in "L", such as in the body of the part, where it is possible to identify a ridge arranged along the upper and right tops of the right side face thereof (197), a channel arranged along the lower part of the right side face of the unit, which is not visible in the figure, a ridge arranged along the upper part of the front face of the unit (198) and a channel arranged both in the bottom part as in the top left side of the right side face (199). These ridges and channels allow the "L" shaped pillar covering unit to fit in the channels present in other primary and secondary masonry units, while the channels fit in the projections of these same units. In this part, the pending low slope between the ridges and channels and the upper and lower front edges in each face of the "L", is maintained and allows the continuity of the inclined plane presented in other units, assuming the functions of sealing of the joints between units and guaranteeing the drainage of any excess water which can infiltrate in the joints. In the intersection of the two upper inclined planes and the two lower inclined planes, an edge is formed both on the upper part (201) as in the lower part of the unit. The internal faces (196), in turn, do not exhibit any coat, having the function of abut the element which it is intended to conceal.

Figure 15A:
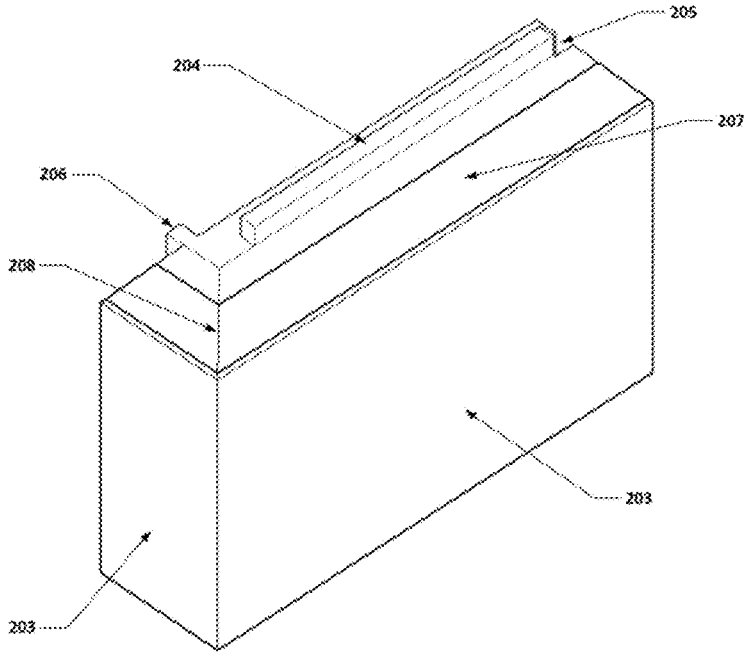
FIG. 15 illustrates, in i) and ii), top perspectives of two possible embodiments of an alternative unit for pillar covering suitable to the variation of the masonry system with insulation guaranteed from the outside, where the ridges and channels thereof can be observed. These units can, in combination with beam covering units, represent an alternative to the "L" shaped pillar covering unit.
Figure 15B:
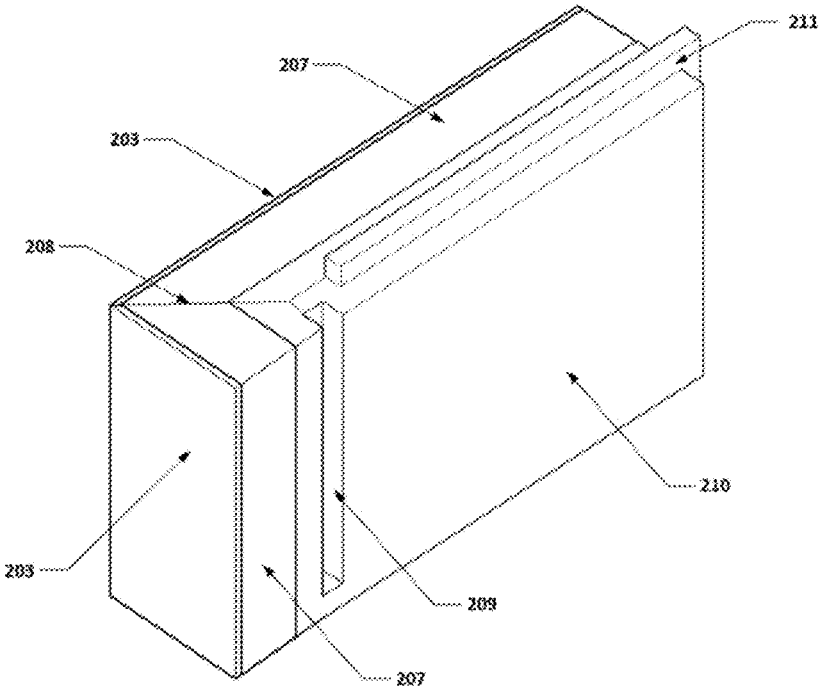

Referring to FIG. 15, this shows two possible embodiments for a secondary masonry unit, which are a variation of the alternative pillar covering units present in FIGS. 4*a*) and 4*b*), this time adapted to be used in the variation of the system which foresees thermal insulation from the outside. These parts present the same characteristics and functions of the correspondents relative to the variation of the masonry system with insulation from the inside, being also carried out in the same materials and must be used in combination with units of the type present in FIG. 14—i), so as to allow the contour of the corners and pillars. Thus, focusing on FIG. 15, the two embodiments illustrated of this unit of alternative pillar covering are represented in perspective, being perceptible the final finishing coat layer (203) and the insulation layer (207). In the body of these units, which rear face (210) and on the opposite side face do not present final finishing coating, there stand out, in embodiment represented in FIG. 15—i), an upper ridge along the top face (204), a channel developed along the lower and left side face of the unit (205) and a vertical ridge which stands out on the rear face of the unit (206). For the embodiment illustrated in FIG. 15—ii), there is a visible ridge which develops along the upper and right lateral faces of the unit (211), a channel which develops through the lower face of the unit, not visible in the illustration, and a channel embedded on the rear face of the unit (209) with shape and dimensions such that enables the fitting of a ridge of the same or other types of secondary masonry units. The small slope present from the ridges and channels to the upper and lower edges of the front face produces, due to the intersection of the planes which this slope forms, a small edge visible both on the top (208) of the unit as on the lower face.

Figure 16A:
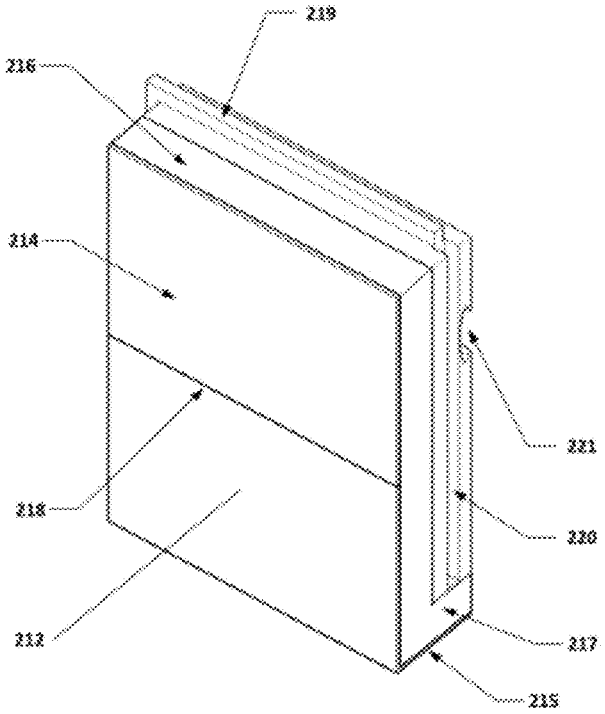
FIG. 16 illustrates a pair of masonry units suitable to the variation of the masonry system with insulation guaranteed from the outside. This pair of units consists in a modified primary masonry unit which presents an elliptical prismatic protuberance ready to fit into a depression which is a negative in identical form, but inverse, which is longitudinally placed along the inner face of another masonry unit. This other masonry unit is a special covering unit which has the function of covering the masonry unit in which it fits and the structural element or the singularity which is presented below the masonry unit in which it fits.
Figure 16B:
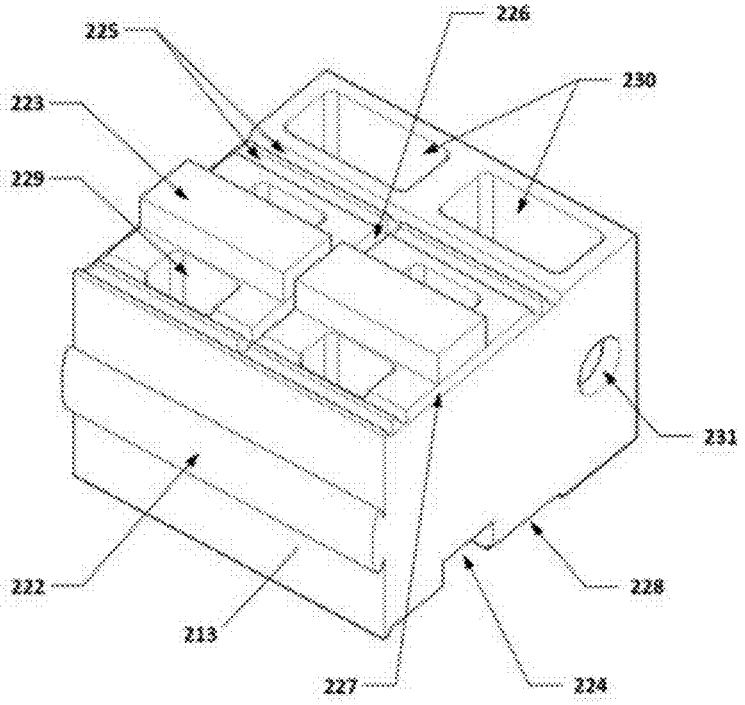
Figure 16C:
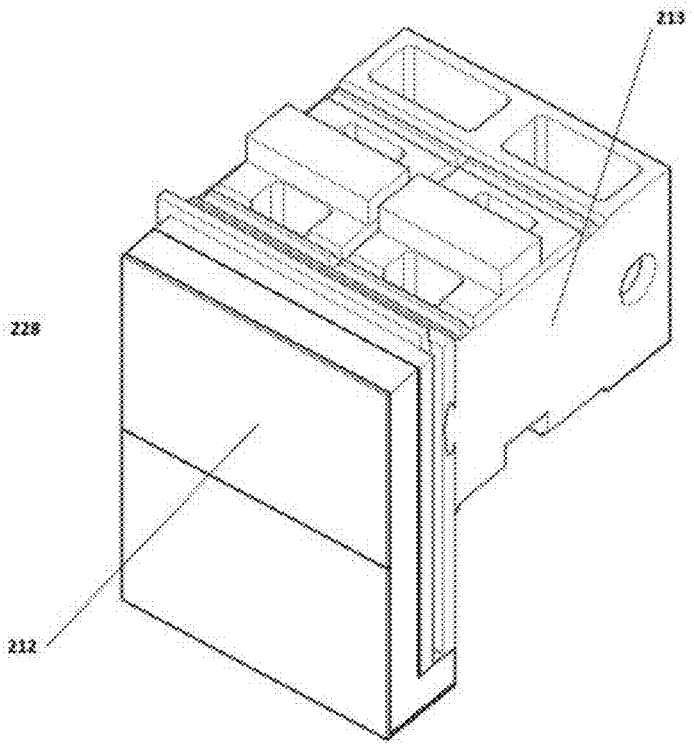

As regards FIG. 16, this illustrates the combination of the two masonry units created to integrate the variation of the system with insulation from the outside and which correspond, in functions, materials and range of dimensions, to the masonry units illustrated in FIGS. 5*a* and 5*b* which integrate the system with insulation from inside. As such, there is illustrated a modified primary masonry unit (213), capable of receiving a special covering unit (212), which main function is to cover not only the modified primary unit, but also singularities which can occur below the primary unit, such as beams, slab edges, or lintels over door and windows.

The modified primary masonry unit (213), derives from the primary masonry unit, FIGS. 13*a* and 13*b*, and includes: the main central ridge on the upper face (223) and the main central channel on the lower face (224); the set comprised by the intermediary transverse upper semicircular channel (226), by the two upper transverse quarter circle channels on the side faces (227) and by the two pairs of upper longitudinal semicircular channels present on the top (225); a similar set of pairs of longitudinal semicircular channels, of transverse semicircular channels and of quarter circle channels present on the lower face, of which a quarter circle side channel can be seen (228) and a larger main channel arranged halfway the lower face (224). The modified primary masonry unit further comprises four cavities (229), similar to what happens in the original primary masonry unit. In this unit, contrary to the corresponding variation of the system with insulation from the inside, as illustrated in FIGS. 5*a* and 5*b*, the rear face does not have any insulation layer. Instead, similarly to what occurs with the primary masonry unit in its variation with insulation from the outside, this face is used to guarantee negatives which can be used for the passing of piping and cabling of the several specialties of Construction. As such, in its rear face, the unit (213) has two vertical development cavities, in this document denominated rear cavities (230), as well as inter-units communication windows (231) which allow the horizontal passage of cables and pipes. In order to receive a special covering unit (212), the modified primary masonry unit (213) has an elliptical prismatic protuberance (222), in reverse form as that of the channel (221) present in the special covering unit which it is destined to receive. Since this pair of special units respects the variation of the masonry system which foresees insulation from the outside, the insulation layer (216) was displaced from the rear face of the primary unit (213) to the outer face of the special covering unit (212). This special covering unit (212) is characterized by presenting, apart from the elliptical shaped channel (221), a final finishing coat layer (214) which contours the bottom portion of the covering (215) and covers the portion of the insulation layer which insulates this lower part (217) and by having a lateral channel along all its left face (220) and a ridge which develops along the upper and right lateral faces (219). These ridges and channels present the same transverse section as the ridges and channels of the other masonry units. As in the corresponding part of the variation of the system with insulation from the internal face, a false joint (218) is foreseen on the external face of the covering unit, for purely aesthetic reasons. This unit maintains the small slope planes developed from the upper ridge and the lower channel to the upper and lower edges of the front face, respectively. The two masonry units (212 and 213) complement each other and are present in the same materials and with the same range of dimensions, with the due alterations due to the presence of the rear cavities in the unit (213) and in the insulation layer integrated on the outer face of the unit (212), as the analogous units of the variation of the system with insulation from the inside, as illustrated in FIGS. 5*a* and 5*b*.

Figure 17A:
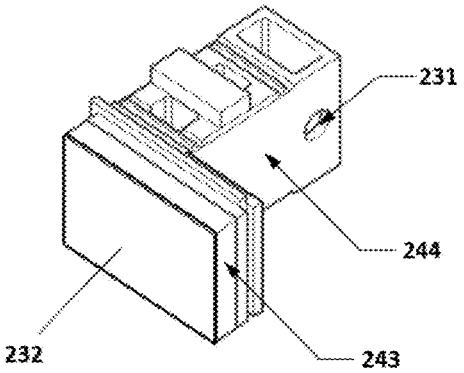
FIG. 17*a* illustrates six masonry units based on the variation of the primary masonry unit with insulation layer from outside and which enable overcoming some singularities which can occur when a masonry wall is constructed.
Figure 17B:
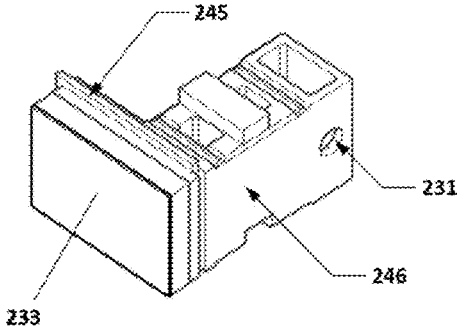
FIG. 17*b* illustrates five more masonry units based on the variation of the primary masonry unit with insulation layer from the outside and which allow overcoming some singularities which can occur when a masonry wall is constructed.
Figure 17C:
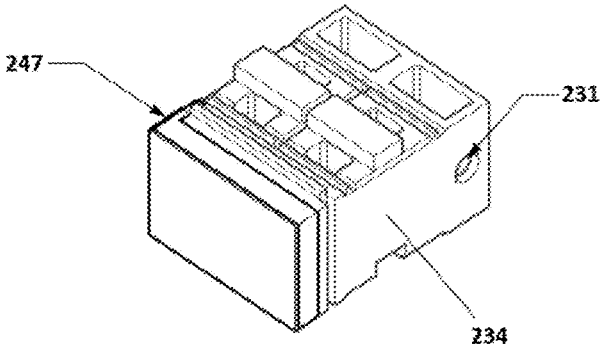
Figure 17D:
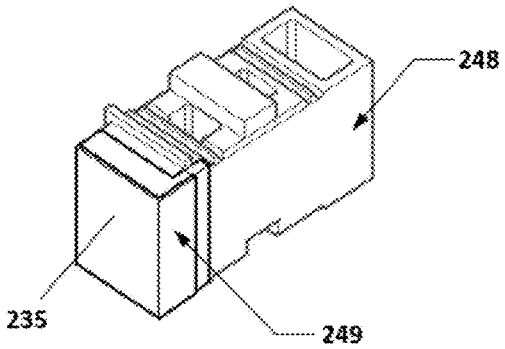
Figure 17E:
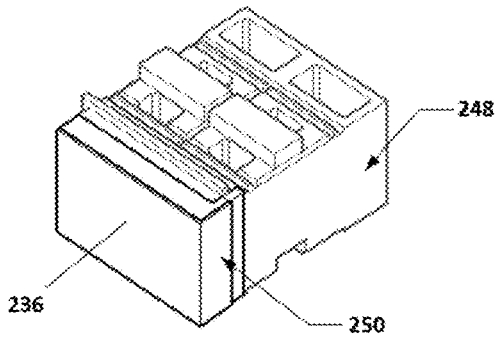
Figure 17F:
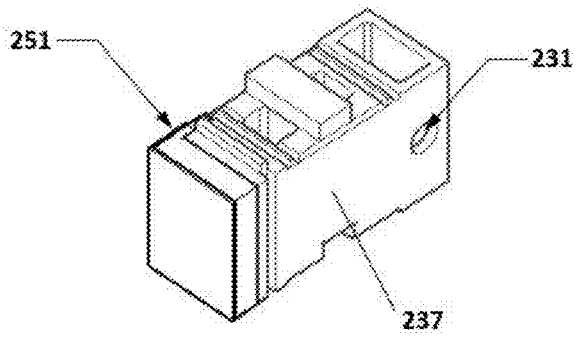
Figure 17G:
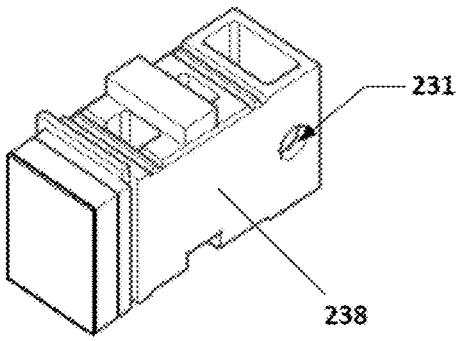
Figure 17H:
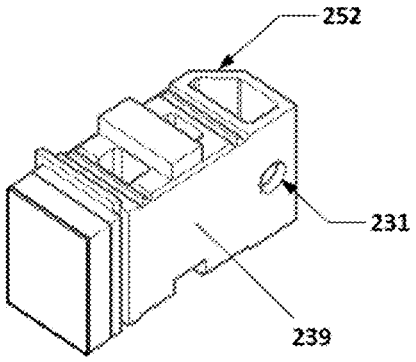
Figure 17I:
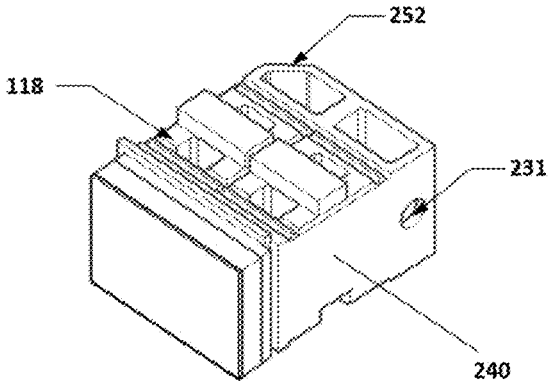
Figure 17J:
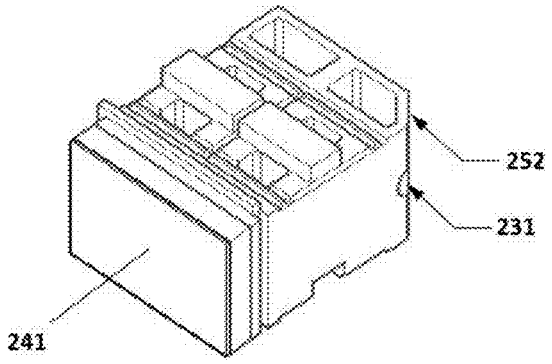
Figure 17K:
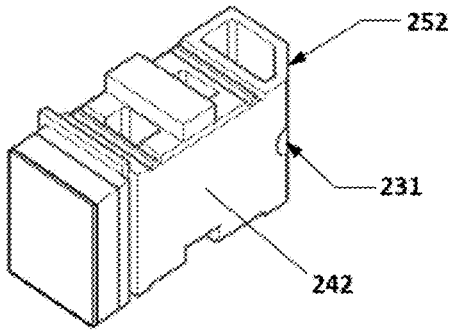

Centering the analysis now on FIG. 17*a*, this shows some of the other embodiments suitable to integrate the variation of the system with insulation from the outside. All these embodiments are derived from the primary masonry unit (253) and were designed to overcome some singularities which occur, sometimes, when a wall is constructed. In this manner, in i) there is illustrated a special masonry unit which is a primary masonry half unit with an extension of its covering portion to the left (232). The extended covering portion (243) detaches from the main body (244) and enables this unit to partially cover a singularity, such as a structural pillar which occurs in the development plan of a masonry wall. To cover the other side of the column, and "embrace" it, an additional unit (233) with its covering portion (245) detached from the core (246) and extended to the other side (right side) is also foreseen. This unit can be observed in drawing ii). Both masonry units, 110 and 111, maintain the horizontal inter-unit windows (231) and exhibit the same length, height, and width dimensions as the primary masonry unit (253), even if their main bodies (244 and 246) have only half the length dimension. To overcome singularities such as windows and doors or any other opening which can exist in a wall, the variation of the masonry system with coating from the outside foresees some units that have a mortise in the final finishing coat layer, providing the cover of the outer borders of the opening with the same material and the same aspect as the outer face of the remaining masonry units. The masonry units, such as the primary masonry units for borders of gaps (234; 236) and primary masonry half units for borders of gaps (235; 237) assume this function. Thus, in FIG. 17*a* there is illustrated a primary masonry unit for borders of gaps (234) with the mortise of the final finishing coating layer (247) on the left side—drawing iii); in drawing iv) there is represented a primary masonry half unit for borders of gaps (235) with the mortise of the final finishing coating layer (249) on the right side; in drawing v) there is visible a primary masonry unit for borders of gaps (236) with the mortise of the final finishing coating layer (250) on the right side; and, in drawing vi) there is represented a primary masonry half unit for borders of gaps (237) with the mortise of the final finishing coating layer (251) on the right side thereof. Regarding these units designed to guarantee coating on the borders of openings, it must be noted that the inter-unit window (231) occurs only on the side opposite the border of the opening, whereby on the side of the border, this window does not exist (248), which allows having an easily coated surface on the inner side of the borders of the openings.

FIG. 17*b* complements FIG. 17*a* and illustrates other embodiments of the masonry system. In the illustration of the drawing vii), there is presented a primary masonry half unit (238). Similarly to the primary masonry half unit relative to the variation of the system with internal insulation, this unit is nothing more than a derivation of the primary masonry unit which has half the length thereof, maintaining the remaining characteristics, even though it does not comprise the central semicircular channel and counts on only two cavities and a rear cavity, instead of four cavities and two rear cavities present in a primary masonry unit (253). The drawings viii), ix), x) and xi) illustrate a primary masonry corner half unit compatible with pillars with section 25×25 cm, with bevel to the left (239); a primary masonry corner unit compatible with pillars of section 25×25 cm, with bevel to the left (240); a primary masonry corner unit compatible with pillars of section 25×25 cm with bevel to the right (241); and a primary masonry corner half unit compatible with pillars of section 25×25 cm, with bevel to the right (242). All these units allow leaning on a pillar with section 25×25 cm, enabling the continuation of the masonry in orthogonal direction, without the need of adaptations of the masonry units in construction. The materials, dimensions and overall characteristics of the primary masonry units and primary masonry half units are maintained by the derivations of the referred masonry units. Any one of the units indicated in i), ii), iii), iv), v), vi), vii), viii), ix), x) and xi) is comprised by the same materials as the remaining units, presenting the same final finishing coat and insulation layers. Additionally, they all maintain the same characteristics of the primary masonry units, such as their cavities, ridges, and channels, conveniently adapted to the requirements of each one of these units. However, it must be remarked that only some of the masonry units that this variation of the system with insulation from the outside comprises are disclosed herein. The system comprises other embodiments which are not disclosed in the referred drawings nor discussed herein.

Figure 18:
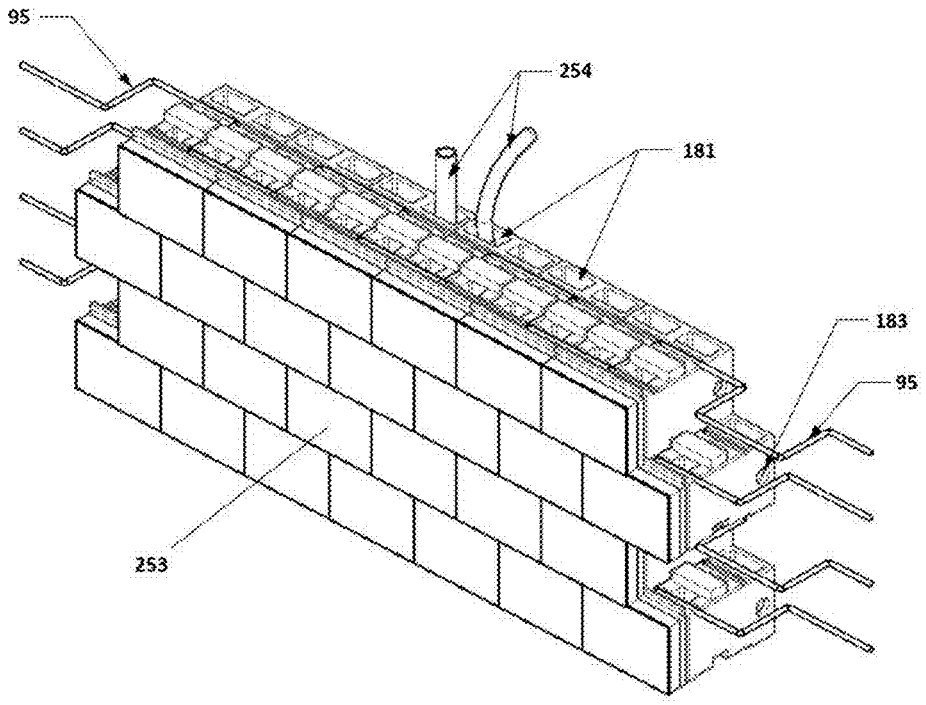
FIG. 18 illustrates a portion of the wall constructed with primary masonry units of the variation of the system which guarantees insulation from outside, it being possible to accommodate these masonry units and further integrate piping and cabling for several installations in the constructed wall.

FIG. 18, in its turn, refers to a segment of a wall constructed with primary masonry units with insulation layer from the outside (253) and with "reverse C-C" reinforcement bar units (95). In this example of wall, the masonry units are laid with unaligned joint at half unit, and, given the symmetry with which the several cavities occur, particularly the rear cavities that these units comprise (181), it becomes possible to create vertical "channels" which can accommodate diverse cabling and piping (254), allowing the installation of diverse types of specialties, such as for example, electricity, ITED cabling and piping for AVAC condensates, sewer drainage pipes or piping for water supply, even with the diameter thereof conditioned to the maximum dimension of the width of the cavity. To enable the horizontal communication between masonry units (and the passing of horizontal cabling and piping), the inter-unit windows (183) are also perfectly aligned. This extra function that the variation with insulation from the exterior offers, enables, while also minimizing, the necessary quantity of furrows to guarantee these specialties. Furthermore, the presence of the communication channels between units, vertical and horizontal, exempts the inner side of the formed wall, of the obligation of a coating system with air box between the rear face of the wall and the plane of the coating elements.

Focusing the analysis on FIG. 19, this shows an example of how the present masonry system, in its variation of insulation from outside, can be constructed around a reinforced concrete structure. The structure used in the present example is the same used to exemplify the functionalities of the variation of the masonry system with insulation from the inside, which can be seen in FIG. 9*a*), placing the same challenges to this variation of the system, this time with insulation from the outside.

The example once again takes into account that the laying of the units must be dry processed. Similarly to the example given for the variation of the system with insulation from the inside, to begin the construction of a wall, the first row of primary masonry units is also laid over a layer of mortar or other binding material (130). The sequence of construction of the wall, functions of the units and fitting ways are similar to that verified for the variation of the system with insulation from the inner side.

Figure 19A:
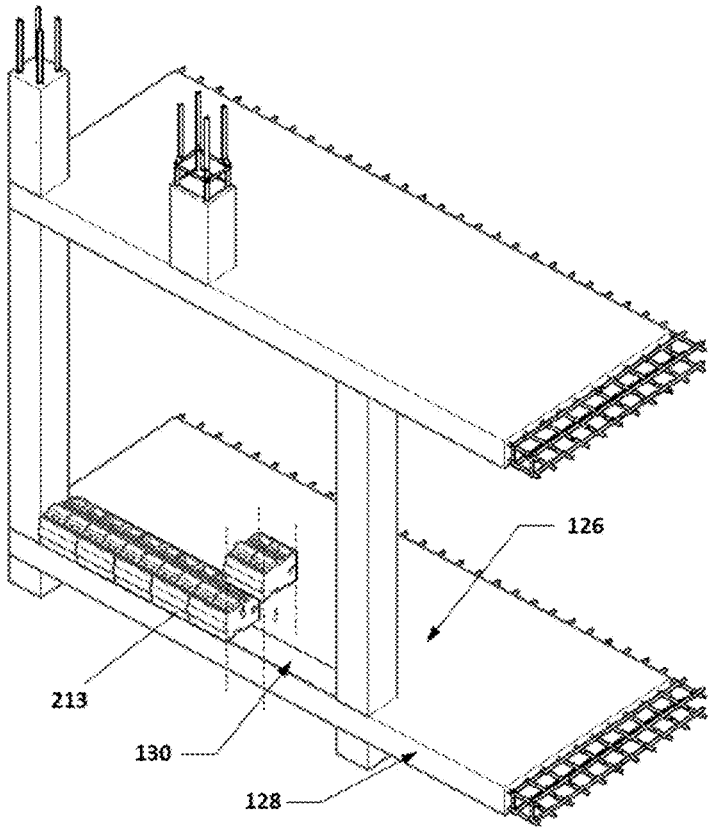
FIG. 19*a* illustrates the laying of a first row of masonry units with insulation layer from the outside in the same example illustrated in FIG. 9*a*.

Observing FIG. 19*a*, it is possible to see, in situation i), some modified primary masonry units (213) to be laid to form the first row of the front wall. Such as exemplified for the variation of the system with insulation from the inside, the option for this type of unit is related to the elliptical prismatic protuberance thereof (222) which allows receiving a special covering unit (212) capable of covering both the modified primary unit (213) as the border of the reinforced concrete slab (128). The situation ii) shows, in more detail, the way to lay a modified masonry unit, similar overall to that seen in FIG. 9*b*—ii).

Figure 19B:
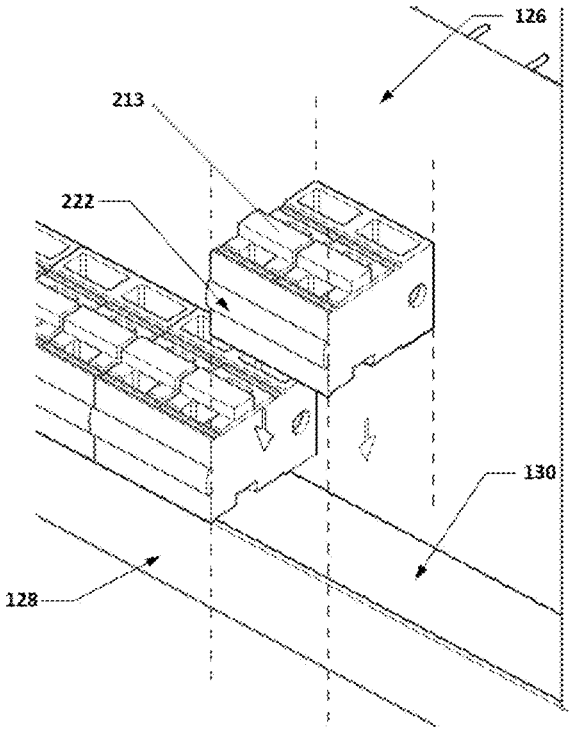
FIG. 19*b* illustrates the process of fitting a special covering unit from outside in a modified primary masonry unit as well as the introduction of a unit of reinforcement bars.

Analyzing now FIG. 19*b*, this shows, in situation i), the covering of the modified primary masonry units (213) with special covering units (212). These special covering units (212) allow covering and concealing not only the front face of the modified masonry unit (213), but also the slab edge of the 1st Floor (128). Illustrations ii) and iii) show in more detail the manner in which the process of fitting of these units is carried out, further illustrating the introduction of the ladder-shaped reinforcement units (96) which fit in the set of semicylindrical longitudinal channels and semicylindrical transverse channels and quarter circle embedded on the top of the masonry units, as soon as this reinforcement unit is vertically aligned with these same channels.

Figure 19C:
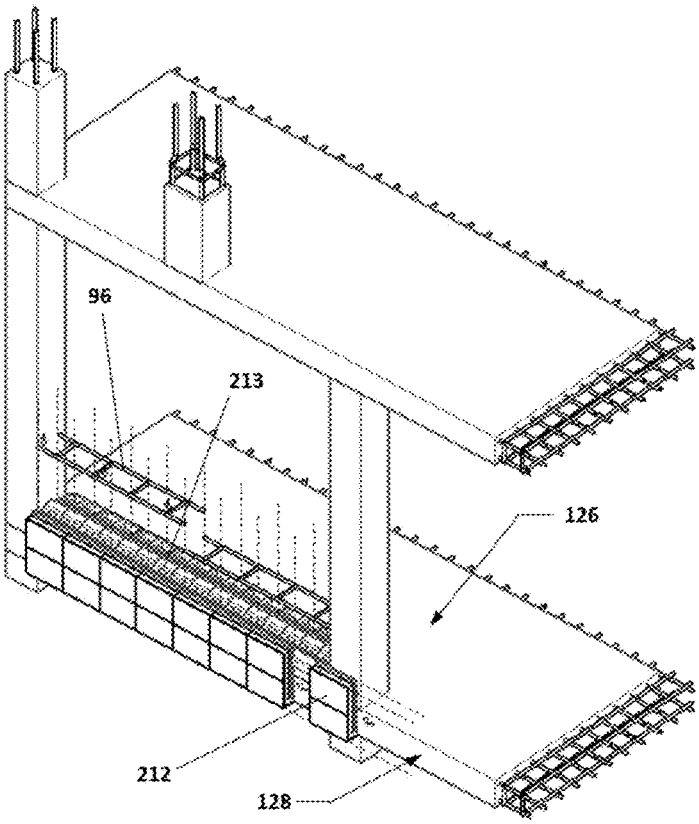
FIG. 19*c* illustrates another stage of the construction of a wall with insulation from outside, to which corresponds the fitting of secondary coat units to coat and "conceal" a pillar.

FIG. 19*c*, in turn, shows another step of the construction of the exemplary wall. Herein represented by drawings i) and ii) is the way to cover reinforced concrete pillars represented herein by pillars (123 and 125). In the covering of these pillars "L" shaped pillar covering units are used (256), as well as a combination of a beam covering unit of 25 cm (255) with one of the alternative embodiments of the pillar covering unit (256). Drawing ii) shows in more detail, the fitting process of said units. Once again, due to the reduced thickness thereof, the units destined to pillar coverings must use adhesive cement or other binding material to paste them to the column, regardless of the laying of the remaining units being carried out by dry process or wet process. The pasting, one part yes, one part no, can be a solution to avoid excessive use of adhesive cement or other similar agglutinating material.

Figure 19D:
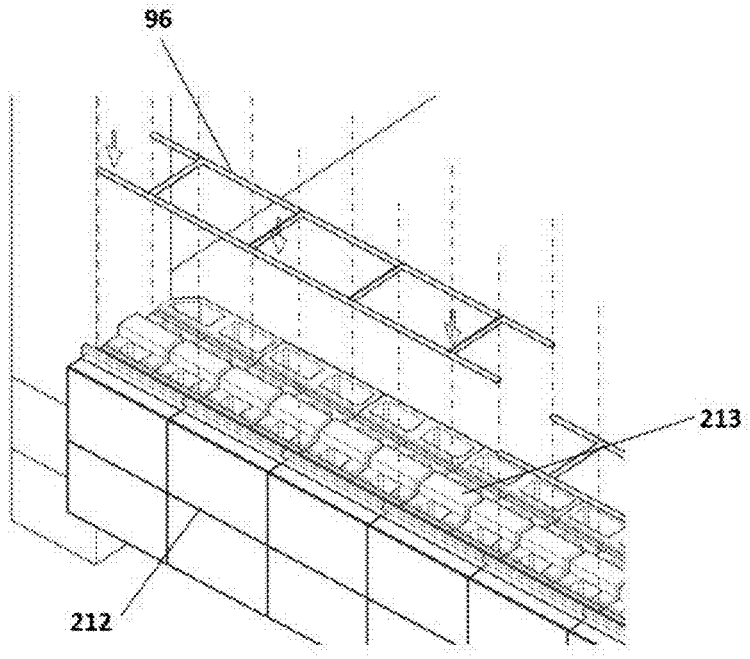
FIG. 19*d* illustrates the beginning of a process for overcoming a difficulty which is related to a singularity which is the existence of a window, with the units being developed for the variation of the masonry system with insulation from outside.

As regards FIG. 19*d*, this illustrates the initial steps of a process for overcoming the existence of a window. As can be seen in situation i), the lower borders of the window are formed by primary masonry units (253), which main projections were removed, which can be done in construction using mechanical means. The lateral borders of the window, in turn, are embodied by units derived from the primary masonry units, which front borders comprise the same final finishing coat layer as the front face of the remaining masonry units. Units such as the primary masonry unit for borders of gaps (236), shown in detail in situation ii), or the primary masonry half unit for borders of gaps, must be used. The ladder-shaped reinforcement bar units (96) are once again ensured in the horizontal joints.

Figure 19E:
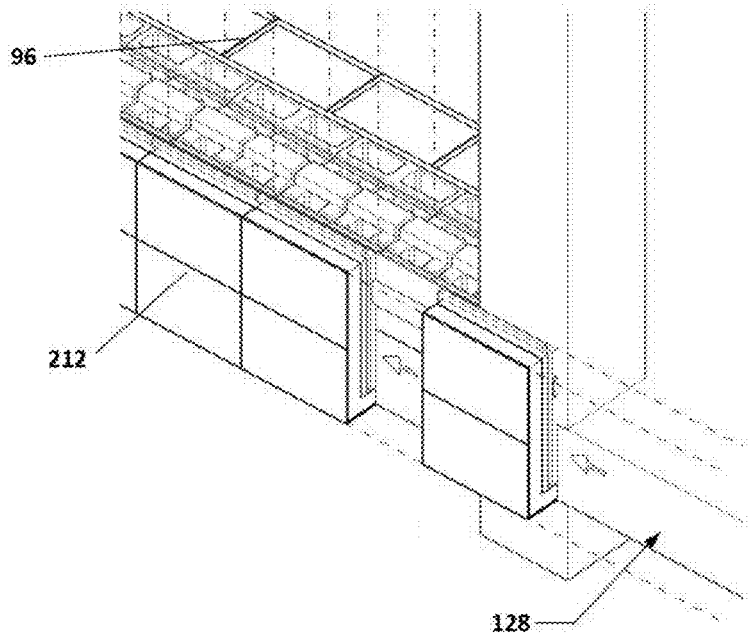
FIG. 19*e* illustrates another stage of a process for overcoming a difficulty due to a singularity which occurs in a wall which is the existence of a window.
Figure 19F:
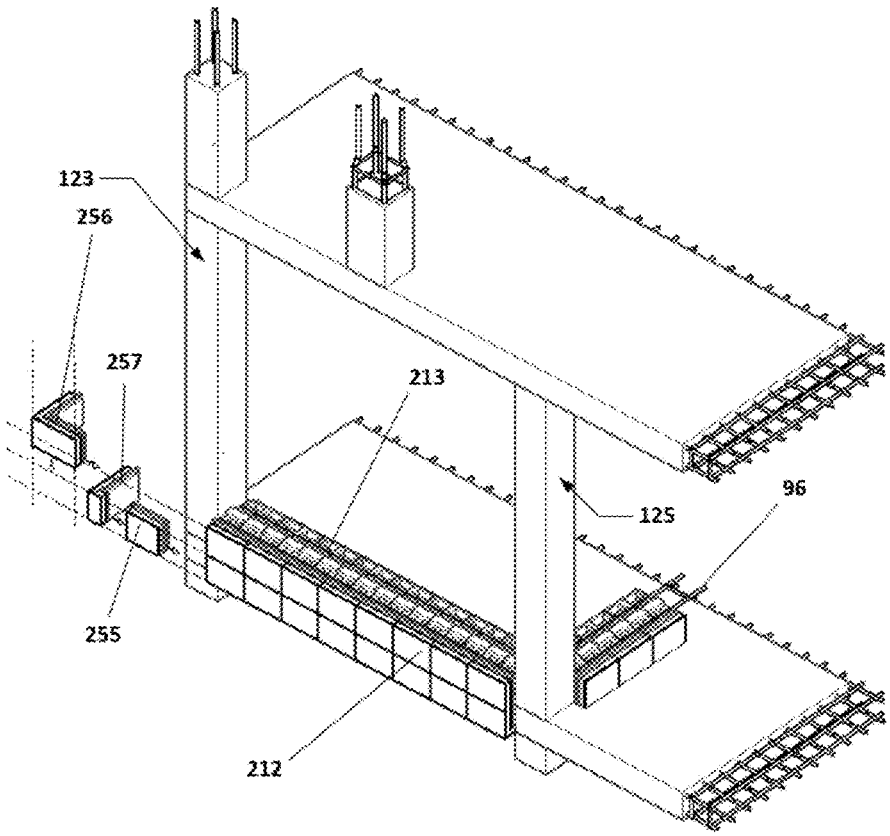
FIG. 19*f* illustrates the final stage of a process for overcoming a difficulty due to a singularity which occurs in a wall which is the existence of a window.

Analyzing FIG. 19*e*, this discloses a more advanced step of the process for masonry construction around a window. With the lower and side borders of the windows already embodied there later exists the need to foresee some element that enables the execution of the upper borders, for which a locally molded or prefabricated lintel can be used (134). Focusing on FIG. 19*f*, this shows the final steps of the process for overcoming the existence of a window in the masonry wall by means of drawings i) and ii). In order to cover the lintel (134) with an aesthetically pleasant appearance that corresponds to that of the remaining borders of the window, to embody the upper borders of the window, the laying of the modified primary masonry units (213) over the linter (134) is carried out. These units guarantee the support for the special covering units (212) which adjust to the modified primary masonry units coating them and coating the lintel. On the corners of the same window, another embodiment of the special covering units with a front face of 30×20 cm (length×height) (259) is fitted in a modified masonry unit (213), which main central ridges must be removed by some mechanical mean, allowing this unit to fit in the space between the lintel and the upper slab. The space left to cover can be covered by a beam covering unit of 15×20 cm (258).

Figure 19G:
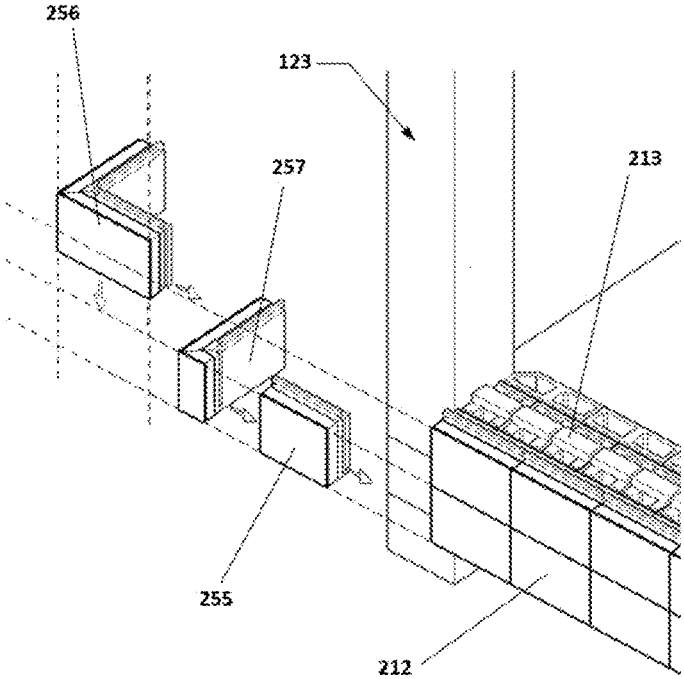
FIG. 19*g* illustrates a process for overcoming another singularity which can occur in the construction of a wall using the masonry system herein described, and which is related to the manner of covering and "concealing" the edge of a slab without the existence of any masonry unit below to provide support.

With reference to FIG. 19*g*, this shows the process of covering the border of the slab of the 2nd floor (129), with the laying of the first row of masonry units of the 2nd floor, the beginning of the process of covering the pillar which goes from the 2nd floor (124) and the first steps to conceal the border of the slab of the 2nd floor, where there do not exist masonry units below to support the covering units. In this example, the slab borders can be covered by regular beam covering units (260), whereby the first row of the 2nd floor is embodied by regular primary masonry units (253). However, in the absence of support due to the lack of existence of masonry units below the part of the slab of the 2nd Floor, a solution such as shown in situation ii) can be carried out, this involving the use of modified primary masonry units (253) in the first row of units of the 2nd floor, which units, due to their elliptical prismatic protuberance, enable the fitting of special covering units (212). These special covering units, once fitted, will cover the masonry unit where they fit and the border of the slab below (129). To fill the spaces not covered by these special covering units there can be used secondary masonry units, such as the beam covering unit of 15×20 cm (258).

Figure 19H:
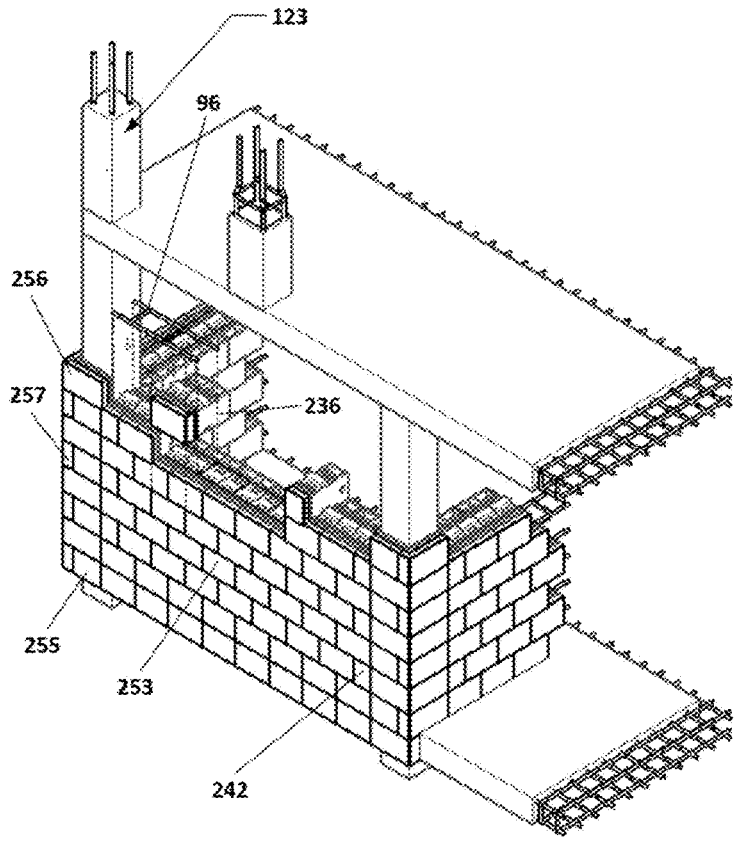
FIG. 19*h* illustrates a process for overcoming another singularity which can occur in the construction of a wall using the masonry system herein described, and which is related to the manner in which the wall can "embrace" a pillar which occurs somewhere within the plane wherein the construction of the wall is developed.
Figure 19I:
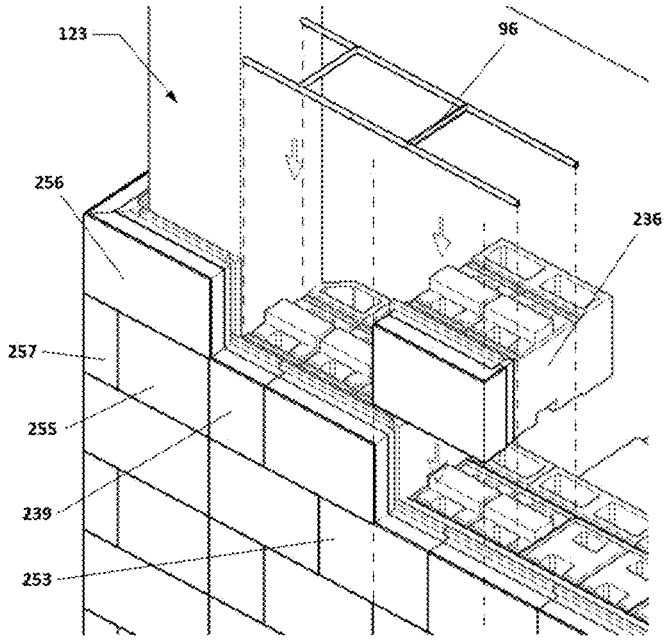
FIG. 19*i* illustrates a wall constructed with units developed for the variation of the masonry system with insulation from the outside, wherein all the previously mentioned singularities are overcome.
Figure 19J:
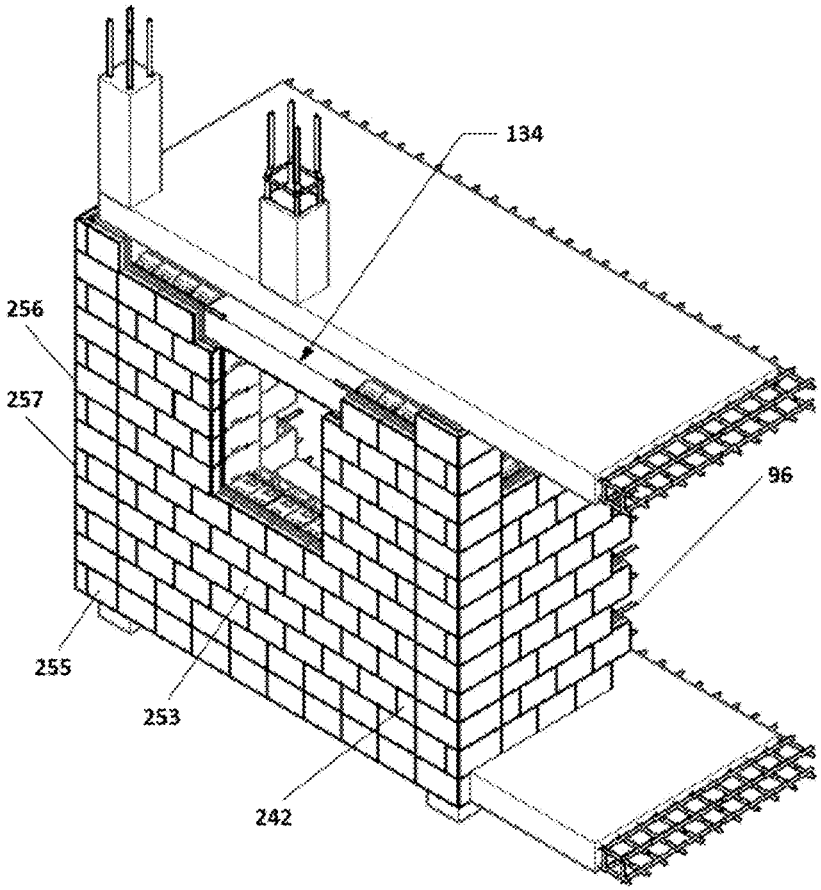
FIG. 19*j* illustrates the same wall in a perspective view, seen from the inner side.
Figure 19K:
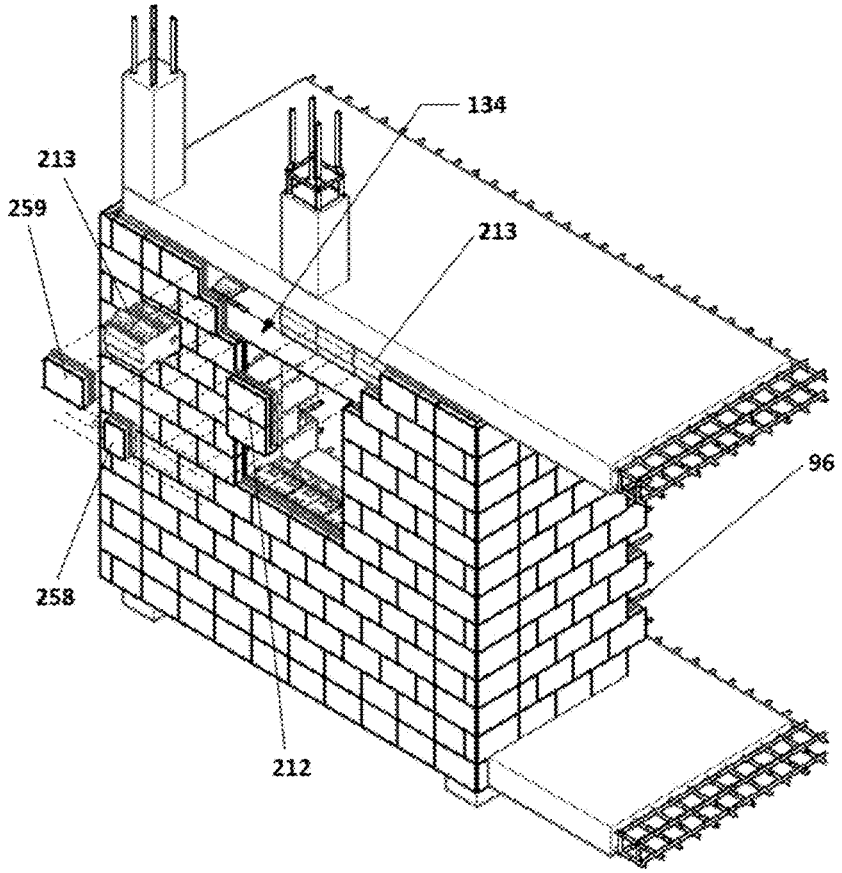
Figure 19L:
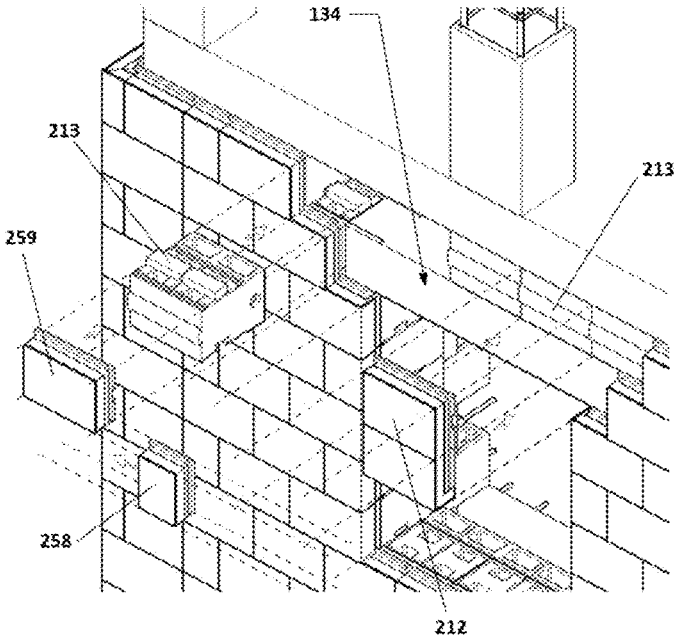
Figure 19M:
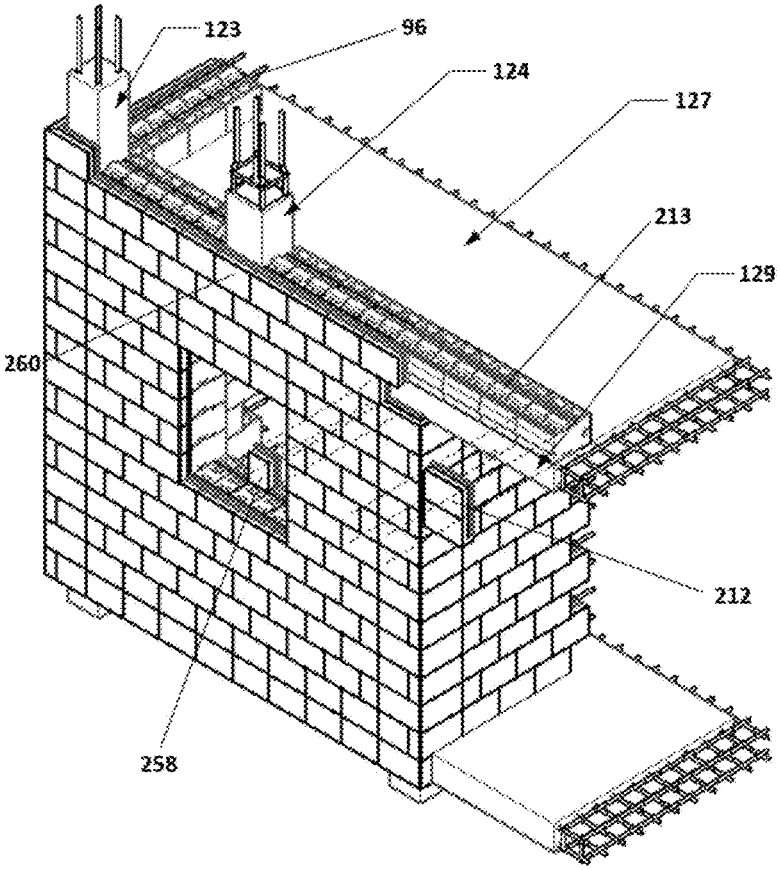
Figure 19N:
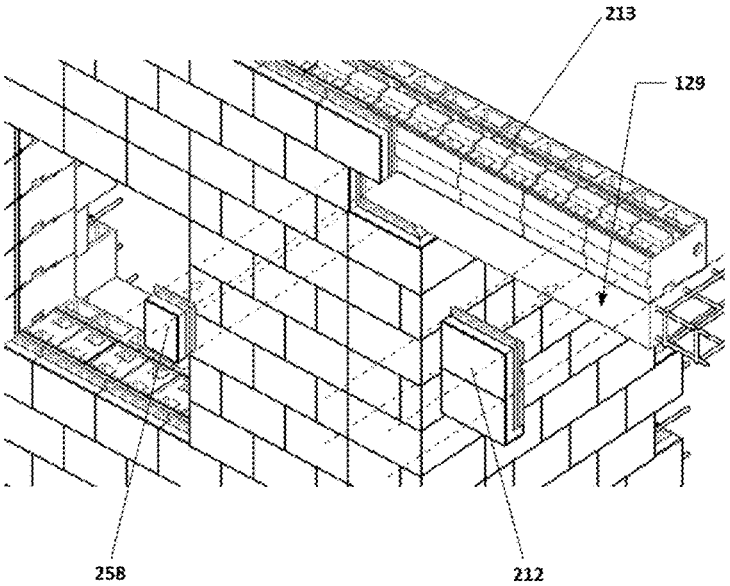
Figure 19O:
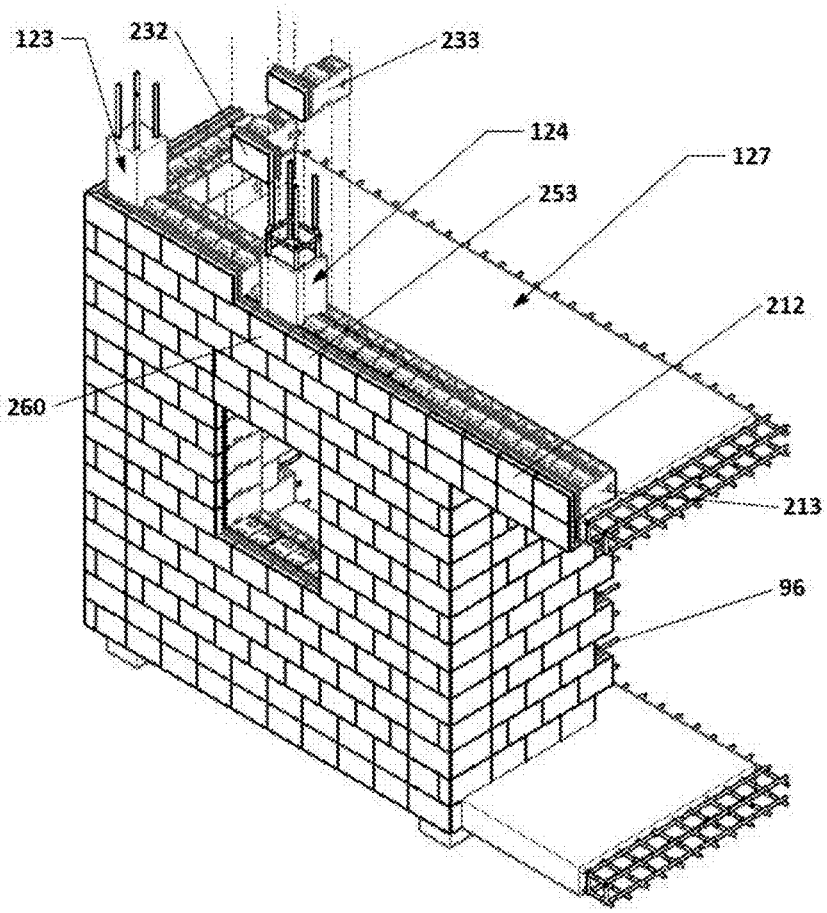
Figure 19P:
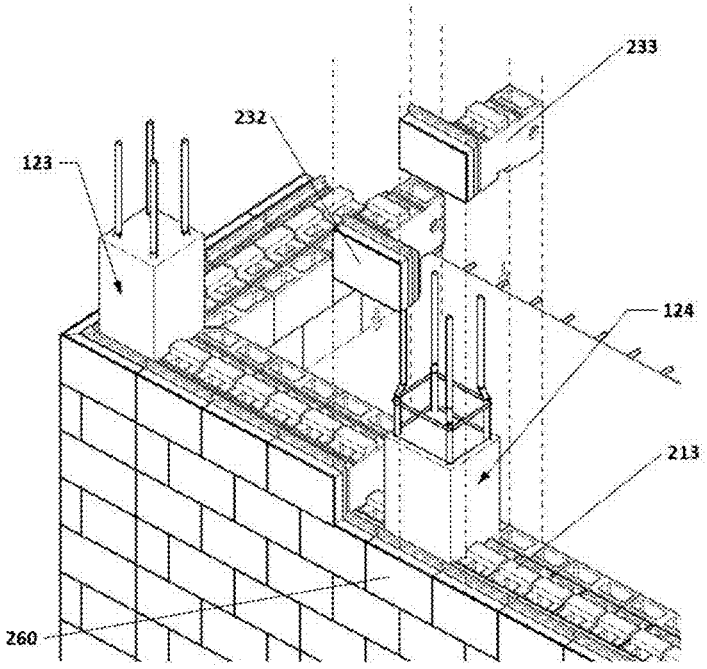
Figure 19Q:
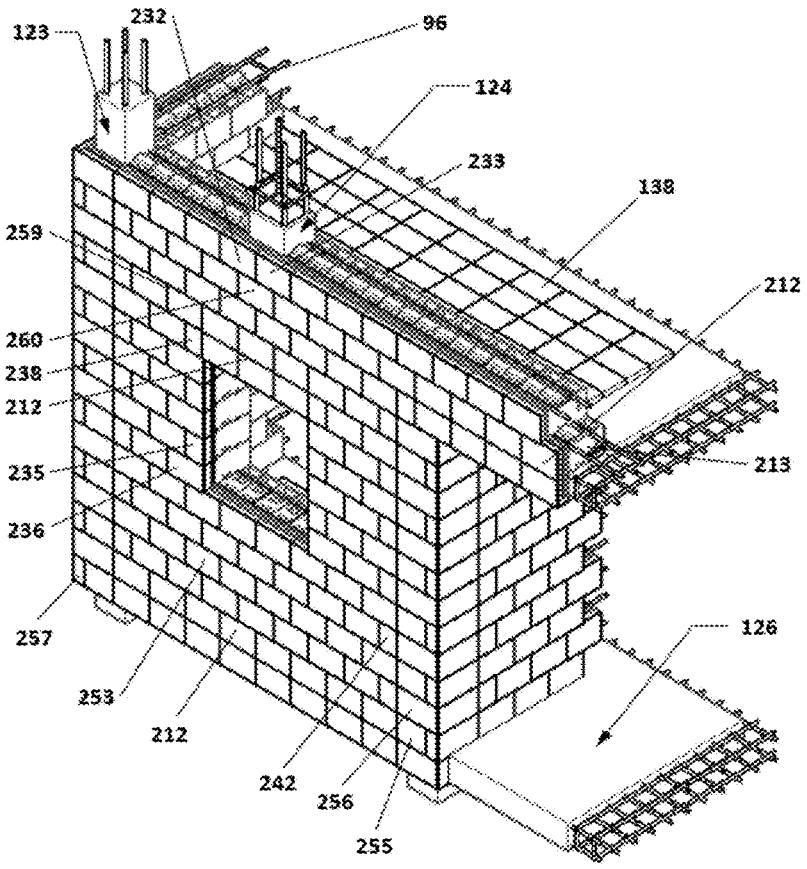
Figure 19R:
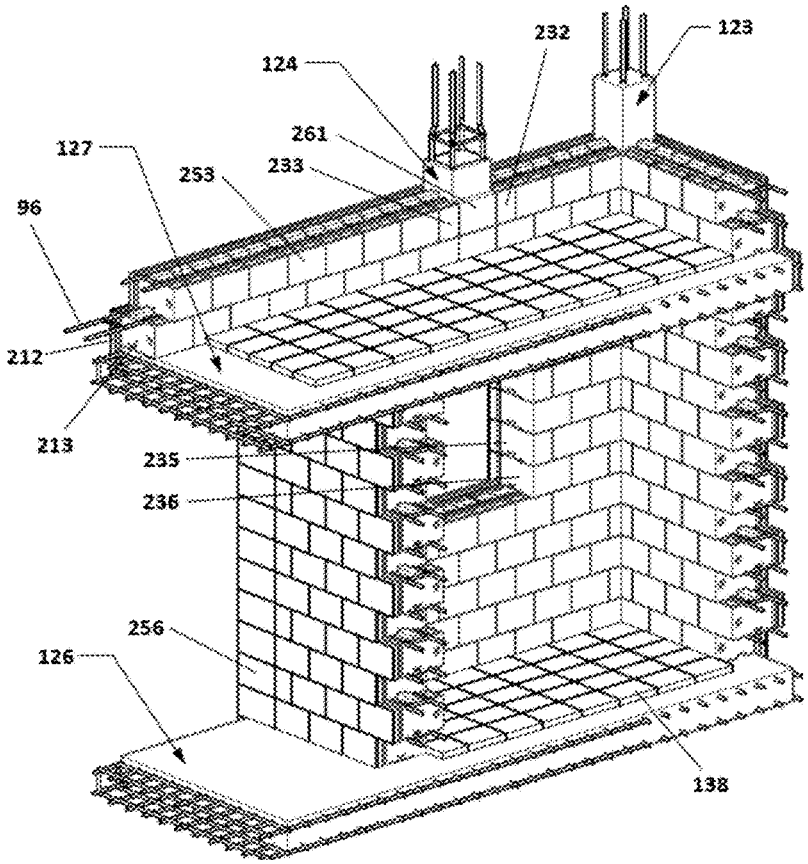

Referring to FIG. 19*h*, this shows a way to contour a pillar somewhere in the middle (124) of the plane where the wall develops. The way to "embrace" this pillar in the masonry system is illustrated by drawings i) —where a generic part of the wall—e ii) is shown. As in the given example, the wall is constructed with unaligned vertical joints, one in each two rows of the masonry units must present a different solution from that which makes use of a regular beam covering unit (260). As such, the masonry system foresees two complementary masonry units, both being a primary masonry half unit with an extension in the covering portion thereof to the left (232) and a primary masonry half unit with an extension of the covering portion thereof to the right (233). Both units are vertically laid in a way that the flat lateral face abuts the lateral face of the other masonry unit, while the lateral face of the extension side abuts the pillar face. FIG. 19*i* shows an upper left front projection of a portion of the wall with all the previously mentioned masonry constructive processes and with insulation boards (138) arranged on top of the slabs of the 1st and the 2nd floors. FIG. 19*j*, in turn, shows an upper left side projection of the rear part of the example given, wherein it is seen a portion of the wall with all masonry constructive processes already referred and with insulation boards (138) placed over the slabs of the 1st and 2nd floors and filling boards (261) to surmount the difference in dimensions between the rear face of the pillars and the rear faces of the masonry units. These boards can be made of the same material as the body of the remaining units.

Figure 20:
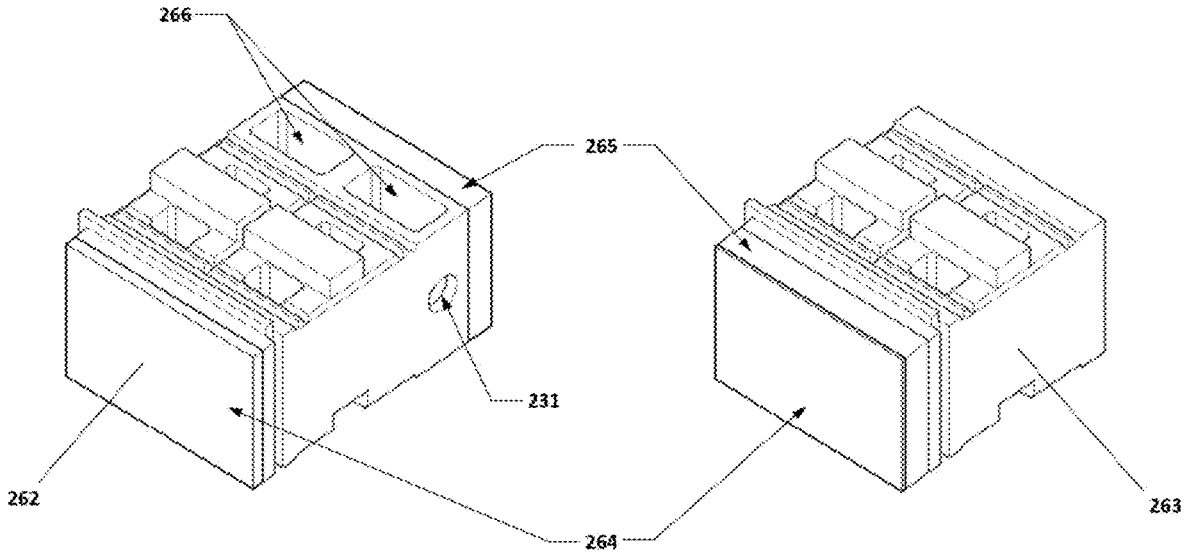
FIG. 20 illustrates perspective views of two other embodiments of the primary masonry unit.

Finally, FIG. 20 illustrates perspective views of two other embodiments of the primary masonry unit. Unit (262) exhibits the same body as the primary unit with insulation from the outside (253), maintaining the rear cavities (266) and the inter-unit communication "window" (231). However, in this embodiment of the primary unit, the insulation layer (265) appears on the inner face thereof, maintaining the front face coated by the final finishing coat layer (264). The rear cavities (266) and the inter-unit "windows" enable accommodating cabling and piping which, however, must be installed judiciously so that they can minimize the crossings of the insulation layer, restricting them to those that are really necessary. The masonry unit represented by 263 presents the same body as the primary masonry unit in its embodiment with insulation from the inside (102), even if, in this case, the insulation layer (265) is presented on the outside, duly covered by the final finishing coating layer (264).

The present description is not, naturally, in any way restricted to the embodiments presented in this document and a person skilled in the art with average knowledge of the area can foresee many possibilities of modification of the same, without departing from the general idea, such as defined in the claims. The preferred embodiments described above are obviously capable of being combined among them. The following claims additionally define preferred embodiments.

The invention claimed is:

1. A masonry system with a final finishing coat layer and insulation layer comprising a primary masonry unit and a secondary masonry unit, wherein the primary masonry unit comprises:

a body comprising an upper main central ridge and a main lower central channel, a secondary lateral channel which is developed along a top and along one side of the primary masonry unit and a secondary lateral channel which develops along a lower part and along an opposite side of a corresponding secondary ridge;

a plurality of longitudinal and transverse semicircular and quarter circle channels arranged over an upper surface and a lower surface of the primary masonry unit;

a plurality of cavities which develop from the upper surface to the lower surface of the primary masonry unit;

a tongue and groove fitting system by means of the main central ridge and secondary ridge and the main central and the secondary lateral channels;

a final finishing coat layer shown on a front/outer face of the primary masonry unit;

a thermal and acoustic insulation layer present on a rear/inner face of the primary masonry unit or in the front/outer face thereof covered by the final finishing coat layer; and a slope by a front top and bottom horizontal edges of the primary masonry unit and which is developed from the secondary ridge and the secondary channel towards the front/outer face;

wherein the secondary masonry unit comprises:

a body comprising a lateral ridge which develops along the top and along one of the sides and a secondary lateral channel which develops along the lower part and along the opposite side of the corresponding ridge;

a final finishing coat layer on the outer/front face;

a slope by the front horizontal top and bottom edges of the unit and which develops from the ridges and channels up to the front face;

a thermal and acoustic insulation layer present in the outer face coated by a final finishing coat layer; and a reinforcement unit covered by pairs of semicircular channels placed on the upper and lower faces of the referred primary masonry unit and secondary masonry unit, wherein the reinforcement unit has one of three shapes: in "reverse C-C", or ladder shaped, or a reinforcement unit comprising a simple bar set.

2. The masonry system with a final finishing coat layer and insulation layer according to claim 1, wherein the body of the secondary masonry unit is an "L" shaped body comprising a lateral ridge which develops along a top of the "L" and along one side of the secondary masonry unit and a lateral channel which develops along a bottom part of the "L" and along an opposite side of a lateral corresponding ridge.

3. The masonry system with a final finishing coat layer and insulation layer according to claim 1, wherein the body of the secondary masonry unit comprising the ridge develops along an upper part, a channel which develops along a lower part and along one side of the secondary masonry unit and the ridge or channel which develops on a rear/inner face of the secondary masonry unit, close to an outer lateral surface.

4. The masonry system with a final finishing coat layer and insulation layer according to claim 1, wherein the primary masonry unit comprises an elliptical prismatic protuberance placed in an intermediary position along the front face of the primary masonry unit, and wherein the secondary masonry unit comprises:

the body comprising the ridge which develops along the top and along one of the sides of the unit and a lateral channel which develops along the opposite side of the corresponding ridge;

an elliptical prismatic channel with dimensions similar to those of the elliptical prismatic protuberance of the masonry primary unit, but inversely;

the final finishing coat layer on the front/outer surface and on the outer lower surface;

the thermal and acoustic insulation layer present in the outer face coated by the final finishing coat layer, only in the secondary unit; and the small slope by the horizontal upper and lower front horizontal edges of the unit and which is developed from the ridges up to the front face.

5. The masonry system with a final finishing coat layer and insulation layer according to claim 1, wherein the primary and secondary masonry units comprising a vertical steel reinforcement soaked in binding material in the cavities are aligned with the primary units immediately above and below.

6. A method for constructing the masonry system with a final finishing coat layer and insulation layer according to claim 1 comprising anchoring and locking the primary and secondary masonry units leading to formwork of reinforced concrete structures simultaneously with the construction of a wall.

7. A masonry wall, comprising a plurality of the masonry system described in claim 1.

* * * * *